US011391442B2

(12) United States Patent
Danesh et al.

(10) Patent No.: US 11,391,442 B2
(45) Date of Patent: Jul. 19, 2022

(54) POLYMER HOUSING FOR A RECESSED LIGHTING SYSTEM AND METHODS FOR USING SAME

(71) Applicant: DMF, Inc., Carson, CA (US)

(72) Inventors: Michael D. Danesh, Carson, CA (US); Amir Lotfi, Redondo Beach, CA (US); Ali A. Nikooyan, Santa Ana, CA (US)

(73) Assignee: DMF, Inc., Carson, CA (US)

( * ) Notice: Subject to any disclaimer, the term of this patent is extended or adjusted under 35 U.S.C. 154(b) by 0 days.

(21) Appl. No.: 17/118,742

(22) Filed: Dec. 11, 2020

(65) Prior Publication Data

US 2021/0254812 A1 Aug. 19, 2021

Related U.S. Application Data

(63) Continuation of application No. PCT/US2019/036477, filed on Jun. 11, 2019.
(Continued)

(51) Int. Cl.
*F21V 15/01* (2006.01)
*F21V 21/04* (2006.01)
*F21V 23/00* (2015.01)

(52) U.S. Cl.
CPC ..... *F21V 15/01* (2013.01); *F21V 21/048* (2013.01); *F21V 23/001* (2013.01)

(58) Field of Classification Search
CPC ..... F21V 15/01; F21V 23/001; F21V 21/048; F21V 21/04; F21V 15/013; F21S 8/02; F21S 8/026
See application file for complete search history.

(56) References Cited

U.S. PATENT DOCUMENTS 1,133,535 A 3/1915 Cain et al.
1,471,340 A 10/1923 Knight
(Continued)

FOREIGN PATENT DOCUMENTS

CA 2243934 C 6/2002
CA 2502637 A1 9/2005
(Continued)

OTHER PUBLICATIONS

2006 International Building Code, Section 712 Penetrations, Jan. 2006, 4 pages.
(Continued)

*Primary Examiner* — Peggy A Neils
(74) *Attorney, Agent, or Firm* — Smith Baluch LLP

(57) ABSTRACT

A recessed lighting system includes multiple components formed from a polymer to reduce the number of components in the system, lower the cost of manufacture, and simplify the installation of the recessed lighting system. In one example, a recessed lighting system includes a housing formed from a polymer, a hanger bar assembly, a light module, and a trim. A yoke may be installed into the housing to provide greater accessibility to mount the light module and/or trim to the housing. A partition plate may be installed to push back wires/cables disposed in the housing such that the cavity of the housing is divided into a wiring compartment containing the wires/cables and a lighting compartment containing the light module and the trim. A hanger bar assembly may also be coupled to the housing to couple the recessed lighting system to a building structure (e.g., a T-bar, a joist, a stud).

20 Claims, 68 Drawing Sheets

Related U.S. Application Data

(60) Provisional application No. 62/791,398, filed on Jan. 11, 2019, provisional application No. 62/749,462, filed on Oct. 23, 2018, provisional application No. 62/683,562, filed on Jun. 11, 2018.

(56) References Cited

U.S. PATENT DOCUMENTS

| | | | |
|---|---|---|---|
| 1,856,356 | A | 5/1932 | Owen |
| 2,038,784 | A | 4/1936 | Ghadiali |
| 2,179,161 | A | 11/1939 | Rambusch |
| 2,197,737 | A | 4/1940 | Appleton |
| 2,352,913 | A | 7/1944 | Morrill |
| 2,528,989 | A | 11/1950 | Ammells |
| 2,597,595 | A | 5/1952 | Ordas |
| 2,642,246 | A | 6/1953 | Larry |
| 2,670,919 | A | 3/1954 | Vincent |
| 2,697,535 | A | 12/1954 | Olson |
| 2,758,810 | A | 8/1956 | Good |
| D180,844 | S | 8/1957 | Poliakoff |
| 2,802,933 | A | 8/1957 | Harry |
| 2,998,512 | A | 8/1961 | Duchene et al. |
| 3,023,920 | A | 3/1962 | Cook et al. |
| 3,057,993 | A | 10/1962 | Gellert |
| 3,104,087 | A | 9/1963 | Joseph et al. |
| 3,214,126 | A | 10/1965 | Roos |
| 3,422,261 | A | 1/1969 | McGinty |
| 3,460,299 | A | 8/1969 | Wilson |
| 3,650,046 | A | 3/1972 | Skinner |
| 3,675,807 | A | 7/1972 | Lund et al. |
| 3,700,885 | A | 10/1972 | Bobrick |
| 3,711,053 | A | 1/1973 | Drake |
| D227,989 | S | 7/1973 | Geisel |
| 3,773,968 | A | 11/1973 | Copp |
| 3,812,342 | A | 5/1974 | Mcnamara |
| 3,836,766 | A | 9/1974 | Auerbach |
| 3,874,035 | A | 4/1975 | Schuplin |
| 3,913,773 | A | 10/1975 | Copp et al. |
| D245,905 | S | 9/1977 | Taylor |
| 4,088,827 | A | 5/1978 | Kohaut |
| 4,154,218 | A | 5/1979 | Hulet |
| 4,154,219 | A | 5/1979 | Gupta et al. |
| 4,176,758 | A | 12/1979 | Glick |
| 4,280,169 | A | 7/1981 | Allen |
| 4,399,497 | A | 8/1983 | Druffel |
| 4,450,512 | A | 5/1984 | Kristofek |
| 4,460,948 | A | 7/1984 | Malola |
| 4,520,435 | A | 5/1985 | Baldwin |
| 4,539,629 | A | 9/1985 | Poppenheimer |
| 4,601,145 | A | 7/1986 | Wilcox |
| 4,667,840 | A | 5/1987 | Lindsey |
| 4,723,747 | A | 2/1988 | Karp et al. |
| 4,729,080 | A | 3/1988 | Fremont et al. |
| 4,754,377 | A | 6/1988 | Wenman |
| 4,770,311 | A | 9/1988 | Wang |
| 4,880,128 | A | 11/1989 | Jorgensen |
| 4,910,651 | A | 3/1990 | Montanez |
| 4,919,292 | A | 4/1990 | Hsu |
| 4,929,187 | A | 5/1990 | Hudson et al. |
| 4,930,054 | A | 5/1990 | Krebs |
| 5,044,582 | A | 9/1991 | Walters |
| D326,537 | S | 5/1992 | Gattari |
| 5,216,203 | A | 6/1993 | Gower |
| 5,222,800 | A | 6/1993 | Chan et al. |
| 5,239,132 | A | 8/1993 | Bartow |
| 5,250,269 | A | 10/1993 | Langer et al. |
| 5,266,050 | A | 11/1993 | O'Neil et al. |
| 5,291,381 | A | 3/1994 | Price |
| 5,303,894 | A | 4/1994 | Deschamps et al. |
| 5,382,752 | A | 1/1995 | Reyhan et al. |
| 5,420,376 | A | 5/1995 | Rajecki et al. |
| 5,465,199 | A | 11/1995 | Bray et al. |
| 5,505,419 | A | 4/1996 | Gabrius |
| 5,544,870 | A | 8/1996 | Kelly et al. |
| 5,562,343 | A | 10/1996 | Chan et al. |
| 5,571,993 | A | 11/1996 | Jones et al. |
| 5,580,158 | A | 12/1996 | Aubrey et al. |
| 5,588,737 | A | 12/1996 | Kusmer |
| 5,603,424 | A | 2/1997 | Bordwell et al. |
| 5,609,408 | A | 3/1997 | Targetti |
| 5,613,338 | A | 3/1997 | Esposito |
| D381,111 | S | 7/1997 | Lecluze |
| 5,662,413 | A | 9/1997 | Akiyama et al. |
| D386,277 | S | 11/1997 | Lecluze |
| 5,690,423 | A | 11/1997 | Hentz et al. |
| D387,466 | S | 12/1997 | Lecluze |
| 5,738,436 | A | 4/1998 | Cummings et al. |
| 5,778,625 | A * | 7/1998 | Druffel ..... F21S 8/02 174/480 |
| 5,836,678 | A | 11/1998 | Wright et al. |
| 5,942,726 | A | 8/1999 | Reiker |
| 5,944,412 | A | 8/1999 | Janos et al. |
| 5,957,573 | A | 9/1999 | Wedekind et al. |
| 5,975,323 | A | 11/1999 | Turan |
| 6,030,102 | A | 2/2000 | Gromotka |
| 6,082,878 | A | 7/2000 | Doubek et al. |
| 6,095,669 | A | 8/2000 | Cho |
| 6,098,945 | A | 8/2000 | Korcz |
| 6,105,334 | A | 8/2000 | Monson et al. |
| 6,161,910 | A | 12/2000 | Reisenauer et al. |
| 6,170,685 | B1 | 1/2001 | Currier |
| 6,170,965 | B1 | 1/2001 | Kotovsky |
| 6,174,076 | B1 | 1/2001 | Petrakis et al. |
| 6,176,599 | B1 | 1/2001 | Farzen |
| 6,267,491 | B1 | 7/2001 | Parrigin |
| 6,332,597 | B1 | 12/2001 | Korcz et al. |
| 6,350,043 | B1 | 2/2002 | Gloisten |
| 6,350,046 | B1 | 2/2002 | Lau |
| 6,364,511 | B1 | 4/2002 | Cohen |
| 6,375,338 | B1 | 4/2002 | Cummings et al. |
| 6,402,112 | B1 | 6/2002 | Thomas et al. |
| D461,455 | S | 8/2002 | Forbes |
| 6,461,016 | B1 | 10/2002 | Jamison et al. |
| 6,474,846 | B1 | 11/2002 | Kelmelis et al. |
| 6,491,413 | B1 | 12/2002 | Benesohn |
| D468,697 | S | 1/2003 | Straub, Jr. |
| D470,970 | S | 2/2003 | Huang |
| 6,515,313 | B1 | 2/2003 | Ibbetson et al. |
| 6,521,833 | B1 | 2/2003 | DeFreitas |
| D471,657 | S | 3/2003 | Huang |
| 6,583,573 | B2 | 6/2003 | Bierman |
| 6,585,389 | B2 | 7/2003 | Bonazzi |
| 6,600,175 | B1 | 7/2003 | Baretz et al. |
| D478,872 | S | 8/2003 | Heggem |
| 6,632,006 | B1 | 10/2003 | Rippel et al. |
| 6,657,236 | B1 | 12/2003 | Thibeault et al. |
| 6,666,419 | B1 | 12/2003 | Vrame |
| D487,600 | S | 3/2004 | Fickas |
| D488,583 | S | 4/2004 | Benghozi |
| 6,719,438 | B2 | 4/2004 | Sevack et al. |
| 6,758,578 | B1 | 7/2004 | Chou |
| 6,777,615 | B1 | 8/2004 | Gretz |
| 6,779,908 | B1 | 8/2004 | Ng |
| 6,827,229 | B2 | 12/2004 | Dinh et al. |
| 6,838,618 | B2 | 1/2005 | Newbold et al. |
| 6,906,352 | B2 | 6/2005 | Edmond et al. |
| D509,314 | S | 9/2005 | Rashidi |
| 6,948,829 | B2 | 9/2005 | Verdes et al. |
| 6,958,497 | B2 | 10/2005 | Emerson et al. |
| 6,964,501 | B2 | 11/2005 | Ryan |
| 6,967,284 | B1 | 11/2005 | Gretz |
| D516,235 | S | 2/2006 | Rashidi |
| 7,025,477 | B2 | 4/2006 | Blessing |
| 7,064,269 | B2 | 6/2006 | Smith |
| D528,673 | S | 9/2006 | Maxik et al. |
| 7,102,172 | B2 | 9/2006 | Lynch |
| D531,740 | S | 11/2006 | Maxik |
| D532,532 | S | 11/2006 | Maxik |
| 7,148,420 | B1 | 12/2006 | Johnson et al. |
| 7,148,632 | B2 | 12/2006 | Berman et al. |
| 7,154,040 | B1 | 12/2006 | Tompkins |
| 7,170,015 | B1 | 1/2007 | Roesch et al. |
| D536,349 | S | 2/2007 | Humber et al. |
| D537,039 | S | 2/2007 | Pincek |

(56) References Cited

U.S. PATENT DOCUMENTS

| | | | |
|---|---|---|---|
| D539,229 | S | 3/2007 | Murphey |
| 7,186,008 | B2 | 3/2007 | Patti |
| 7,190,126 | B1 | 3/2007 | Paton |
| 7,211,833 | B2 | 5/2007 | Slater, Jr. et al. |
| 7,213,940 | B1 | 5/2007 | Van De Ven et al. |
| 7,234,674 | B2 | 6/2007 | Rippel et al. |
| D547,889 | S | 7/2007 | Huang |
| D552,969 | S | 10/2007 | Bobrowski et al. |
| D553,267 | S | 10/2007 | Yuen |
| D555,106 | S | 11/2007 | Pape et al. |
| D556,144 | S | 11/2007 | Dinh |
| 7,297,870 | B1 | 11/2007 | Sartini |
| 7,312,474 | B2 | 12/2007 | Emerson et al. |
| 7,320,536 | B2 | 1/2008 | Petrakis et al. |
| D561,372 | S | 2/2008 | Yan |
| D561,373 | S | 2/2008 | Yan |
| 7,335,920 | B2 | 2/2008 | Denbaars et al. |
| D563,896 | S | 3/2008 | Greenslate |
| 7,347,580 | B2 | 3/2008 | Blackman et al. |
| D570,012 | S | 5/2008 | Huang |
| 7,374,308 | B2 | 5/2008 | Sevack et al. |
| D570,504 | S | 6/2008 | Maxik et al. |
| D570,505 | S | 6/2008 | Maxik et al. |
| 7,399,104 | B2 | 7/2008 | Rappaport |
| 7,429,025 | B1 | 9/2008 | Gretz |
| D578,677 | S | 10/2008 | Huang |
| 7,431,482 | B1 | 10/2008 | Morgan et al. |
| 7,432,440 | B2 | 10/2008 | Hull et al. |
| 7,442,883 | B2 | 10/2008 | Jolly et al. |
| 7,446,345 | B2 | 11/2008 | Emerson et al. |
| 7,470,048 | B2 | 12/2008 | Wu |
| 7,473,005 | B2 | 1/2009 | O'Brien |
| 7,488,097 | B2 | 2/2009 | Reisenauer et al. |
| 7,488,098 | B2 | 2/2009 | Dumont |
| 7,494,258 | B2 | 2/2009 | McNaught |
| 7,503,145 | B2 | 3/2009 | Newbold et al. |
| 7,524,089 | B2 | 4/2009 | Park |
| D591,894 | S | 5/2009 | Flank |
| 7,534,989 | B2 | 5/2009 | Suehara et al. |
| D596,154 | S | 7/2009 | Rivkin |
| 7,566,154 | B2 | 7/2009 | Gloisten et al. |
| D599,040 | S | 8/2009 | Alexander et al. |
| D600,836 | S | 9/2009 | Hanley et al. |
| 7,588,359 | B2 | 9/2009 | Coushaine et al. |
| 7,592,583 | B2 | 9/2009 | Page et al. |
| D606,696 | S | 12/2009 | Chen et al. |
| 7,625,105 | B1 | 12/2009 | Johnson |
| 7,628,513 | B2 | 12/2009 | Chiu |
| 7,651,238 | B2 | 1/2010 | O'Brien |
| 7,654,705 | B2 | 2/2010 | Czech et al. |
| D611,650 | S | 3/2010 | Broekhoff |
| 7,670,021 | B2 | 3/2010 | Chou |
| 7,673,841 | B2 | 3/2010 | Wronski |
| 7,677,766 | B2 | 3/2010 | Boyer |
| 7,692,182 | B2 | 4/2010 | Bergmann et al. |
| 7,704,763 | B2 | 4/2010 | Fujii et al. |
| D616,118 | S | 5/2010 | Thomas et al. |
| 7,712,922 | B2 | 5/2010 | Hacker et al. |
| 7,722,208 | B1 | 5/2010 | Dupre et al. |
| 7,722,227 | B2 | 5/2010 | Zhang et al. |
| 7,735,795 | B2 | 6/2010 | Wronski |
| 7,735,798 | B2 | 6/2010 | Kojima |
| 7,748,887 | B2 | 7/2010 | Zampini, II et al. |
| 7,766,518 | B2 | 8/2010 | Piepgras et al. |
| 7,769,192 | B2 | 8/2010 | Takagi et al. |
| 7,771,082 | B2 | 8/2010 | Peng |
| 7,771,094 | B2 | 8/2010 | Goode |
| 7,784,754 | B2 | 8/2010 | Nevers et al. |
| D624,691 | S | 9/2010 | Zhang et al. |
| D624,692 | S | 9/2010 | Mackin et al. |
| D625,847 | S | 10/2010 | Maglica |
| D625,876 | S | 10/2010 | Chen et al. |
| D627,507 | S | 11/2010 | Lai et al. |
| D627,727 | S | 11/2010 | Alexander et al. |
| 7,828,465 | B2 | 11/2010 | Roberge et al. |
| D629,366 | S | 12/2010 | Ericson et al. |
| 7,845,393 | B2 | 12/2010 | Kao et al. |
| 7,857,275 | B2 | 12/2010 | de la Borbolla |
| 7,871,184 | B2 | 1/2011 | Peng |
| 7,874,539 | B2 | 1/2011 | Wright et al. |
| 7,874,703 | B2 | 1/2011 | Shastry et al. |
| 7,874,709 | B1 | 1/2011 | Beadle |
| D633,224 | S | 2/2011 | Lee |
| 7,909,487 | B1 | 3/2011 | Venetucci et al. |
| D636,117 | S | 4/2011 | Kim et al. |
| D636,118 | S | 4/2011 | Kim et al. |
| D636,903 | S | 4/2011 | Torenbeek |
| D637,339 | S | 5/2011 | Hasan et al. |
| D637,340 | S | 5/2011 | Hasan et al. |
| 7,950,832 | B2 | 5/2011 | Tanaka et al. |
| D639,499 | S | 6/2011 | Choi et al. |
| D640,819 | S | 6/2011 | Pan |
| 7,956,546 | B2 | 6/2011 | Hasnain |
| 7,959,332 | B2 | 6/2011 | Tickner et al. |
| 7,967,480 | B2 | 6/2011 | Pickard et al. |
| D642,317 | S | 7/2011 | Rashidi |
| 7,972,035 | B2 | 7/2011 | Boyer |
| 7,972,043 | B2 | 7/2011 | Schutte |
| D642,536 | S | 8/2011 | Robinson |
| D643,970 | S | 8/2011 | Kim et al. |
| 7,993,037 | B1 | 8/2011 | Buse |
| 8,002,425 | B2 | 8/2011 | Russo et al. |
| D646,011 | S | 9/2011 | Rashidi |
| 8,013,243 | B2 | 9/2011 | Korcz et al. |
| 8,038,113 | B2 | 10/2011 | Fryzek et al. |
| D648,476 | S | 11/2011 | Choi et al. |
| D648,477 | S | 11/2011 | Kim et al. |
| D650,115 | S | 12/2011 | Kim et al. |
| 8,070,328 | B1 | 12/2011 | Knoble et al. |
| 8,096,670 | B2 | 1/2012 | Trott |
| D654,205 | S | 2/2012 | Rashidi |
| D656,262 | S | 3/2012 | Yoshinobu et al. |
| D656,263 | S | 3/2012 | Ogawa et al. |
| 8,142,057 | B2 | 3/2012 | Roos et al. |
| 8,152,334 | B2 | 4/2012 | Krogman |
| D658,788 | S | 5/2012 | Dudik et al. |
| D658,802 | S | 5/2012 | Chen |
| D659,862 | S | 5/2012 | Tsai |
| D659,879 | S | 5/2012 | Rashidi |
| D660,814 | S | 5/2012 | Wilson |
| 8,182,116 | B2 | 5/2012 | Zhang et al. |
| 8,201,968 | B2 | 6/2012 | Maxik et al. |
| D663,058 | S | 7/2012 | Pan |
| D663,466 | S | 7/2012 | Rashidi |
| D664,274 | S | 7/2012 | de Visser et al. |
| D664,705 | S | 7/2012 | Kong et al. |
| 8,215,805 | B2 | 7/2012 | Cogliano et al. |
| 8,220,970 | B1 | 7/2012 | Khazi et al. |
| 8,226,270 | B2 | 7/2012 | Yamamoto et al. |
| 8,235,549 | B2 | 8/2012 | Gingrich, III et al. |
| 8,238,050 | B2 | 8/2012 | Minano et al. |
| 8,240,630 | B2 | 8/2012 | Wronski |
| D667,155 | S | 9/2012 | Rashidi |
| 8,262,255 | B1 | 9/2012 | Rashidi |
| D668,372 | S | 10/2012 | Renshaw et al. |
| D668,809 | S | 10/2012 | Rashidi |
| D669,198 | S | 10/2012 | Qui |
| D669,199 | S | 10/2012 | Chuang |
| D669,620 | S | 10/2012 | Rashidi |
| 8,277,090 | B2 | 10/2012 | Fryzek et al. |
| D671,668 | S | 11/2012 | Rowlette, Jr. et al. |
| 8,308,322 | B2 | 11/2012 | Santiago et al. |
| D672,899 | S | 12/2012 | Ven et al. |
| D673,869 | S | 1/2013 | Yu |
| D676,263 | S | 2/2013 | Birke |
| D676,814 | S | 2/2013 | Paul |
| 8,376,593 | B2 | 2/2013 | Bazydola et al. |
| D677,417 | S | 3/2013 | Rashidi |
| D677,634 | S | 3/2013 | Korcz et al. |
| D679,044 | S | 3/2013 | Jeswani et al. |
| D679,047 | S | 3/2013 | Tickner et al. |
| 8,403,533 | B1 | 3/2013 | Paulsel |
| 8,403,541 | B1 | 3/2013 | Rashidi |
| 8,405,947 | B1 | 3/2013 | Green et al. |

(56) References Cited

U.S. PATENT DOCUMENTS

D681,259 S 4/2013 Kong
8,408,759 B1 4/2013 Rashidi
D682,459 S 5/2013 Gordin et al.
D683,063 S 5/2013 Lopez et al.
D683,890 S 6/2013 Lopez et al.
D684,269 S 6/2013 Wang et al.
D684,287 S 6/2013 Rashidi
D684,719 S 6/2013 Rashidi
D685,118 S 6/2013 Rashidi
D685,120 S 6/2013 Rashidi
8,454,204 B1 6/2013 Chang et al.
D685,507 S 7/2013 Sun
D687,586 S 8/2013 Rashidi
D687,587 S 8/2013 Rashidi
D687,588 S 8/2013 Rashidi
D687,980 S 8/2013 Gravely et al.
D688,405 S 8/2013 Kim et al.
8,506,127 B2 8/2013 Russello et al.
8,506,134 B2 8/2013 Wilson et al.
D690,049 S 9/2013 Rashidi
D690,864 S 10/2013 Rashidi
D690,865 S 10/2013 Rashidi
D690,866 S 10/2013 Rashidi
D691,314 S 10/2013 Rashidi
D691,315 S 10/2013 Samson
D691,763 S 10/2013 Hand et al.
8,550,669 B2 10/2013 Macwan et al.
D693,043 S 11/2013 Schmalfuss et al.
D693,517 S 11/2013 Davis
D694,456 S 11/2013 Rowlette, Jr. et al.
D695,441 S 12/2013 Lui et al.
D695,941 S 12/2013 Rashidi
D696,446 S 12/2013 Huh
D696,447 S 12/2013 Huh
D696,448 S 12/2013 Huh
8,602,601 B2 12/2013 Khazi et al.
D698,067 S 1/2014 Rashidi
D698,068 S 1/2014 Rashidi
8,622,361 B2 1/2014 Wronski
8,632,040 B2 1/2014 Mass et al.
D698,985 S 2/2014 Lopez et al.
D699,384 S 2/2014 Rashidi
D699,687 S 2/2014 Baldwin et al.
D700,387 S 2/2014 Snell
8,641,243 B1 2/2014 Rashidi
8,659,034 B2 2/2014 Baretz et al.
D700,991 S 3/2014 Johnson et al.
D701,175 S 3/2014 Baldwin et al.
D701,466 S 3/2014 Clifford et al.
8,672,518 B2 3/2014 Boomgaarden et al.
D702,867 S 4/2014 Kim et al.
D703,843 S 4/2014 Cheng
8,684,569 B2 4/2014 Pickard et al.
8,696,158 B2 4/2014 Santiago et al.
D705,472 S 5/2014 Huh
D705,481 S 5/2014 Zhang et al.
8,727,582 B2 5/2014 Brown et al.
D708,381 S 7/2014 Rashidi
8,777,449 B2 7/2014 Ven et al.
D710,529 S 8/2014 Lopez et al.
8,801,217 B2 8/2014 Gehle et al.
8,820,985 B1 9/2014 Tam et al.
8,833,013 B2 9/2014 Harman
8,845,144 B1 9/2014 Davies et al.
D714,989 S 10/2014 Rowlette, Jr. et al.
8,870,426 B2 10/2014 Biebl et al.
8,888,332 B2 11/2014 Martis et al.
8,890,414 B2 11/2014 Rowlette, Jr. et al.
D721,845 S 1/2015 Lui et al.
8,926,133 B2 1/2015 Booth
8,939,418 B2 1/2015 Green et al.
D722,296 S 2/2015 Taylor
D722,977 S 2/2015 Hagarty
D722,978 S 2/2015 Hagarty
8,950,898 B2 2/2015 Catalano
D723,781 S 3/2015 Miner
D723,783 S 3/2015 Miner
D725,359 S 3/2015 Miner
8,967,575 B1 3/2015 Gretz
D726,363 S 4/2015 Danesh
D726,949 S 4/2015 Redfern
D728,129 S 4/2015 Kreuzbichler
9,004,435 B2 4/2015 Wronski
9,039,254 B2 5/2015 Danesh
D731,689 S 6/2015 Bernard et al.
9,062,866 B1 6/2015 Christ et al.
9,065,264 B2 6/2015 Cooper et al.
9,068,719 B2 6/2015 Van De Ven et al.
9,068,722 B2 6/2015 Wronski et al.
D734,525 S 7/2015 Gordin et al.
D735,012 S 7/2015 Cowie
D735,142 S 7/2015 Hagarty
9,078,299 B2 7/2015 Ashdown
9,109,760 B2 8/2015 Shum et al.
9,109,783 B1 * 8/2015 Davis ..... F21V 23/001
D739,355 S 9/2015 D'Aubeterre
D739,590 S 9/2015 Redfern
9,140,441 B2 9/2015 Goelz et al.
D741,538 S 10/2015 Ghasabi
9,151,457 B2 10/2015 Pickard et al.
9,151,477 B2 10/2015 Pickard et al.
D742,325 S 11/2015 Leung
D743,079 S 11/2015 Adair
D744,723 S 12/2015 Yoo
9,217,560 B2 12/2015 Harbers et al.
9,222,661 B2 12/2015 Kim et al.
9,239,131 B1 1/2016 Wronski et al.
D750,317 S 2/2016 Lui et al.
9,285,103 B2 3/2016 Van De Ven et al.
9,291,319 B2 3/2016 Kathawate et al.
9,301,362 B2 3/2016 Dohn et al.
D754,078 S 4/2016 Baldwin et al.
D754,079 S 4/2016 Baldwin et al.
D754,605 S 4/2016 McMillan
9,303,812 B2 4/2016 Green et al.
9,310,038 B2 4/2016 Athalye
9,310,052 B1 4/2016 Shum
9,322,543 B2 4/2016 Hussell et al.
D756,025 S 5/2016 Wronski et al.
9,347,655 B2 5/2016 Boomgaarden et al.
9,366,418 B2 6/2016 Gifford
9,371,966 B2 6/2016 Rowlette, Jr. et al.
D762,181 S 7/2016 Lin
9,395,051 B2 7/2016 Hussell et al.
D762,906 S 8/2016 Jeswani et al.
D764,079 S 8/2016 Wu
9,417,506 B1 8/2016 Tirosh
9,423,110 B1 8/2016 Newton et al.
D766,185 S 9/2016 Hagarty
D767,199 S 9/2016 Wronski et al.
9,447,917 B1 9/2016 Wronski et al.
9,447,953 B2 9/2016 Lawlor
D768,325 S 10/2016 Xu
D768,326 S 10/2016 Guzzini
D769,501 S 10/2016 Jeswani et al.
D770,065 S 10/2016 Tittle
D770,076 S 10/2016 Li et al.
9,476,552 B2 10/2016 Myers et al.
9,488,324 B2 11/2016 Shum et al.
D774,676 S 12/2016 Ng
D776,324 S 1/2017 Gierl et al.
D777,967 S 1/2017 Redfern
9,534,751 B2 1/2017 Maglica et al.
D778,241 S 2/2017 Holbrook et al.
D778,484 S 2/2017 Guzzini
D779,100 S 2/2017 Redfern
9,581,302 B2 2/2017 Danesh
9,599,315 B1 3/2017 Harpenau et al.
9,605,842 B1 3/2017 Davis
9,605,910 B2 3/2017 Swedberg et al.
D785,228 S 4/2017 Guzzini
D786,472 S 5/2017 Redfern
D786,473 S 5/2017 Dean
D786,474 S 5/2017 Fujisawa

(56) References Cited

U.S. PATENT DOCUMENTS

| | | | |
|---|---|---|---|
| D788,330 | S | 5/2017 | Johnson et al. |
| D790,102 | S | 6/2017 | Guzzini |
| 9,673,597 | B2 | 6/2017 | Lee |
| 9,689,541 | B2 | 6/2017 | Wronski |
| D791,709 | S | 7/2017 | Holton |
| D791,711 | S | 7/2017 | Holton |
| D791,712 | S | 7/2017 | Holton |
| 9,696,021 | B2 | 7/2017 | Wronski |
| 9,702,516 | B1 | 7/2017 | Vasquez et al. |
| D795,820 | S | 8/2017 | Wengreen |
| 9,732,904 | B1 | 8/2017 | Wronski |
| 9,732,947 | B1 | 8/2017 | Christ et al. |
| 9,739,464 | B2 | 8/2017 | Wronski |
| D799,105 | S | 10/2017 | Eder et al. |
| D800,957 | S | 10/2017 | Eder et al. |
| 9,791,111 | B1 | 10/2017 | Huang et al. |
| 9,797,562 | B2 | 10/2017 | Dabiet et al. |
| 9,803,839 | B2 | 10/2017 | Visser et al. |
| D805,660 | S | 12/2017 | Creasman et al. |
| 9,854,642 | B2 | 12/2017 | Kashani |
| D809,176 | S | 1/2018 | Partington |
| 9,860,961 | B2 | 1/2018 | Chemel et al. |
| 9,863,619 | B2 | 1/2018 | Mak |
| D809,465 | S | 2/2018 | Keirstead |
| 9,903,569 | B2 | 2/2018 | O'Brien et al. |
| 9,945,548 | B2 | 4/2018 | Williams et al. |
| 9,964,266 | B2 | 5/2018 | Danesh |
| D820,494 | S | 6/2018 | Cohen |
| D821,615 | S | 6/2018 | Trice |
| D821,627 | S | 6/2018 | Ko |
| 9,995,441 | B2 | 6/2018 | Power et al. |
| D822,505 | S | 7/2018 | Gibson et al. |
| D824,494 | S | 7/2018 | Martins et al. |
| D825,829 | S | 8/2018 | Guo |
| 10,041,638 | B2 | 8/2018 | Vasquez et al. |
| 10,054,274 | B2 | 8/2018 | Athalye et al. |
| D827,903 | S | 9/2018 | Wu |
| 10,072,805 | B2 | 9/2018 | Bailey |
| D832,218 | S | 10/2018 | Wronski et al. |
| D833,977 | S | 11/2018 | Danesh et al. |
| 10,125,959 | B2 | 11/2018 | Cohen |
| 10,139,059 | B2 | 11/2018 | Danesh |
| D836,976 | S | 1/2019 | Reese et al. |
| 10,244,607 | B1 | 3/2019 | Kashani |
| D847,414 | S | 4/2019 | Danesh et al. |
| D847,415 | S | 4/2019 | Danesh et al. |
| 10,247,390 | B1 | 4/2019 | Kopitzke et al. |
| D848,375 | S | 5/2019 | Danesh et al. |
| 10,281,131 | B2 | 5/2019 | Cohen |
| 10,295,163 | B1 | 5/2019 | Cohen |
| D850,695 | S | 6/2019 | Dabiet et al. |
| D851,046 | S | 6/2019 | Peng et al. |
| 10,408,395 | B2 | 9/2019 | Danesh |
| 10,408,396 | B2 | 9/2019 | Wronski et al. |
| 10,408,436 | B2 | 9/2019 | Wronski et al. |
| D863,661 | S | 10/2019 | Tian et al. |
| D864,467 | S | 10/2019 | Mizobe |
| D864,877 | S | 10/2019 | Danesh |
| D867,653 | S | 11/2019 | Gorman |
| 10,488,000 | B2 | 11/2019 | Danesh et al. |
| 10,551,044 | B2 | 2/2020 | Peng et al. |
| 10,563,850 | B2 | 2/2020 | Danesh |
| D877,957 | S | 3/2020 | Kopitzke, IV |
| 10,591,120 | B2 | 3/2020 | Bailey et al. |
| 10,609,785 | B1 | 3/2020 | Fardadi et al. |
| D880,733 | S | 4/2020 | Lo et al. |
| D883,562 | S | 5/2020 | Hu |
| D885,648 | S | 5/2020 | Zeng |
| D885,649 | S | 5/2020 | McLaughlin, III et al. |
| 10,663,127 | B2 | 5/2020 | Danesh et al. |
| 10,663,153 | B2 | 5/2020 | Nikooyan et al. |
| D888,313 | S | 6/2020 | Xie et al. |
| 10,683,994 | B2 | 6/2020 | Wronski et al. |
| 10,684,003 | B2 | 6/2020 | Wronski et al. |
| D890,410 | S | 7/2020 | Stanford et al. |
| 10,704,745 | B2 | 7/2020 | Sherry et al. |
| 10,753,558 | B2 | 8/2020 | Danesh |
| 10,808,917 | B2 * | 10/2020 | Harris ..... F21V 21/04 |
| 10,816,148 | B2 | 10/2020 | Danesh |
| D901,398 | S | 11/2020 | Danesh et al. |
| D901,745 | S | 11/2020 | Yang |
| D902,160 | S | 11/2020 | Cohen |
| D902,871 | S | 11/2020 | Danesh et al. |
| D903,605 | S | 12/2020 | Danesh et al. |
| D905,327 | S | 12/2020 | Williams et al. |
| D907,284 | S | 1/2021 | Danesh et al. |
| D910,223 | S | 2/2021 | Cohen |
| 10,975,570 | B2 | 4/2021 | Shen |
| 10,982,829 | B2 | 4/2021 | Danesh |
| 11,022,259 | B2 | 6/2021 | Bailey et al. |
| 11,028,982 | B2 | 6/2021 | Danesh |
| 11,047,538 | B2 | 6/2021 | Danesh et al. |
| D924,467 | S | 7/2021 | Danesh et al. |
| D925,109 | S | 7/2021 | Danesh et al. |
| 11,060,705 | B1 | 7/2021 | Danesh et al. |
| 11,067,231 | B2 | 7/2021 | Lotfi et al. |
| 11,085,597 | B2 | 8/2021 | Danesh |
| 2002/0172047 | A1 | 11/2002 | Ashley |
| 2003/0006353 | A1 | 1/2003 | Dinh et al. |
| 2003/0016532 | A1 | 1/2003 | Reed |
| 2003/0021104 | A1 | 1/2003 | Tsao |
| 2003/0161153 | A1 | 8/2003 | Patti |
| 2004/0001337 | A1 | 1/2004 | Defouw et al. |
| 2004/0120141 | A1 | 6/2004 | Beadle |
| 2004/0156199 | A1 | 8/2004 | Rivas et al. |
| 2005/0078474 | A1 | 4/2005 | Whitfield |
| 2005/0121215 | A1 | 6/2005 | Halbert |
| 2005/0225966 | A1 | 10/2005 | Hartmann et al. |
| 2005/0227536 | A1 | 10/2005 | Gamache et al. |
| 2005/0231962 | A1 | 10/2005 | Koba et al. |
| 2005/0237746 | A1 | 10/2005 | Yiu |
| 2006/0005988 | A1 | 1/2006 | Jorgensen |
| 2006/0158873 | A1 | 7/2006 | Newbold et al. |
| 2006/0198126 | A1 | 9/2006 | Jones |
| 2006/0215408 | A1 | 9/2006 | Lee |
| 2006/0221620 | A1 | 10/2006 | Thomas |
| 2006/0237601 | A1 | 10/2006 | Rinderer |
| 2006/0243877 | A1 | 11/2006 | Rippel |
| 2006/0250788 | A1 | 11/2006 | Hodge et al. |
| 2006/0262536 | A1 | 11/2006 | Nevers |
| 2006/0262545 | A1 | 11/2006 | Piepgras et al. |
| 2007/0012847 | A1 | 1/2007 | Tai |
| 2007/0035951 | A1 | 2/2007 | Tseng |
| 2007/0121328 | A1 | 5/2007 | Mondloch et al. |
| 2007/0131827 | A1 | 6/2007 | Nevers et al. |
| 2007/0185675 | A1 | 8/2007 | Papamichael et al. |
| 2007/0200039 | A1 | 8/2007 | Petak |
| 2007/0206374 | A1 | 9/2007 | Petrakis et al. |
| 2008/0002414 | A1 | 1/2008 | Miletich et al. |
| 2008/0019138 | A1 | 1/2008 | Otte et al. |
| 2008/0112168 | A1 | 5/2008 | Pickard et al. |
| 2008/0112170 | A1 | 5/2008 | Trott |
| 2008/0112171 | A1 | 5/2008 | Patti et al. |
| 2008/0130308 | A1 | 6/2008 | Behr et al. |
| 2008/0137347 | A1 | 6/2008 | Trott et al. |
| 2008/0165545 | A1 | 7/2008 | O'Brien |
| 2008/0170404 | A1 | 7/2008 | Steer et al. |
| 2008/0224008 | A1 | 9/2008 | Dal Ponte et al. |
| 2008/0232116 | A1 | 9/2008 | Kim |
| 2008/0247181 | A1 | 10/2008 | Dixon |
| 2008/0285271 | A1 | 11/2008 | Roberge et al. |
| 2009/0003009 | A1 | 1/2009 | Tessnow et al. |
| 2009/0034261 | A1 | 2/2009 | Grove |
| 2009/0080189 | A1 | 3/2009 | Wegner |
| 2009/0086484 | A1 | 4/2009 | Johnson |
| 2009/0097262 | A1 | 4/2009 | Zhang et al. |
| 2009/0135613 | A1 | 5/2009 | Peng |
| 2009/0141500 | A1 | 6/2009 | Peng |
| 2009/0141506 | A1 | 6/2009 | Lan et al. |
| 2009/0141508 | A1 | 6/2009 | Peng |
| 2009/0147517 | A1 | 6/2009 | Li |
| 2009/0161356 | A1 | 6/2009 | Negley et al. |
| 2009/0237924 | A1 | 9/2009 | Ladewig |
| 2009/0280695 | A1 | 11/2009 | Sekela et al. |

(56) References Cited

U.S. PATENT DOCUMENTS

2009/0283292 A1 11/2009 Lehr
2009/0290343 A1 11/2009 Brown et al.
2010/0014282 A1 1/2010 Danesh
2010/0033095 A1 2/2010 Sadwick
2010/0061108 A1 3/2010 Zhang et al.
2010/0110690 A1 5/2010 Hsu et al.
2010/0110698 A1 5/2010 Harwood et al.
2010/0110699 A1 5/2010 Chou
2010/0148673 A1 6/2010 Stewart et al.
2010/0149822 A1 6/2010 Cogliano et al.
2010/0165643 A1 7/2010 Russo et al.
2010/0244709 A1 9/2010 Steiner et al.
2010/0246172 A1 9/2010 Liu
2010/0259919 A1 10/2010 Khazi et al.
2010/0270903 A1 10/2010 Jao et al.
2010/0277905 A1 11/2010 Janik et al.
2010/0284185 A1 11/2010 Ngai
2010/0302778 A1 12/2010 Dabiet et al.
2010/0328956 A1 12/2010 Zhang
2011/0043040 A1 2/2011 Porter et al.
2011/0063831 A1 3/2011 Cook
2011/0068687 A1 3/2011 Takahasi et al.
2011/0069499 A1 3/2011 Trott et al.
2011/0080750 A1 4/2011 Jones et al.
2011/0116276 A1 5/2011 Okamura et al.
2011/0121756 A1 5/2011 Thomas et al.
2011/0134634 A1 6/2011 Gingrich, III et al.
2011/0134651 A1 6/2011 Berman
2011/0140633 A1 6/2011 Archenhold
2011/0170294 A1 7/2011 Mier-Langner et al.
2011/0194299 A1 8/2011 Crooks et al.
2011/0216534 A1 9/2011 Tickner et al.
2011/0226919 A1 9/2011 Fryzek et al.
2011/0255292 A1 10/2011 Shen
2011/0267828 A1 11/2011 Bazydola et al.
2011/0285314 A1 11/2011 Carney et al.
2012/0020104 A1 1/2012 Biebl et al.
2012/0074852 A1 3/2012 Delnoij
2012/0106176 A1 5/2012 Lopez et al.
2012/0113642 A1 5/2012 Catalano
2012/0140442 A1 6/2012 Woo et al.
2012/0140465 A1 6/2012 Rowlette, Jr. et al.
2012/0162994 A1 6/2012 Wasniewski et al.
2012/0182744 A1 7/2012 Santiago et al.
2012/0188762 A1 7/2012 Joung et al.
2012/0243237 A1 9/2012 Toda et al.
2012/0250321 A1 10/2012 Blincoe et al.
2012/0266449 A1 10/2012 Krupa
2012/0268688 A1 10/2012 Sato et al.
2012/0287625 A1 11/2012 Macwan et al.
2012/0305868 A1 12/2012 Callahan et al.
2012/0314429 A1 12/2012 Plunk
2013/0009552 A1 1/2013 Page
2013/0010476 A1 1/2013 Pickard et al.
2013/0016864 A1 1/2013 Ivey et al.
2013/0033872 A1 2/2013 Randolph et al.
2013/0050994 A1 2/2013 Pieper
2013/0051012 A1 2/2013 Oehle et al.
2013/0077307 A1 3/2013 Yamamoto
2013/0083529 A1 4/2013 Gifford
2013/0141913 A1 6/2013 Sachsenweger
2013/0155681 A1 6/2013 Nall et al.
2013/0163254 A1 6/2013 Chang et al.
2013/0170232 A1 7/2013 Park et al.
2013/0170233 A1 7/2013 Nezu et al.
2013/0227908 A1 9/2013 Gulbrandsen et al.
2013/0258677 A1 10/2013 Fryzek et al.
2013/0265750 A1 10/2013 Pickard et al.
2013/0271989 A1 10/2013 Hussell et al.
2013/0294084 A1 11/2013 Kathawate et al.
2013/0301252 A1 11/2013 Hussell et al.
2013/0322062 A1 12/2013 Danesh
2013/0322084 A1 12/2013 Ebisawa
2013/0335980 A1 12/2013 Nakasuji et al.
2014/0029262 A1 1/2014 Maxik et al.
2014/0036497 A1 2/2014 Hussell et al.
2014/0049957 A1 2/2014 Goelz et al.
2014/0063776 A1 3/2014 Clark et al.
2014/0071679 A1 3/2014 Booth
2014/0071687 A1 3/2014 Tickner et al.
2014/0140490 A1 5/2014 Roberts et al.
2014/0063818 A1 6/2014 Randolph et al.
2014/0233246 A1 8/2014 Lafreniere et al.
2014/0254177 A1 9/2014 Danesh
2014/0268836 A1 9/2014 Thompson
2014/0268869 A1 9/2014 Blessitt et al.
2014/0299730 A1 10/2014 Green et al.
2014/0313775 A1 10/2014 Myers et al.
2014/0321122 A1 10/2014 Domagala et al.
2014/0347848 A1 11/2014 Pisavadia et al.
2015/0009676 A1 1/2015 Danesh
2015/0029732 A1 1/2015 Hatch
2015/0078008 A1 3/2015 He
2015/0085500 A1 3/2015 Cooper et al.
2015/0092449 A1 4/2015 Demuynck et al.
2015/0131301 A1 5/2015 Ho
2015/0138779 A1 5/2015 Livesay et al.
2015/0153635 A1 6/2015 Chen et al.
2015/0184837 A1 7/2015 Zhang et al.
2015/0198324 A1 7/2015 O'Brien et al.
2015/0219317 A1 8/2015 Gatof et al.
2015/0233556 A1 8/2015 Danesh
2015/0241039 A1 8/2015 Fryzek
2015/0263497 A1 9/2015 Korcz et al.
2015/0276185 A1 10/2015 Bailey et al.
2015/0308662 A1 10/2015 Vice et al.
2015/0345761 A1 12/2015 Lawlor
2015/0362159 A1 12/2015 Ludyjan
2016/0084488 A1 3/2016 Wu et al.
2016/0209007 A1 7/2016 Belmonte et al.
2016/0238225 A1 8/2016 Doust
2016/0308342 A1 10/2016 Witherbee et al.
2016/0312987 A1 10/2016 Danesh
2016/0348860 A1 12/2016 Danesh
2016/0348861 A1 12/2016 Bailey et al.
2016/0366738 A1 12/2016 Boulanger et al.
2017/0003007 A1 1/2017 Wronski
2017/0005460 A1 1/2017 Lee
2017/0045213 A1 2/2017 Williams et al.
2017/0059135 A1 3/2017 Jones
2017/0138576 A1 5/2017 Peng et al.
2017/0138581 A1 5/2017 Doust
2017/0167672 A1 6/2017 Stauner et al.
2017/0167699 A1 6/2017 Schubert et al.
2017/0198896 A1 7/2017 May
2017/0284616 A1 10/2017 Coakley et al.
2017/0307188 A1 10/2017 Oudina et al.
2017/0307198 A1* 10/2017 Shah ..... F21V 5/04
2018/0112857 A1 4/2018 Wronski et al.
2018/0142871 A1 5/2018 Morales
2018/0216809 A1 8/2018 Cohen
2018/0224095 A1 8/2018 Cohen
2018/0283677 A1 10/2018 Cohen
2019/0032874 A1 1/2019 Bonnetto et al.
2019/0041050 A1 2/2019 Cairns et al.
2019/0049080 A1 2/2019 Danesh
2019/0063701 A1 2/2019 Lotfi et al.
2019/0063724 A1 2/2019 Vice et al.
2019/0093836 A1 3/2019 Danesh
2020/0182420 A1 6/2020 Cohen et al.
2020/0291652 A1 9/2020 Shen
2020/0355334 A1 11/2020 Shen et al.
2020/0393118 A1 12/2020 Danesh et al.
2021/0010647 A1 1/2021 Danesh et al.
2021/0010663 A1 1/2021 Nikooyan et al.
2021/0033268 A1 2/2021 Danesh
2021/0080081 A1 3/2021 Cohen
2021/0080084 A1 3/2021 Danesh et al.
2021/0222845 A1 7/2021 Kopitzke et al.

FOREIGN PATENT DOCUMENTS

CA 2691480 C 4/2012
CA 2734369 A1 10/2013

(56) References Cited

FOREIGN PATENT DOCUMENTS

| | | | |
|---|---|---|---|
| CA | 2561459 | A1 | 11/2013 |
| CA | 2815067 | | 11/2013 |
| CA | 2848289 | A1 | 10/2014 |
| CA | 2998173 | | 7/2018 |
| CN | 2182475 | Y | 11/1994 |
| CN | 201059503 | Y | 5/2008 |
| CN | 201259125 | Y | 6/2009 |
| CN | 101608781 | A | 12/2009 |
| CN | 201636626 | U | 11/2010 |
| CN | 102062373 | A | 5/2011 |
| CN | 202014067 | U | 10/2011 |
| CN | 202392473 | U | 8/2012 |
| CN | 202733693 | U | 2/2013 |
| CN | 103307518 | A | 9/2013 |
| CN | 103322476 | A | 9/2013 |
| CN | 203202661 | U | 9/2013 |
| CN | 203215483 | U | 9/2013 |
| CN | 101498411 | B | 11/2013 |
| CN | 203273663 | U | 11/2013 |
| CN | 203297980 | U | 11/2013 |
| CN | 203628464 | U | 12/2013 |
| CN | 203641919 | U | 6/2014 |
| CN | 204300818 | U | 4/2015 |
| CN | 104654142 | A | 5/2015 |
| CN | 204513161 | U | 7/2015 |
| CN | 204611541 | U | 9/2015 |
| CN | 204786225 | U | 11/2015 |
| CN | 204829578 | U | 12/2015 |
| CN | 103712135 | B | 4/2016 |
| CN | 205606362 | U | 9/2016 |
| CN | 206130742 | U | 4/2017 |
| CN | 103154606 | B | 5/2017 |
| CN | 206222112 | U | 6/2017 |
| CN | 107013845 | A | 8/2017 |
| CN | 107084343 | A | 8/2017 |
| DE | 9109828 | U1 | 2/1992 |
| DE | 199 47 208 | | 5/2001 |
| EP | 1 589 289 | | 10/2005 |
| EP | 1 672 155 | A1 | 6/2006 |
| EP | 1688663 | | 8/2006 |
| EP | 2 095 938 | A1 | 2/2008 |
| EP | 2 306 072 | A1 | 4/2011 |
| EP | 2 453 169 | A2 | 5/2012 |
| EP | 2 193 309 | B1 | 7/2012 |
| EP | 2 735 787 | A1 | 5/2014 |
| EP | 3 104 024 | A1 | 12/2016 |
| GB | 2325728 | | 12/1998 |
| GB | 2427020 | A | 12/2006 |
| GB | 2466875 | | 7/2010 |
| GB | 2471929 | | 1/2014 |
| GB | 2509772 | A | 7/2014 |
| JP | H02113002 | U | 9/1990 |
| JP | 2007091052 | A | 4/2007 |
| JP | 2007265961 | A | 10/2007 |
| JP | 2011060450 | A2 | 3/2011 |
| JP | 2012064551 | A2 | 3/2012 |
| JP | 2015002027 | A2 | 1/2015 |
| JP | 2015002028 | A2 | 1/2015 |
| JP | 2016219335 | A | 12/2016 |
| JP | 2017107699 | A2 | 6/2017 |
| KR | 1020110008796 | A | 1/2011 |
| KR | 1020120061625 | A | 6/2012 |
| MX | 2011002947 | A | 9/2011 |
| TW | 474382 | U | 1/2002 |
| WO | WO 2013/128896 | A1 | 9/2013 |
| WO | WO 2015/000212 | A1 | 1/2015 |
| WO | WO 2016152166 | A2 | 9/2016 |

OTHER PUBLICATIONS

Acrich COB Zhaga Module, Product Description, Seoul Semiconductor, Nov. 11, 2016, 39 pages.

<https://www.zhagastandard.org/books/book18/>, Mar. 2017, 5 pages. Accessed on May 14, 2018.

Bortz, J. C. et al., "Optimal design of a nonimaging TIR doublet lens for an illumination system using an LED source", Proc. SPIE 5529, Nonimaging Optics and Efficient Illumination Systems, (Sep. 29, 2004); doi: 10.1117/12.562598; https://doi.org/10.1117/12.562598, 10 pages.

BXUV.GuideInfo, Fire Resistance Ratings—ANSI/UL 263, UL Online Certifications Directory, last updated Nov. 3, 2016, 27 pages.

CEYY.GuideInfo, Outlet Boxes and Fittings Certified for Fire Resistance, UL Online Certifications Directory, last updated May 16, 2013, 2 pages.

Canadian Office Action dated Dec. 23, 2013 from Canadian Application No. 2,778,581, 3 pages.

Canadian Office Action dated Mar. 22, 2016 from Canadian Application No. 2,879,629, 4 pages.

Canadian Office Action dated Dec. 6, 2016 from Canadian Application No. 2,879,629, 3 pages.

Canadian Office Action dated Mar. 9, 2017 from Canadian Application No. 2,931,588, 5 pages.

Canadian Office Action dated Feb. 1, 2016 from Canadian Application No. 2,879,486, 5 pages.

Canadian Office Action dated Jun. 12, 2017 from Canadian Application No. 2,927,601, 4 pages.

Canadian Office Action dated Aug. 11, 2017 from Canadian Application No. 2,941,051, 4 pages.

Carlon® Zip Box® Blue™ Switch and Outlet Boxes, Product Brochure, http://www.carlonsales.com/brochures.php, Jun. 20, 2006, 22 pages.

Cree LED Lamp Family Sales Sheet—Better light is beautiful light, Apr. 24, 2017, 2 pages.

DME Series Installation Instructions, Oct. 18, 2011, 2 pages.

DMF, Inc., "dmfLIGHTING: LED Recessed Lighting Solutions," Info sheets, Mar. 15, 2012, 4 pages.

DMF, Inc., "dmfLIGHTING: LED Recessed Downlighting," DRD2 Product Brochure, Oct. 23, 2014, 50 pages.

DMF, Inc., "dmfLIGHTING: LED Recessed Downlighting," Product Catalog, Aug. 2012, 68 pages.

Dross, O. et al., "Review of SMS design methods and real-world applications", Proc. SPIE 5529, Nonimaging Optics and Efficient Illumination Systems, (Sep. 29, 2004); doi: 10.1117/12.561336; https://doi.org/10.1117/12.561336, 14 pages.

Final Office Action dated Apr. 27, 2016 from U.S. Appl. No. 14/184,601, 19 pages.

Final Office Action dated Jul. 26, 2017 from U.S. Appl. No. 14/184,601, 18 pages.

Final Office Action dated Jan. 29, 2016 from U.S. Appl. No. 14/183,424, 21 pages.

Final Office Action dated Jun. 23, 2016 from U.S. Appl. No. 13/484,901, 18 pages.

Final Office Action dated Apr. 2, 2015 from U.S. Appl. No. 13/484,901, 13 pages.

Halo, Halo LED H4 H7 Collection, SustainabLEDesign, Cooper Lighting, (emphasis on p. 18 "H7 Collection LED Modules—Halo LED H7 Module Features,") Mar. 28, 2012, 52 pages.

Halo, H7 LED Downlight Trims 49x Series, 6-inch LED Trims for Use with MI7x LED Modules, Cooper Lighting, ADV110422, rev. Aug. 12, 2011, 15 pages.

Halo, LED Module ML706x, Cooper Lighting, General Installation for All Modules/p. 1; Tether Installation/pp. 2-3; Installation into HALO H750x Series LED—only (Non-Screw Based), Recessed Fixture, p. 4, Oct. 20, 2009, 4 pages.

Medvedev, V et al., "Uniform LED illuminator for miniature displays," Proc. SPIE 3428, Illumination and Source Engineering, (Oct. 20, 1998); doi: 10.1117/12.327957;https://doi.org/10.1117/12.327957, 13 pages.

"Membrane Penetrations in Fire-Resistance Rated Walls," https://www.ul.com/wp-content/uploads/2014/04/ul_MembranePenetrations.pdf, Issue 1, 2009, published Feb. 26, 2010, 2 pages.

"Metallic Outlet Boxes," UL 514A, Underwriters Laboratories, Inc., Feb. 16, 2004 (Title Page Reprinted Aug. 10, 2007), 106 pages.

"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.

(56) References Cited

OTHER PUBLICATIONS

Notice of Allowance dated Mar. 26, 2018 for U.S. Appl. No. 14/184,601, 10 pages.
Non-Final Office Action dated Mar. 15, 2010 from U.S. Appl. No. 12/100,148, 8 pages.
Non-Final Office Action dated Apr. 30, 2010 from U.S. Appl. No. 12/173,232, 13 pages.
Non-Final Office Action dated Sep. 5, 2014 from U.S. Appl. No. 13/791,087, 8 pages.
Non-Final Office Action dated Jul. 20, 2015 from U.S. Appl. No. 14/184,601, 16 pages.
Non-Final Office Action dated Dec. 15, 2016 from U.S. Appl. No. 14/184,601, 18 pages.
Non-Final Office Action dated Feb. 6, 2018 from U.S. Appl. No. 15/167,682, 9 pages.
Non-Final Office Action dated Sep. 15, 2015 from U.S. Appl. No. 13/484,901, 16 pages.
Non-Final Office Action dated Oct. 16, 2014 from U.S. Appl. No. 13/484,901, 11 pages.
Non-Final Office Action dated Sep. 6, 2017 from U.S. Appl. No. 14/726,064, 8 pages.
Non-Final Office Action dated May 17, 2017 from U.S. Appl. No. 14/183,424, 20 pages.
Non-Final Office Action dated Jun. 2, 2015 from U.S. Appl. No. 14/183,424, 20 pages.
Non-Final Office Action dated Apr. 12, 2018 for U.S. Appl. No. 29/638,259, 5 pages.
Non-Final Office Action dated May 16, 2018 for U.S. Appl. No. 15/132,875, 18 pages.
Notice of Allowance dated Jan. 30, 2015 from U.S. Appl. No. 13/791,087, 9 pages.
Notice of Allowance dated Jan. 16, 2015 from U.S. Appl. No. 29/467,026, 9 pages.
Notice of Allowance dated Oct. 21, 2016 from U.S. Appl. No. 13/484,901, 7 pages.
Notice of Allowance dated Mar. 24, 2016 from U.S. Appl. No. 14/247,149, 8 pages.
Notice of Allowance dated May 22, 2018 from U.S. Appl. No. 14/183,424, 9 pages.
Notice of Allowance dated May 10, 2018 from U.S. Appl. No. 14/726,064, 7 pages.
Notice of Allowance dated Aug. 23, 2017 from Canadian Application No. 2,879,629, 1 page.
"Outlet Boxes for Use in Fire Rated Assemblies," https://www.ul.com/wp-content/uploads/2014/04/UI_outletboxes.pdf, Apr. 2007, 2 pages.
Notice of Allowance dated Sep. 21, 2018 from U.S. Appl. No. 29/645,941, 5 pages.
"Advanced LED Solutions," Imtra Marine Lighting. Jun. 17, 2011. 39 pages.
"Portland Bi-Color, Warm White/Red," item:ILIM30941.Imtra Marine Products. 2012. 3 pages. Accessed athttp://www.imtra.com:80/0ade25fb-3218-4cae-a926-6abe64ffd93a/lighting-light-fixtures-downlights-3-to-4-inches-detail.htm on Jan. 25, 2013.
"Cree LMH2 LED Modules," Mouser Electronics. Accesssed at www.mouser.com/new/cree/creelmh2 on Sep. 9, 2012. 2 pages.
"Cree LMH2 LED Module with TrueWhite Technology," Cree Product Family Data Sheet. Dec. 21, 2011. 3 pages.
"Cree LMH2 LED Modules Design Guide," Cree Product Design Guide. 2011. 20 pages.
"Undercabinet Pucks, Xyris Mini LED Puck Light," ELCO Lighting. Sep. 2018. 1 page.
"LED Undercabinet Pocket Guide," ELCO Lighting. Nov. 2, 2016. 12 pages.
"Versi LED Mini Flush," Lithonia Lghting. Sep. 2013. 6 pages.
Notice of Allowance dated Oct. 4, 2018 from U.S. Appl. No. 15/947,065, 9 pages.
Notice of Allowance dated Sep. 19, 2018 from U.S. Appl. No. 15/167,682, 7 pages.
Non-Final Office Action dated Jun. 25, 2018 for U.S. Appl. No. 29/541,565, 10 pages.
Non-Final Office Action dated Oct. 24, 2018 for U.S. Appl. No. 15/688,266, 14 pages.
OneFrame Recessed LED Downlight. Dmflighting.com. Published Jun. 6, 2018. Retrieved at https://www.dmflighting.com/product/oneframe on Jun. 6, 2018. 11 pages.
Notice of Allowance dated Oct. 9, 2018 from U.S. Appl. No. 29/653,142, 7 pages.
International Search Report and Written Opinion in PCT/US2018/048357 dated Nov. 14, 2018, 13 pages.
Notice of Allowance dated Nov. 27, 2018 from U.S. Appl. No. 15/167,682, 11 pages.
Non-Final Office Action dated Dec. 5, 2018 from U.S. Appl. No. 14/942,937, 13 pages.
International Search Report and Written Opinion in International Patent Application No. PCT/US18/39048 dated Dec. 14, 2018. 24 pages.
Notice of Allowance dated Jan. 2, 2019 from U.S. Appl. No. 29/541,565, 6 pages.
RACO 4 i+A882:C958n. Octagon Welded Concrete Ring, 3-1/2 in. Deep with 1/2 and 3/4 in. Knockouts and ilcludes 890 cover (20-Pack). Model # 280. Accessed at https://www.homedepot.com/p/RACO-4-in-Octagon-Welded-Concrete-Ring-3-1-2-in-Deep-with-1-2-and-3-4-in-Knockouts-and-ilcludes-890-cover-20-Pack-280/203638679 on Jan. 18, 2019. 3 pages.
RACO 4 in. Octagon Welded Concrete Ring, 6 in. Deep with 1/2 and 3/4 in. Knockouts (10-Pack). Model # 276. Accessed at https://www.homedepot.com/p/RACO-4-in-Octagon-Welded-Concrete-Ring-6-in-Deep-with-1-2-and-3-4-in-Knockouts-10-Pack-276/203638675 on Jan. 16, 2019. 4 pages.
Notice of Allowance dated Feb. 8, 2019 from U.S. Appl. No. 29/541,565, 5 pages.
Non-Final Office Action dated Feb. 7, 2019 from U.S. Appl. No. 16/200,393, 32 pages.
Notice of Allowance dated Jan. 28, 2019 from U.S. Appl. No. 29/664,471, 8 pages.
Non-Final Office Action dated Jul. 24, 2018 from U.S. Appl. No. 29/638,259, 5 pages.
Final Office Action dated Mar. 15, 2019 from U.S. Appl. No. 15/132,875, 15 pages.
International Search Report and Written Opinion in International Patent Application No. PCT/US18/62868 dated Mar. 14, 2019, 13 pages.
CS&E PCT Collaborative Search and Examination Pilot Upload Peer Contribution in International Patent Application No. PCT/US18/62868 dated Mar. 14, 2019, 61 pages.
Notice of Allowance dated Apr. 1, 2019 from U.S. Appl. No. 15/167,682, 7 pages.
Non-Final Office Action dated Apr. 4, 2019 from U.S. Appl. No. 29/678,482, 8 pages.
Notice of Allowance dated Apr. 8, 2019 from U.S. Appl. No. 29/653,142, 8 pages.
Notice of Allowance dated Apr. 17, 2019 from U.S. Appl. No. 29/678,478, 7 pages.
International Search Report and Written Opinion in International Patent Application No. PCT/US18/67614 dated Apr. 25, 2019, 20 pages.
CS&E PCT Collaborative Search and Examination Pilot Upload Peer Contribution in International Patent Application No. PCT/US18/67614 dated Apr. 24, 2019, 53 pages.
Specification & Features 4" Octagonal Concrete Box Covers. Orbit Industries, Inc. Accessed at https://www.orbitelectric.com on May 6, 2019. 1 page.
4" Octagon Concrete Boxes and Back Plates. Appleton. Accessed at www.appletonelec.com on May 6, 2019. 1 page.
RACO Commercial, Industrial and Residential Electrical Products. Hubbell. Accessed at www.Hubbell-RTB.com on May 6, 2019. 356 pages.
Imtra Marine Lighting 2008 Catalog. 40 pages.
Imtra Marine Lighting 2009 Catalog. 32 pages.
Imtra Marine Lighting Spring 2007 Catalog. 36 pages.

(56) References Cited

OTHER PUBLICATIONS

Final Office Action dated Jun. 6, 2019 from U.S. Appl. No. 15/688,266, 7 pages.
Non-Final Office Action dated Jun. 11, 2019 from U.S. Appl. No. 15/901,738, 6 pages.
Notice of Allowance dated Jun. 12, 2019 from U.S. Appl. No. 16/016,040, 8 pages.
Cooper Lighting Halo ML56 LED System Product Sheet. Mar. 2, 2015. Accessed at http://www.cooperindustries.com/content/dam/public/lighting/products/documents/halo/spec_sheets/halo-ml56600-80cri-141689-sss.pdf. 8 pages.
KWIKBRACE® New Construction Braces for Lighting Fixtures or Ceiling Fans 1-1/2 in. Depth. Hubbel. Accessed at https://hubbellcdn.com/specsheet/926.pdf on Jun. 27, 2019. 1 page.
IC1JB Housing 4" IC-Rated New Construction Junction Box Housing. AcuityBrands. Accessed at https://www.acuitybrands.com/en/products/detail/845886/juno/ic1jb-housing/4-ic-rated-new-construction-junction-box-housing on Jun. 27, 2019.
Ex-Parte Quayle Action mailed Jun. 27, 2019 from U.S. Appl. No. 29/683,730, 5 pages.
Notice of Allowance dated Jul. 31, 2019 from U.S. Appl. No. 15/167,682, 7 pages.
Supplemental Notice of Allowance dated Aug. 5, 2019 from U.S. Appl. No. 15/947,065, 2 pages.
International Search Report and Written Opinion in International Patent Application No. PCT/US19/32281 dated Aug. 2, 2019, 18 pages.
Notice of Allowance dated Sep. 11, 2019 from U.S. Appl. No. 29/653,142, 6 pages.
Notice of Allowance dated Sep. 19, 2019 from U.S. Appl. No. 16/016,040, 7 pages.
Corrected Notice of Allowance dated Sep. 27, 2019 from U.S. Appl. No. 15/167,682, 2 pages.
Final Office Action dated Sep. 27, 2019 from U.S. Appl. No. 16/200,393, 34 pages.
Notice of Allowance dated Feb. 15, 2019 from U.S. Appl. No. 15/947,065, 9 pages.
Notice of Allowance dated Oct. 1, 2019 from U.S. Appl. No. 14/942,937, 7 pages.
Final Office Action dated Oct. 3, 2019 from U.S. Appl. No. 29/678,482, 6 pages.
Delhi Rehab & Nursing Facility ELM16-70884. Vertex Innovative Solutions Feb. 25, 2016. 89 pages.
SlimSurface surface mount downlighting. Philips Lightolier 2018. 8 pages.
Be seen in the best light. Lightolier by signify. Comprehensive 2019 Lighting Catalog. 114 pages.
Corrected Notice of Allowance dated Oct. 10, 2019 from U.S. Appl. No. 16/016,040, 2 pages.
Cree® LMR2 LED Module. Product Family Data Sheet Cree 2011. 3 pages.
Notice of Allowance dated Oct. 16, 2019 from U.S. Appl. No. 15/132,875, 12 pages.
International Search Report and Written Opinion in International Patent Application No. PCT/US2019/036477 dated Oct. 17, 2019, 15 pages.
ML56 LED Lighting System 600 / 900 / 1200 Series Halo. Cooper Lighting Brochure 2015. Accessed at https://images.homedepot-static.com/catalog/pdfImages/06/06d28f93-4bf6-45be-a35a-a0239606f227.pdf. 41 pages.
Switch and Outlet Boxes and Covers Brochure. Appelton 2010. 77 pages.
Non-Final Office Action dated Dec. 30, 2019 from U.S. Appl. No. 16/653,497, 8 pages.
Notice of Allowance dated Feb. 5, 2020 from U.S. Appl. No. 15/901,738, 8 pages.
Notice of Allowance dated Feb. 5, 2020 from U.S. Appl. No. 29/678,482 , 13 pages.
Maxim Lighting Wafer Trifold Brochure LMXBR01711 2017. Accessed at https://www.maximlighting.com/Upload/download/brochure/pdf/LMXBRO1711.pdf on Feb. 13, 2020. 2 pages.
Maxim Convert Fixture. LMXCAT1805 Maxim Main Catalog 2018 p. 639.
Maxim Wafer. LMXCAT1805 Maxim Main Catalog 2018 pp. 636-638.
Maxim Lighting Trim Trifold LMXBRC1905 2019. Accessed at https://www.maximlighting.com/Upload/download/brochure/pdf/LMXBRC1905.pdf on Feb. 13, 2020. 2 pages.
International Search Report and Written Opinion in International Patent Application No. PCT/US2019/054220 dated Feb. 24, 2020, 23 pages.
Final Office Action dated Mar. 17, 2020 for U.S. Appl. No. 29/653,142, 13 pages.
LED Book Pr ice Guide 2012. DMF Light. Issued Jun. 26, 2013. 3 pages.
DLER411 4" Recessed LED Retrofit Module. DMF Light. Issued Jun. 15, 2011. 1 page.
DLEI411 4" Recessed LED New Construction, IC. DMF Light. Issued Nov. 30, 2011. 1 page.
DLEIR411 4" Recessed LED Remodel, IC. DMF Light. Issued Jun. 15, 2011. 1 page.
3 & 4" DLE Series LED Sample Case Now Available. DMF Light. Issued Jan. 6, 2012. 1 page.
DLEI3 3" Recessed LED New Construction, IC. DMF Light. Issued Nov. 30, 2011. 2 pages.
Ridgway-Barnes, SlimSurface LED Downlight: One of the thinnest LED surface mount downlights in the market. Philips Lighting Blog. Oct. 28, 2014. Accessed at http://applications.nam.lighting.philips.com/blog/index.php/2014/10/28/slimsurface-led-downlight-one-of-the-thinnest-led-surface-mount-downlights-in-the-market/. 3 pages.
SlimSurface LED S5R, S7R & S10R Round 5", 7" and 10" Apertures. Lightolier by Signify. Nov. 2018. 9 pages.
Non-Final Office Action dated Apr. 2, 2020 for U.S. Appl. No. 16/522,275, 21 pages.
20 cu. in. Blue Polycarbonate Round New Work Ceiling Electrical Box. Carlon. Accessed at https://www.homedepot.com/p/Carlon-20-cu-in-Blue-Polycarbonate-Round-New-Work-Ceiling-Electrical-Box-B520P-UPC/202592617?MERCH=REC-_-pipsem-_-100404124-_-202592617-_-N on May 15, 2020. 14 pages.
Notice of Allowance dated May 18, 2020 from U.S. Appl. No. 15/901,738, 7 pages.
Non-Final Office Action dated May 20, 2020 for U.S. Appl. No. 15/688,266, 6 pages.
Non-Final Office Action dated May 26, 2020 for U.S. Appl. No. 16/719,361, 10 pages.
Maxim Lighting International, "Wafer LED 7" RD 3000K Wall/Flush Mount", undated.
Maxim Lighting International, "Convert LED Flush Mount", undated.
Maxim Lighting International, "Views of the Wafer Flush Mount", undated.
Maxim Lighting International, "Product/Drawing Specification Sheet", undated.
International Search Report and Written Opinion in PCT/US2020/017331 dated Jun. 22, 2020, 16 pages.
Taiwan Office Action and translation thereof dated Jun. 12, 2020 from Taiwan Application No. 108116564, 8 pages.
Access Lighting Installation Instructions. No. 20870LEDD/20871LEDD/20872LEDD. Dec. 16, 2019. 2 pages.
Model No. 20870LEDD-WH/ACR Infinite Specification Sheet. Access Lighting. Apr. 9, 2020. 1 page.
Notice of Allowance dated Apr. 9, 2020 from U.S. Appl. No. 16/653,497, 7 pages.
Notice of Allowance dated Jul. 10, 2020 from U.S. Appl. No. 29/694,475, 6 pages.
Corrected Notice of Allowability dated Oct. 25, 2018 from U.S. Appl. No. 14/183,424, 3 pages.
Dmf DRD2 Recessed LED Downlight General Retrofit Junction Box Dated: 12.18.15 Downloaded Jul. 28, 2018, from https://www.alconlighting.com/specsheets/DMF/DRD2-Junction-Box-Retrofit-Spec-Sheet .pdf, 6 pages.

(56) References Cited

OTHER PUBLICATIONS

Dmf DRD2 Recessed LED Downlight General New Construction 4", 5", 6" Aperture Dated: Aug. 31, 2016 Downloaded Jul. 28, 2018, from https://www. cansandfans.com/sites/default/files/DRD2-General-New-Construction-Spec-Sheet_7_0 .pdf, 9 pages.
Mar. 5, 2016—The DMF Lighting DRD2 Recessed LED Downlight General Retrofit Junction Box—Wet Location Rated is the ideal solution for Commercial LED recessed lighting retrofit applications. web cache https://www.alconlighting.com/dmf-drd2m.html (downloaded Jul. 28, 2018), 6 pages.
Ex Parte Quayle Office Action mailed Oct. 16, 2018 for U.S. Appl. No. 29/663,037, 7 pages.
Notice of Allowance dated Nov. 19, 2018 from U.S. Appl. No. 29/663,037, 5 pages.
Notice of Allowance dated Nov. 15, 2018 from U.S. Appl. No. 29/663,040, 5 pages.
LED modules advance in performance, standardization questions persist (MAGAZINE). LEDs Magazine. Oct. 29, 2013. Accessed at https://www.ledsmagazine.com/leds-ssl-design/modular-light-engines/article/16695073/led-modules-advance-in-performance-standardization-questions-persist-magazine. 9 pages.
Notice of Allowance dated Jul. 20, 2020 from U.S. Appl. No. 29/648,046, 5 pages.
Octagon Concrete Box Cover with (3) 1/2 in. & (2) 3/4 in. Conduit Knockouts. Garvin. Accessed at https://www.garvinindustries.com/covers-and-device-rings/concrete-slab-box-covers-adaptor-rings/flat-covers-all-styles/cbp?gclid=Cj0KCQjw9b_4BRCMARIsADMUIypJcOK80UHdDTI9C5m4BDzR3U87PRYV1NdQIBFxEWQ2l_3otTCTqEkaAi_DEALw_wcB on Jul. 20, 2020. 1 page.
Notice of Allowance dated Jul. 28, 2020 from U.S. Appl. No. 16/719,361, 8 pages.
Notice of Allowance dated Jul. 29, 2020 from U.S. Appl. No. 16/522,275, 8 pages.
Non-Final Office Action dated Aug. 19, 2020 for U.S. Appl. No. 16/886,365, 16 pages.
Notice of Allowance dated Sep. 8, 2020 from U.S. Appl. No. 29/678,482, 5 pages.
Corrected Notice of Allowance dated Sep. 11, 2020 from U.S. Appl. No. 16/719,361, 2 pages.
Canadian Office Action in Application No. 2931588 dated Aug. 13, 2020, 5 pages.
Corrected Notice of Allowance dated Sep. 14, 2020 from U.S. Appl. No. 16/522,275, 2 pages.
Notice of Allowance dated Sep. 22, 2020 from U.S. Appl. No. 29/683,730, 6 pages.
Notice of Allowance dated Sep. 22, 2020 from U.S. Appl. No. 29/653,142, 6 pages.
Notice of Allowance dated Oct. 27, 2020 from U.S. Appl. No. 29/648,046, 5 pages.
Notice of Allowance dated Oct. 27, 2020 from U.S. Appl. No. 29/694,475, 5 pages
Notice of Allowance dated Nov. 10, 2020 from U.S. Appl. No. 29/688,143, 6 pages.
Notice of Allowance dated Nov. 10, 2020 from U.S. Appl. No. 29/688,172, 6 pages.
Non-Final Office Action dated Nov. 30, 2020 from U.S. Appl. No. 17/000,702, 7 pages.
Notice of Allowance dated Dec. 2, 2020 from U.S. Appl. No. 29/746,262, 6 pages.
International Search Report and Written Opinion in PCT/US2020/050767 dated Dec. 9, 2020, 25 pages.
Non-Final Office Action dated Dec. 16, 2020 from U.S. Appl. No. 17/080,080, 28 pages.
Canadian Office Action in Application No. 2941051 dated Dec. 8, 2020, 5 pages.
Final Office Action dated Jan. 11, 2021 from U.S. Appl. No. 15/688,266, 7 pages.
Non-Final Office Action dated Jan. 11, 2021 from U.S. Appl. No. 16/725,606, 7 pages.
Non-Final Office Action dated Jan. 13, 2021 from U.S. Appl. No. 17/085,636, 14 pages.
Notice of Allowance dated Jan. 15, 2021 from U.S. Appl. No. 17/000,702, 7 pages.
Notice of Allowance dated Jan. 22, 2021 from U.S. Appl. No. 17/080,080, 14 pages.
Notice of Allowance dated Jan. 22, 2021 from U.S. Appl. No. 16/886,365, 7 pages.
Final Office Action dated Feb. 5, 2021 from U.S. Appl. No. 16/200,393, 7 pages.
"Electrical Boxes" accessed at http://electrical-inspector.blogspot.com/2013/06/electrical-boxes.html Jun. 22, 2013 retrieved from Wayback Machine Archinve.org on Jan. 25, 2021. 12 pages.
"Electrical Boxes Volume and Fill Calculations" accessed at http://electrical-inspector.blogspot.com/2013/06/electrical-boxes-Volume-and-Fill-Calculations.html Jun. 22, 2013 retrieved from Wayback Machine Archinve.org on Jan. 25, 2021. 8 pages.
U.S. Appl. No. 61/881,162, filed Sep. 23, 2013. Prioirty application to US Publication No. 2015/0085500 to Cooper et al. 31 pages.
Non-Final Office Action dated Jan. 19, 2021 from U.S. Appl. No. 17/099,650, 15 pages.
Supplemental Notice of Allowance dated Mar. 10, 2021 from U.S. Appl. No. 16/886,365, 2 pages.
Thiele, Plastic Electrical Boxes Pros and Cons. Dated Jul. 1, 2019. Accessed at found at https://www.thespruce.com/plastic-electrical-boxes-pros-and-cons-1152405. 1 page.
"Electrical Box" reference dated Mar. 23, 2021. Accessed at https://www.zoro.com/cantex-electrical-box-3-12-in-rouond-20-cu-in-ez20cnr-/i/G1823376/. 1 page.
Notice of Allowance dated Apr. 6, 2021 from U.S. Appl. No. 16/200,393, 11 pages.
Non-Final Office Action dated Apr. 12, 2021 from U.S. Appl. No. 29/694,475, 11 pages.
Notice of Allowance dated Apr. 13, 2021 from U.S. Appl. No. 16/725,606, 7 pages.
Notice of Allowance dated Apr. 26, 2021 from U.S. Appl. No. 17/080,080, 11 pages.
Corrected Notice of Allowance dated Apr. 28, 2021 from U.S. Appl. No. 16/725,606, 2 pages.
Notice of Allowance dated May 5, 2021 from U.S. Appl. No. 17/085,636, 8 pages.
Notice of Allowance dated May 14, 2021 from U.S. Appl. No. 16/881,686, 8 pages.
Notice of Allowance dated May 17, 2021 from U.S. Appl. No. 15/688,266, 9 pages.
Notice of Allowance dated May 24, 2021 from U.S. Appl. No. 29/688,143, 6 pages.
Notice of Allowance dated May 24, 2021 from U.S. Appl. No. 29/688,172, 6 pages.
Notice of Allowance dated May 27, 2021 from U.S. Appl. No. 16/779,865, 9 pages.
Notice of Allowance dated Jun. 1, 2021 from U.S. Appl. No. 16/719,361,7 pages.
Corrected Notice of Allowance dated Jun. 21, 2021 from U.S. Appl. No. 16/779,865, 3 pages.
Petition for Inter Partes Review of U.S. Pat. No. 9,964,266 Pursuant to 37 C.F.R. § 42.100 et seq. *AMP Plus Inc*. dbd *ELCO Lighting* v. *DMF, Inc*, IPR2019-01094 filed May 17, 2019. 108 pages.
IPR2019-01094 Exhibit 1001. U.S. Pat. No. 9,964,266 ("the '266 Patent"). 14 pages.
IPR2019-01094 Exhibit 1002. Declaration of Eric Bretschneider, Ph.D. ("Bretschneider"). 107 pages.
IPR2019-01094 Exhibit 1003. Curriculum Vitae of Dr. Bretschneider. 11 pages.
IPR2019-01094 Exhibit 1004. Excerpts from the File History of U.S. Pat. No. 9,964,266. 105 pages.
IPR2019-01094 Exhibit 1005. Imtra 2011 Marine Lighting Catalog—Advanced LED Solutions ("Imtra 2011"). 40 pages.
IPR2019-01094 Exhibit 1006. Imtra 2007 Marine Lighting Catalog ("Imtra 2007"). 36 pages.
IPR2019-01094 Exhibit 1007. U.S. Pat. No. 9,366,418 ("Gifford"). 9 pages.

(56) References Cited

OTHER PUBLICATIONS

IPR2019-01094 Exhibit 1008. Declaration of Colby Chevalier ("Chevalier"). 89 pages.
IPR2019-01094 Exhibit 1009. U.S. Pat. No. 7,102,172 ("Lynch"). 41 pages.
IPR2019-01094 Exhibit 1010. Illuminating Engineering Society, Ansi RP-16-10, Nomenclature and Definitions for Illuminating Engineering (approved as an American National Standard Jul. 15, 2005, approved by the IES Board of Directors Oct. 15, 2005). 4 pages.
IPR2019-01094 Exhibit 1011. Underwriters Laboratories Inc. Standard for Safety, Standard UL-8750, entitled Light Emitting Diode (LED) Equipment for Use in Lighting (1st ed. 2009). 5 pages.
IPR2019-01094 Exhibit 1012. Celanese CoolPoly® D5502 Thermally Conductive Liquid Crystalline Polymer Specification ("CoolPoly"). 1 page.
IPR2019-01094 Exhibit 1013. Illuminating Engineering Society of North America, IES Lighting Handbook (John E. Kaufman and Howard Haynes eds., Application vol. 1981) ("Lighting Handbook"). 5 pages.
IPR2019-01094 Exhibit 1014. California Energy Commission, PIER Lighting Research Program: Project 2.3 Low-profile LED Luminaires Final Report (Prepared by Lighting Research Center, Jan. 2005) ("Pier LRP"). 70 pages.
IPR2019-01094 Exhibit 1015. Jim Sinopoli, Using DC Power to Save Energy and End the War on Currents, GreenBiz (Nov. 15, 2012), https://www.greenbiz.com/news/2012/11/15/using-dc-power-save-energy-end-war-currents ("Sinopoli"). 6 pages.
IPR2019-01094 Exhibit 1016. Robert W. Johnson, "Thought Leadership White Paper: AC Versus DC Power Distribution" (Nov. 2012) ("Johnson"). 10 pages.
IPR2019-01094 Exhibit 1017. Lumileds, LUXEON Rebel General Purpose Product Datasheet, Specification DS64 (2016) ("Luxeon Rebel"). 26 pages.
IPR2019-01094 Exhibit 1018. U.S. Pat. No. 8,454,204 ("Chang"). 11 pages.
IPR2019-01094 Exhibit 1019. U.S. Department of Energy, CALiPER Benchmark Report: Performance of Incandescent A-Type and Decorative Lamps and LED Replacements (prepared by Pacific National Laboratory, Nov. 2008) ("CALiPER 2008"). 25 pages.
IPR2019-01094 Exhibit 1020. U.S. Pat. No. 3,836,766 ("Auerbach"). 13 pages.
IPR2019-01094 Exhibit 1021. U.S. Department of Energy, CALiPER Application Summary Report 16: LED BR30 and R30 Lamps (prepared by Pacific Northwest National Laboratory, Jul. 2012) ("CALiPER 2012"). 26 pages.
IPR2019-01094 Exhibit 1022. Sandia National Laboratories, Sandia Report: "The Case for a National Research Program on Semiconductor Lighting" (Jul. 2000) ("Haitz"). 24 pages.
IPR2019-01094 Exhibit 1023. Sylvania, Post Top Street Light LED Retrofit Kit Specification, LED40POST (2009) ("Sylvania"). 4 pages.
IPR2019-01094 Exhibit 1024. Webster's New Collegiate Dictionary (1973) ("Webster's"). 2 pages.
IPR2019-01094 Exhibit 1025. 3M Wire Connectors and Tools Catalog 2013 ("3M Catalog"). 22 pages.
IPR2019-01094 Exhibit 1026. Wakefield Semiconductor Heat Sinks and Thermal Products 1974 Catalog ("Wakefield"). 3 pages.
IPR2019-01094 Exhibit 1027. U.S. Department of Energy, Solid-State Lighting Research and Development Portfolio: Multi-Year Program Plan FY'07-FY'12 (prepared by Navigant Consulting, Inc., Mar. 2006) ("DOE 2006"). 129 pages.
IPR2019-01094 Exhibit 1028. U.S. Department of Energy, Solid-State Lighting ResearA1023:C1043elopment: Multi-Year Program Plan (Apr. 2013) ("DOE 2013"). 89 pages.
Declaration of Colby Chevalier from Central District of California Civil Docket for Case #: 2:18-cv-07090-CAS-GJS filed Jun. 3, 2019, signed Jun. 3, 2019. 2 pages.
Docket Listing in Inter Partes Review of U.S. Pat. No. 9,964,266. Docket Navegator *AMP Plus, Inc.* d/b/a *Elco Lighting et al.* v. *DMF, Inc.* PTAB-IPR2019-01094. Downloaded Mar. 25, 2020. 4 pages.
Petition for Inter Partes Review of U.S. Pat. No. 9,964,266 Pursuant to 37 C.F.R. § 42.100 et seq. *AMP Plus Inc.* dbd *ELCO Lighting* v. *DMF, Inc*, PTAB-IPR2019-01500 filed Aug. 14, 2019. 99 pages.
Docket Listing in Inter Partes Review of U.S. Pat. No. 9,964,266 . *AMP Plus, Inc.* d/b/a *ELCO Lighting et al.* v. *DMF, Inc.* PTAB-IPR2019-01500. Downloaded Mar. 25, 2020. 3 pages.
Civil Action No. 2:18-cv-07090. Complaint For Infringement And Unfair Competition. *DMF, Inc.* v. *AMP Plus, Inc.* d/b/a *ELCO Lighting*. 52 pages. Dated Aug. 15, 2018.
Docket Listing in Civil Action No. 2:18-cv-07090. *DMF, Inc.* v. *AMP Plus, Inc.* d/b/a *ELCO Lighting et al.* CDCA-2-18-CV-07090. Downloaded on Mar. 25, 2020. 39 pages.
Civil Action No. 2:19-cv-4519.Complaint For Patent Infringement. *DMF, Inc.* v. *AMP Plus, Inc.* d/b/a *ELCO Lighting.* 52 pages dated May 22, 2019. 23 pages.
Docket Listing in Civil Action No. 2:19-cv-4519. *DMF Inc* v. *AMP Plus, Inc.* d/b/a *ELCO Lighting et al.* CDCA-2-19-cv-04519. Downloaded on Mar. 25, 2020. 3 pages.
Decision Denying Institution of Inter Partes Review of U.S. Pat. No. 9,964,266 in IPR2019-01500 dated Mar. 17, 2020. 21 pages.
Defendants' Notice of Prior Art Pursuant To 35 U.S.C. § 282 in Civil Action No. 2:18-cv-07090-CAS-GJS dated Feb. 28, 2020. 7 pages.
Defendant AMP Plus, Inc.'s Opposition to DMF's Motion for Summary Judgement in Civil Action No. 2:18-cv-07090-CAS-GJS filed Feb. 10, 2020. 32 pages.
Declaration of Eric Bretschneider, Ph.D In Support of Amp Plus, Inc.'s Opposition to Dmf, Inc.'s Motion for Partial Summary Judgment in Civil Action No. 2:18-cv-07090-CAS-GJS filed Feb. 10, 2020. 210 pages.
Plaintiff DMF's Reply in Support Of Motion For Partial Summary Judgment in Civil Action No. 2:18-cv-07090-CAS-GJS filed Feb. 18, 2020. 33 pages.
Declaration of James R. Benya In Support of Plaintiff DMF's Motion for Summary Judgment in Civil Action No. 2:18-cv-07090-CAS-GJS filed Feb. 3, 2020. 193 pages.
Underwriters Laboratories Inc. Standard for Safely. UL 1598. Luminaires Jan. 11, 2020. 12 pages.
Exceptional LED Lighting Technology Product Portfolio. LightingScience 2012. 11 pages.
"Cree LMH2 Led Modules," Mouser Electronics. Sep. 9, 2012. 4 pages.
Slim Line Disc. EYE LEDs Specification Sheet 2012. 2 pages.
HiBay LED Heat Sink. Wakefield-vette. Dec. 11, 2017. 1 pages.
Thermal Management of Cree® XLamp® LEDs. Cree Application Note. 2004. 19 pages.
Imtra Marine Lighting Fall 2007 Catalog. 32 pages.
Cree LMH2 LED Modules Product Family Data Sheet. Cree 2011-2014, 18 pages.
Cree LMH2 LED Modules Design Guide. Cree 2011-2015, 23 pages.
Brochure of Elco EL49A, EL49ICA, EL49RA modules. ELCO Lighting Nov. 25, 2009. 1 page.
Image of Elco E347/247 module identified by Elco in response to DMF's Request for Production in Civil Action No. 2:18-cv-07090-CAS-GJS on Aug. 28, 2019. 1 page.
Screenshots from the Deposition of Brandon Cohen in Civil Action No. 2:18-cv-07090-CAS-GJS. Conducted Sep. 2, 2020. 8 pages.
Defendant AMP Plus, Inc.'s Initial Disclosure and Designation of Expert Witnesses in Civil Action No. 2:19-CV-4519-CAS. 37 pages.
Defendant AMP Plus, Inc. D/B/A Elco Lighting's Supplemental Responses to Plaintiff DMF, Inc.'s First Set of Interrogatories (Nos. 1-16) in Civil Action No. 2:19-CV-4519-CAS, Redacted. 13 pages.
Final Written Decision in IPR2019-01094 dated Nov. 19, 2020, 58 pages.
Notice of Allowance dated Jul. 21, 2021 from U.S. Appl. No. 17/318, 13 pages.
Supplemental Notice of Allowance dated Aug. 13, 2021 1 from U.S. Appl. No. 16/779,824, 3 pages.

(56) References Cited

OTHER PUBLICATIONS

Supplemental Notice of Allowance dated Aug. 19, 2021 1 from U.S. Appl. No. 17/318,193, 4 pages.
Notice of Allowance dated Aug. 20, 2021 1 from U.S. Appl. No. 29/764,875, 5 pages.
Notice of Allowance dated Sep. 16, 2021 from U.S. Appl. No. 16/779,865, 9 pages.
Non-Final Office Action dated Oct. 18, 2021 from U.S. Appl. No. 29/696,830, 8 pages.
Notice of Allowance dated Nov. 3, 2021 from U.S. Appl. No. 17/220,779, 7 pages.
Notice of Allowance dated Nov. 5, 2021 1 from U.S. Appl. No. 17/318,193, 11 pages.
Non-Final Office Action dated Nov. 5, 2021 from U.S. Appl. No. 17/379,748, 8 pages.
Notice of Allowance dated Nov. 8, 2021 1 from U.S. Appl. No. 29/764,875, 5 pages.
Non-Final Office Action dated Nov. 15, 2021 from U.S. Appl. No. 17/374,674, 7 pages.
Final Office Action dated Nov. 16, 2021 from U.S. Appl. No. 17/099,650, 14 pages.
Notice of Allowance dated Nov. 22, 2021 from U.S. Appl. No. 29/694,475, 7 pages.
Notice of Allowance dated Nov. 24, 2021 from U.S. Appl. No. 17/234,421, 9 pages.
Non-Final Office Action dated Nov. 30, 2021 from U.S. Appl. No. 17/395,522, 28 pages.
Non-Final Office Action dated Dec. 1, 2021 from U.S. Appl. No. 16/883,144, 23 pages.
Corrected Notice of Allowance dated Dec. 10, 2021 from U.S. Appl. No. 17/234,421, 2 pages.
Non-Final Office Action dated Dec. 13, 2021 from U.S. Appl. No. 29/711,198, 8 pages.
Corrected Notice of Allowance dated Jan. 11, 2022 from U.S. Appl. No. 29/694,475, 2 pages.
Corrected Notice of Allowance dated Jan. 12, 2022 from U.S. Appl. No. 16/779,865, 9 pages.

* cited by examiner

POLYMER HOUSING FOR A RECESSED LIGHTING SYSTEM AND METHODS FOR USING SAME

CROSS-REFERENCE TO RELATED PATENT APPLICATION(S)

This application is a bypass continuation application of International Application PCT/US2019/036477, filed Jun. 11, 2019, and entitled "A POLYMER HOUSING FOR A RECESSED LIGHTING SYSTEM AND METHODS FOR USING SAME," which claims priority to U.S. Provisional Application No. 62/683,562, filed on Jun. 11, 2018, entitled "PLASTIC DEEP ELECTRICAL JUNCTION BOX," U.S. Provisional Application No. 62/749,462, filed on Oct. 23, 2018, entitled "PLASTIC DEEP ELECTRICAL JUNCTION BOX," and U.S. Provisional Application No. 62/791,398, filed on Jan. 11, 2019, entitled "PLASTIC DEEP ELECTRICAL JUNCTION BOX." Each of the above identified applications is incorporated herein by reference in its entirety.

BACKGROUND

A recessed lighting system is a lighting device that is installed in an opening on a ceiling or a wall of a building structure in a manner that substantially hides the components of the lighting device (e.g., the housing, the wiring) from view. A typical recessed lighting system includes a light source and a driver deployed in at least one housing (e.g., a can housing, a junction box, or a combination of both). The housing may be coupled to a hanger bar assembly to facilitate installation of the recessed lighting system to various building structures such as a T-bar, a joist, and a stud. The housing may also include a feedthrough to facilitate connection to an external electrical power supply (e.g., an alternating current (AC) or direct current (DC) source in a building). A trim may also be used to cover the opening in the ceiling or the wall. The trim may be designed to modify the lighting in the environment and/or to accommodate aesthetic preferences.

SUMMARY

The Inventors, via previous innovative designs of lighting systems, have recognized and appreciated that recessed lighting offers several benefits for ambient and task lighting including, but not limited to making the environment appear larger (e.g., low ceiling environments), greater flexibility in tailoring lighting conditions (e.g., wall wash, directional, accent, general lighting), and fewer limitations on the installation location (e.g., a sloped ceiling, a vaulted ceiling, a wall). However, the Inventors have also recognized that previous recessed lighting systems are cumbersome to assemble. Furthermore, the Inventors have recognized previous recessed lighting systems may be expensive due to excessive use of expensive materials and labor costs associated with the manufacture, assembly, and installation of the lighting system.

Previous recessed lighting systems typically include one or more housings (e.g., a can housing, a junction box) to contain the light source and the driver. Additional components may be included such as a mounting pan, metallic conduits, and fittings, which increases the number of parts of the lighting system leading to higher manufacturing costs and a more complex assembly/installation procedure.

The housing(s) is typically formed from a sheet metal. Conventional sheet metal forming processes are limited in terms of fabricating parts with a variable thickness. Thus, the housing(s) typically do not include features to increase the structural rigidity (e.g., a rib, a gusset). Instead, the housing(s) are formed using a thicker material to provide a desired structural integrity at the expense of additional material costs.

Additionally, the recessed lighting system may have to meet certain safety standards (e.g., a fire-rating standard) to operate in the environment. For example, a fire-rating qualification may involve installing a recessed lighting system inside an enclosure (e.g., a fire-rated, thermally insulated enclosure). The enclosure not only increases the complexity of the installation, but also increases the overall size of the lighting system, thus limiting its use in confined spaces (e.g., a ceiling of a multi-family residential building). Alternatively, the housing(s) may be made thicker and/or coated to meet the safety standards, which may add additional costs.

The present disclosure is thus directed to various inventive implementations of a recessed lighting system that is simpler in design and easier to install compared to previous recessed lighting systems while maintaining or, in some instances, improving the mechanical, thermal, and electrical properties of the lighting system. The present disclosure is also directed to various inventive methods of assembling and installing the recessed lighting system described herein.

In one aspect, a housing of the lighting system may be formed from a polymer instead of a metal. A polymer-based housing may be lighter, more flexible in terms of design and manufacturability, and may more readily meet safety standards compared to a metal-based housing. For instance, the housing may be fabricated using injection molding techniques, which enables the integration of structural features to mechanically strengthen the housing (e.g., a rib structure, a section of the housing is thicker than another section). If such features are strategically incorporated into the housing, the housing may be fabricated using less without compromising the structural integrity of the housing. The housing described herein may also replace and/or eliminate several components in previous recessed lighting fixtures including, but not limited to a junction box, a can housing, a mounting pan, metallic conduits, and fittings, thus simplifying the manufacture and assembly of the lighting system.

In another aspect, the lighting system may include a yoke disposed in the cavity of the housing to facilitate the installation of a light module into the housing. The yoke may include a frame with a frame opening through which the light module is partially inserted. The frame may also include features (e.g., a tab with hole) to couple the yoke to the light module. The frame may also include one or more arms that each have a slot. Each arm may be coupled to the housing by inserting a peg, mounted to the housing, through the slot. The yoke may be slidably adjustable along the respective slots of each arm relative to the pegs.

For comparison, in previous housings, the user generally placed their hand inside the cavity of the housing, which may obstruct the user's view making installation more difficult and/or expose the user to safety hazards (e.g., electrical hazard, sharp features). The inclusion of a yoke may mitigate these issues by allowing a user to position the yoke near the opening of the housing or outside of the housing to provide the user a more accessible surface to mount the light module. The yoke may also be formed from a polymer or a metal.

In yet another aspect, the lighting system may include a partition plate disposed in a cavity of the housing to improve the ease of installation by pressing back wires/cables in the housing, which could otherwise obstruct or interfere with the installation of the light module and/or trim. The partition plate may divide the cavity into a wiring compartment and a lighting compartment. The wiring compartment may house one or more wires/cables in the housing to supply/transfer power from an external electrical power source or another recessed lighting system (e.g., a daisy-chained lighting fixture). The lighting compartment may be used to house a light module that includes the light source and the driver. The one or more wires/cables may be fed through a feed-through in the partition plate to connect to the light module. The partition plate may be secured to the housing in a tool-less manner via a twist and lock connector. The partition plate may also be formed from a polymer or a metal. Furthermore, the partition plate may also reduce the risk of exposure to electrical safety hazards, increase the structural integrity of the housing, and increase heat dissipation from the light module.

In yet another aspect, the lighting system may include a trim to cover an exposed opening in the building structure through which the recessed lighting system is installed. The trim may be coupled to the light module in a tool-less manner, such as through use of a twist and lock connector. The trim may also be secured to the housing using various coupling mechanisms including, but not limited to a spring clip and a clamp. In this manner, the installation of the light module into the housing may be accomplished without the use of any tools, thus reducing the number of parts for installation as well as improving the overall ease of installation of the recessed lighting system.

In one example, a lighting system includes a housing with a sidewall that defines a cavity and an opening at a first end of the sidewall where the cavity contains a light source and a driver, a cover coupled to the sidewall to enclose a second end of the sidewall opposite from the first end, a knockout disposed on at least one of the sidewall or the cover that is removable in order to form a first opening through which a first cable passes through the first opening into the cavity, and a feedthrough tab disposed on at least one of the sidewall or the cover that is sufficiently compliant such that when bent, a second opening is formed through which a second cable passes through the second opening into the cavity.

In another example, a lighting system includes a housing with a sidewall that defines a cavity and an opening at a first end of the sidewall where the cavity contains a light source and a driver, a cover coupled to the sidewall to enclose a second end of the sidewall opposite to the sidewall, and a support section formed on the sidewall proximate to the cover and protruding into the cavity having a support surface to abut at least a portion of a partition plate disposed in the cavity such that a first plane coinciding with a flat side of the partition plate is substantially parallel to a second plane coinciding with the opening of the housing.

In yet another example, a lighting system includes a housing with a sidewall that defines a cavity and an opening at a first end of the sidewall, a cover coupled to the sidewall to enclose a second end of the sidewall opposite from the first end, a knockout disposed on at least one of the sidewall or the cover that is removable to form a first opening through which a conduit cable passes through the first opening into the cavity, a feedthrough tab disposed on at least one of the sidewall or the cover that is sufficiently compliant such that when bent, a second opening is formed through which a Romex cable passes through the second opening into the cavity, and a support section formed on the sidewall proximate to the cover and protruding into the cavity with a support surface. The lighting system also includes a partition plate disposed in the cavity such that the cavity is divided into a wiring compartment and a lighting compartment. The partition plate includes a base that abuts the support surface of the housing and a first twist and lock connector disposed around the periphery of the base. The lighting system also includes a peg coupled to the sidewall of the housing to engage the first twist and lock connector thereby coupling the partition plate to the housing, a light module disposed in the lighting compartment having a module housing that contains therein a light source and a driver, the module housing having a second twist and lock connector, and a trim to cover an environmental opening in a wall or a ceiling of a building where the recessed lighting system is disposed, the trim having a tab that engages the second twist and lock connector of the module housing thereby coupling the trim to the light module. The lighting system also includes a hanger bar assembly with a hanger bar holder coupled to the sidewall of the housing with a slot that allows the hanger bar assembly to be slidably adjustable along a first axis, the hanger bar holder having a track that defines a second axis, a hanger bar coupled to the track of the hanger bar holder that is slidably adjustable along the second axis, and a hanger bar head coupled to an end of the hanger bar to mount the hanger bar assembly to at least one of a T-bar, a joist, or a stud in the building.

In yet another example, a method of installing a lighting system includes the following steps: A) installing a housing by attaching a hanger bar assembly, coupled to the housing, to at least one of a T-bar, a stud, or a joist in a building, B) inserting a cable into a cavity of the housing through a first opening formed by at least one of B1) removing a knockout on the housing or B2) bending a feedthrough tab on the housing, C) inserting the cable through a feedthrough on a partition plate, and D) inserting the partition plate through a second opening of the housing and securing the partition plate to the housing. The method may further include the following steps: E) connecting the light module to the cable, F) coupling a trim to the light module, and G) inserting the light module and the trim through the second opening into the cavity of the housing, the trim having a coupling member to secure the light module and the trim to the housing, the light module being configured to emit light through the second opening. The method may alternatively include the following steps: H) coupling a stand-off to the partition plate and I) coupling a cover plate to the stand-off, the cover plate substantially covering the second opening of the housing.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

FIG. 1D-2 shows a cross-sectional top, front perspective view of the lighting fixture of FIG. 1D-1.

FIG. 1E-1 shows a cross-sectional top view of the lighting fixture of FIG. 1A where a trim is fully engaged with a light module.

FIG. 1E-2 shows a cross-sectional top, front perspective view of the lighting fixture of FIG. 1E-1.

FIG. 3D-1 shows a cross-sectional view of the junction box of FIG. 3A where the yoke is at a neutral position.

FIG. 3D-2 shows a cross-sectional view of the junction box of FIG. 3A where the yoke is at a fully recessed position.

DETAILED DESCRIPTION

Figure 1A:
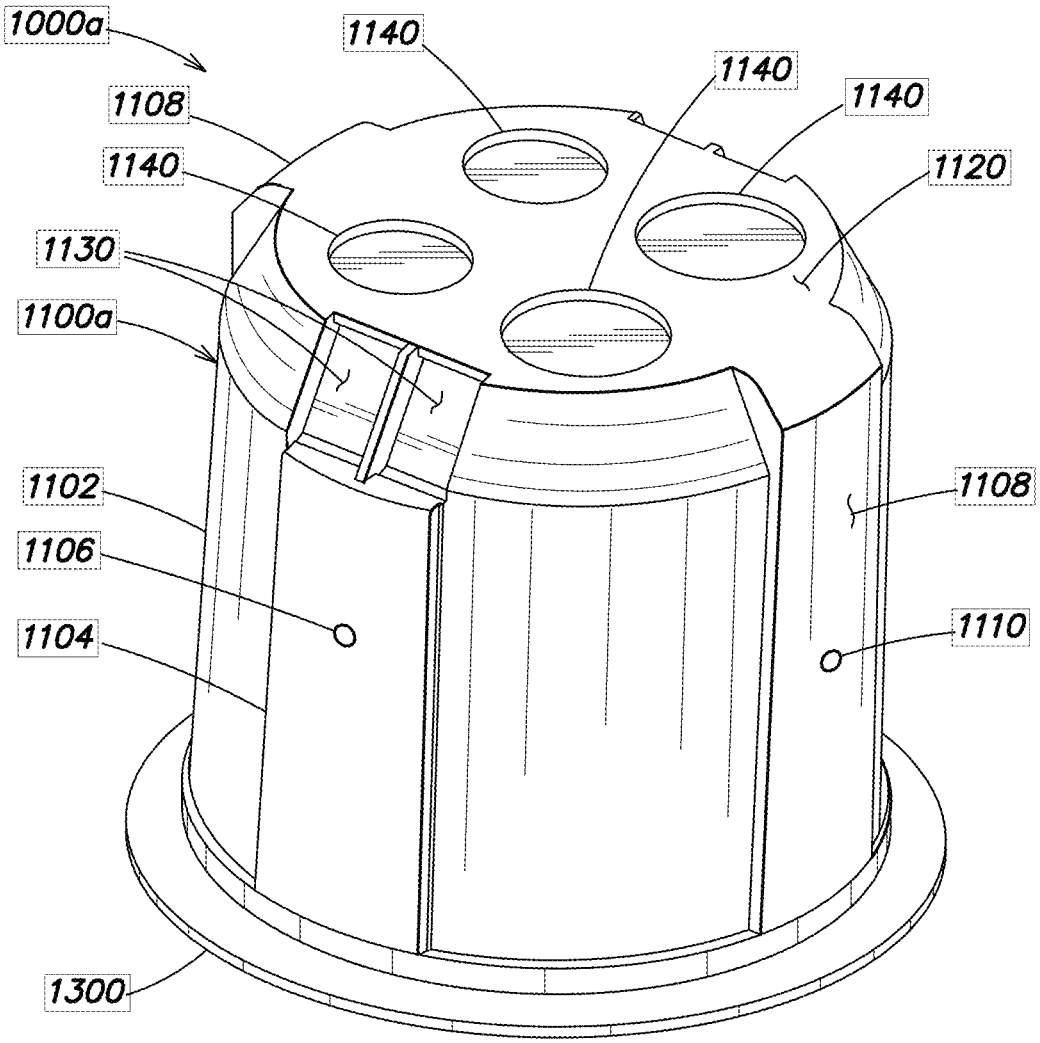
FIG. 1A shows a top, front perspective view of an exemplary lighting fixture.

Following below are more detailed descriptions of various concepts related to, and implementations of, a recessed lighting system configured to be easier to install, simpler in terms of manufacturability, and meets desired mechanical, electrical, and thermal properties during operation. Specifically, a housing and components used to facilitate the installation of a light module in the housing are described herein. It should be appreciated that various concepts introduced above and discussed in greater detail below may be implemented in multiple ways. Examples of specific implementations and applications are provided primarily for illustrative purposes so as to enable those skilled in the art to practice the implementations and alternatives apparent to those skilled in the art.

The figures and example implementations described below are not meant to limit the scope of the present implementations to a single embodiment. Other implementations are possible by way of interchange of some or all of the described or illustrated elements. Moreover, where certain elements of the disclosed example implementations may be partially or fully implemented using known components, in some instances only those portions of such known components that are necessary for an understanding of the present implementations are described, and detailed descriptions of other portions of such known components are omitted so as not to obscure the present implementations.

In the discussion below, various examples of inventive recessed lighting systems are provided, wherein a given example or set of examples showcases one or more particular features of a housing, a yoke, and/or a partition plate. It should be appreciated that one or more features discussed in connection with a given example of a light module and a trim may be employed in other examples of recessed lighting systems according to the present disclosure, such that the various features disclosed herein may be readily combined in a given recessed lighting system according to the present disclosure (provided that respective features are not mutually inconsistent).

A First Example of a Recessed Lighting System with a Yoke

FIGS. 1A-1E show several views of an exemplary recessed lighting system 1000*a* with a yoke 1400*a*. As shown, the lighting system 1000*a* may include a housing 1100*a* with a cavity 1101 that contains a light module 1200 and a yoke 1400*a*. The housing 1100*a* may include an opening 1103 for light from the light module 1200 to pass through into the environment. The light module 1200 may include a light source to emit light and a driver to supply power to the light source. Thus, the housing 1100*a* may replace the can housing and the junction box used in previous recessed lighting systems. The housing 1100*a* may also eliminate the use of a mounting pan and additional cables (e.g., metallic conduits) previously used to connect the junction box and the can housing.

Additionally, a trim 1300 may also be disposed, at least in part, onto the opening 1103 of the housing 1100*a* to cover a corresponding opening in the ceiling or wall of the building structure into which the recessed lighting system 1000*a* is installed. The recessed lighting system 1000*a* may be mounted to various structures in the building (e.g., a stud, a joist, a T-bar) via a hanger bar assembly (not shown). The hanger bar assembly may provide multiple axes of adjustment in order to position the recessed lighting system 1000*a* at a desired location relative to the structures supporting the recessed lighting system. An exemplary hanger bar assembly is described in further detail below with respect to other exemplary recessed lighting systems 1000 (e.g. recessed lighting systems 1000*a*-1000*e*).

Figure 1B:
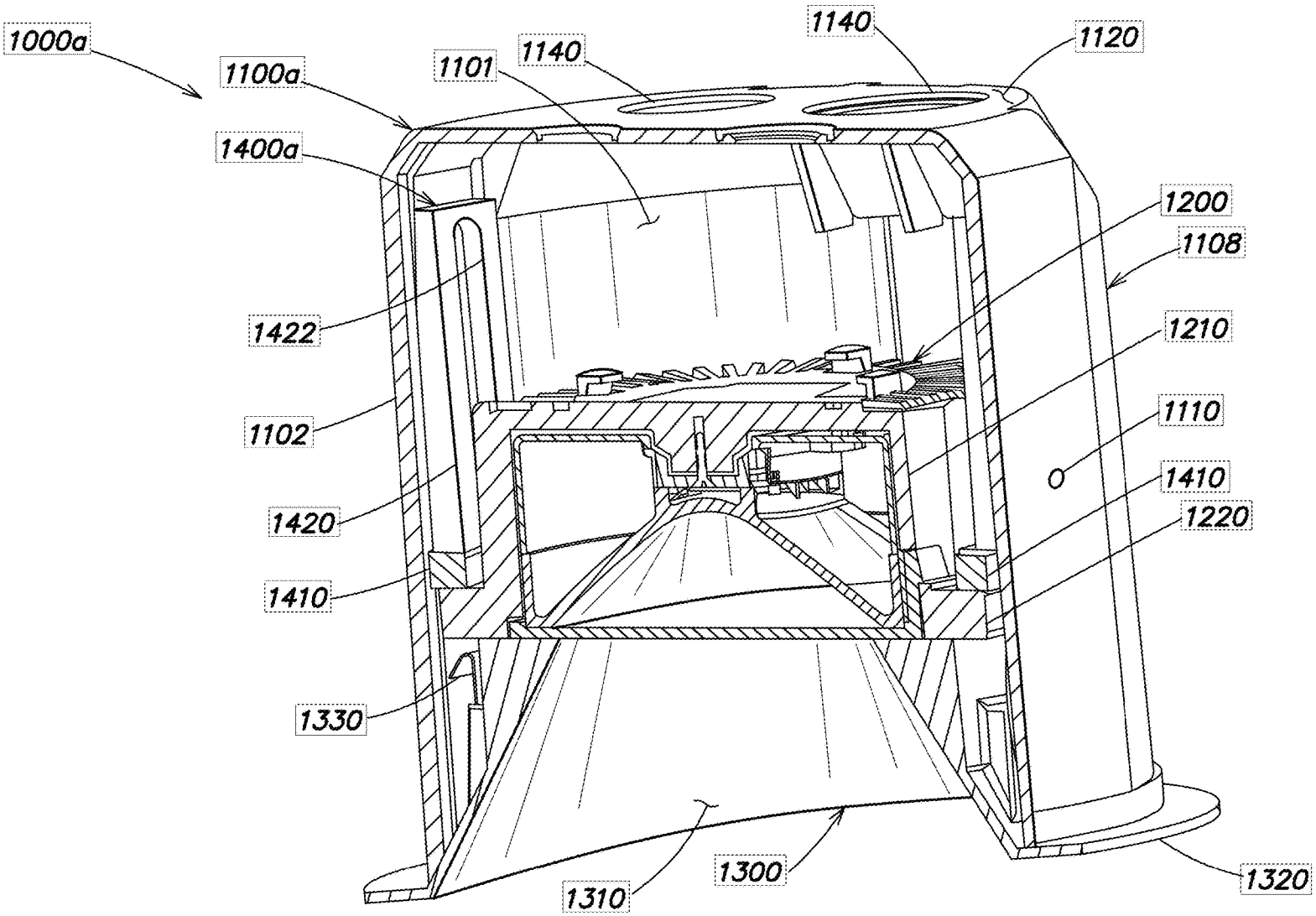
FIG. 1B shows a cross-sectional front perspective view of the lighting fixture of FIG. 1A where a yoke is positioned near the cover of the housing.
Figure 1C:
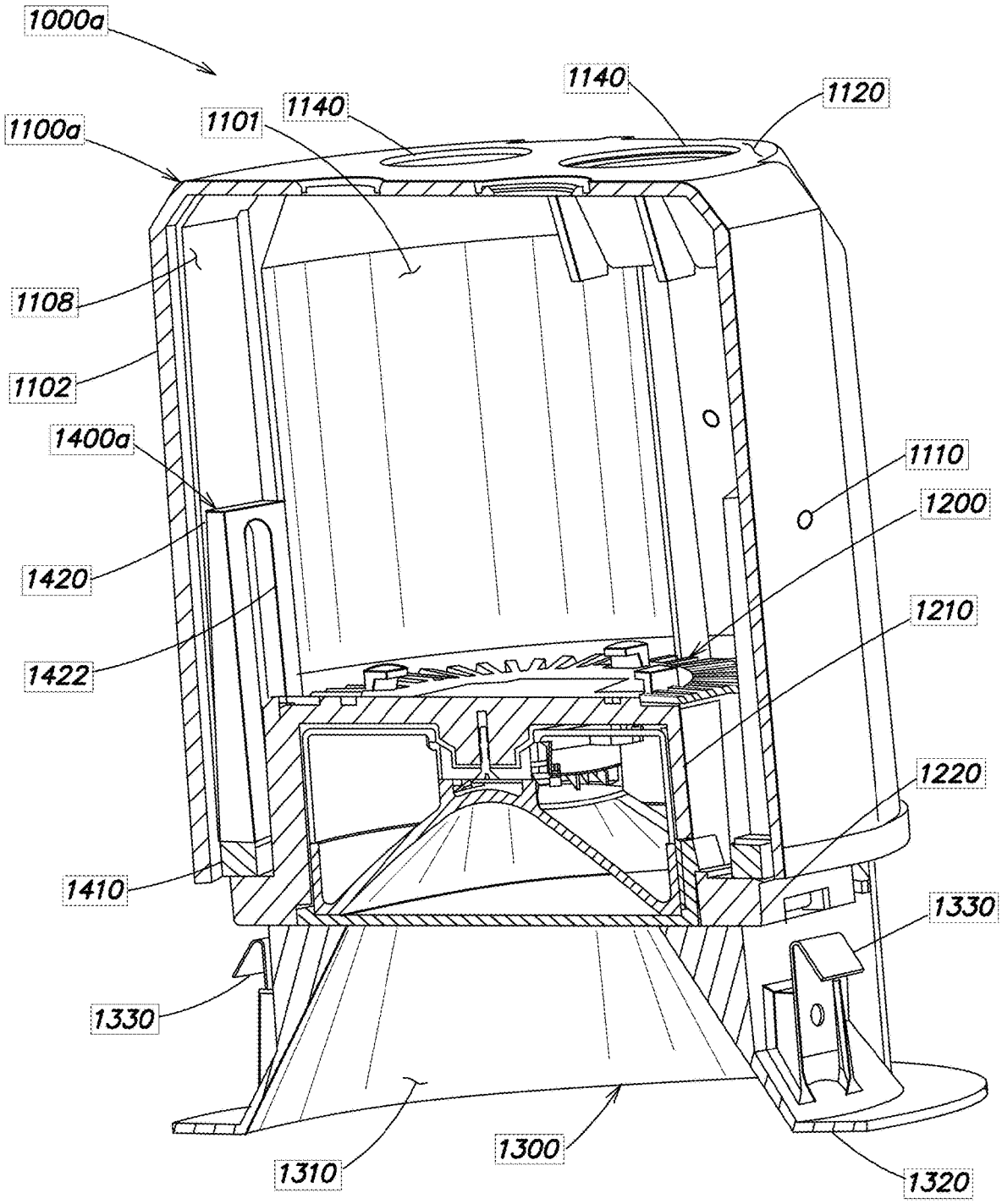
FIG. 1C shows a cross-sectional front perspective view of the lighting fixture of FIG. 1B where the yoke is positioned near the opening of the housing.
Figures 1, 1D:
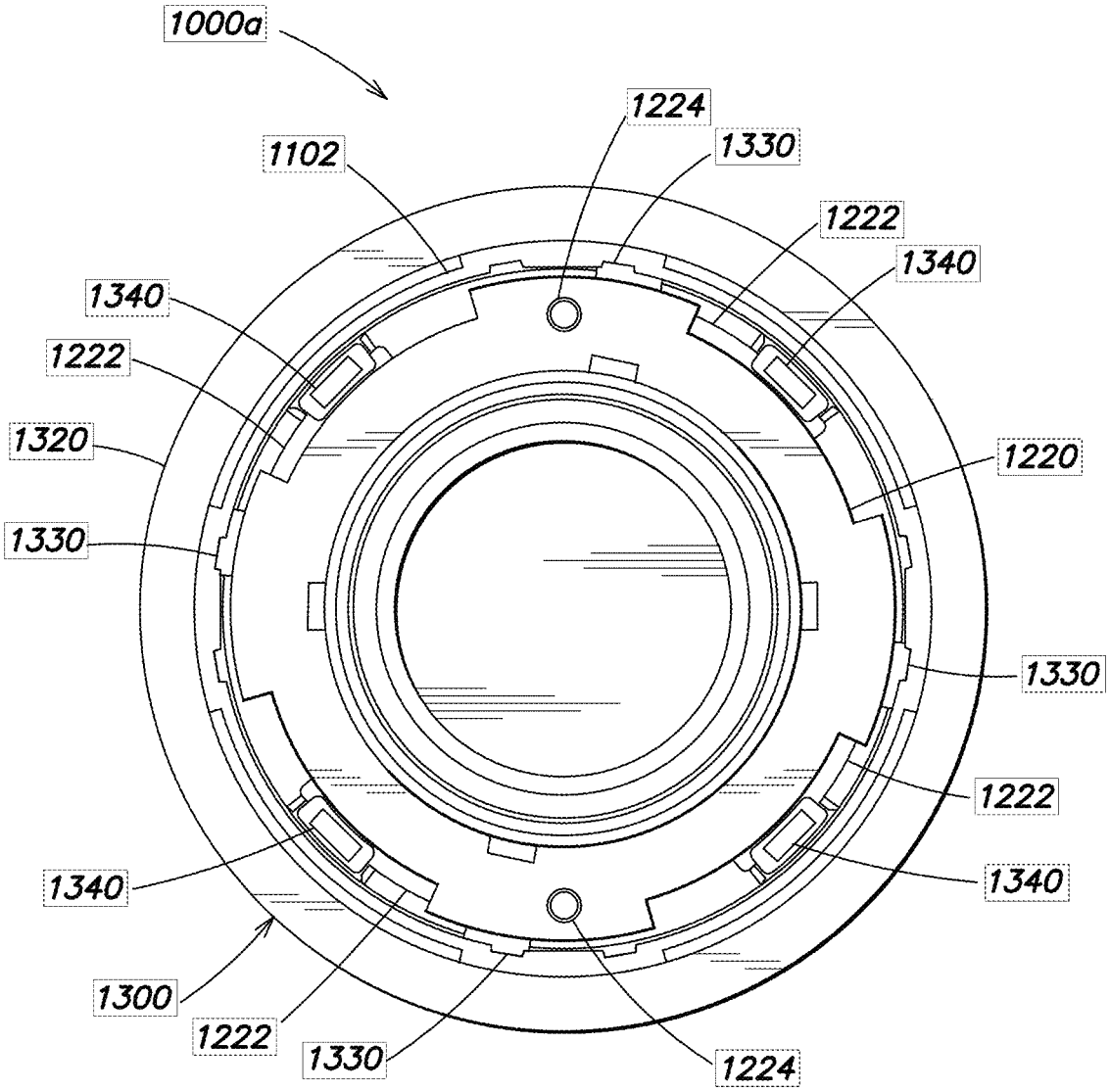
FIG. 1D-1 shows a cross-sectional top view of the lighting fixture of FIG. 1A where the trim is partially engaged with the light module.
Figures 1, 1D, 2:
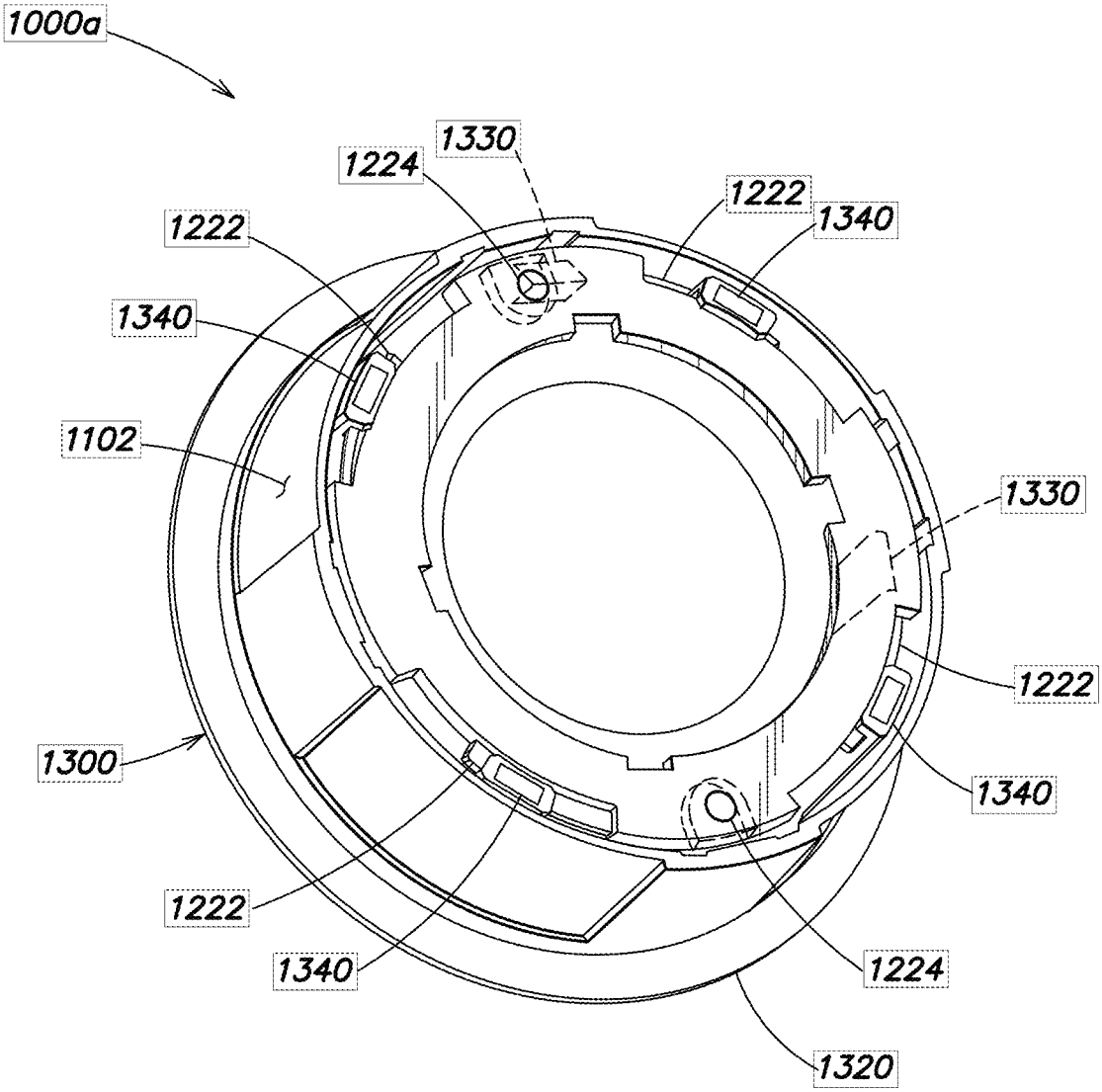
Figures 1, 1E:
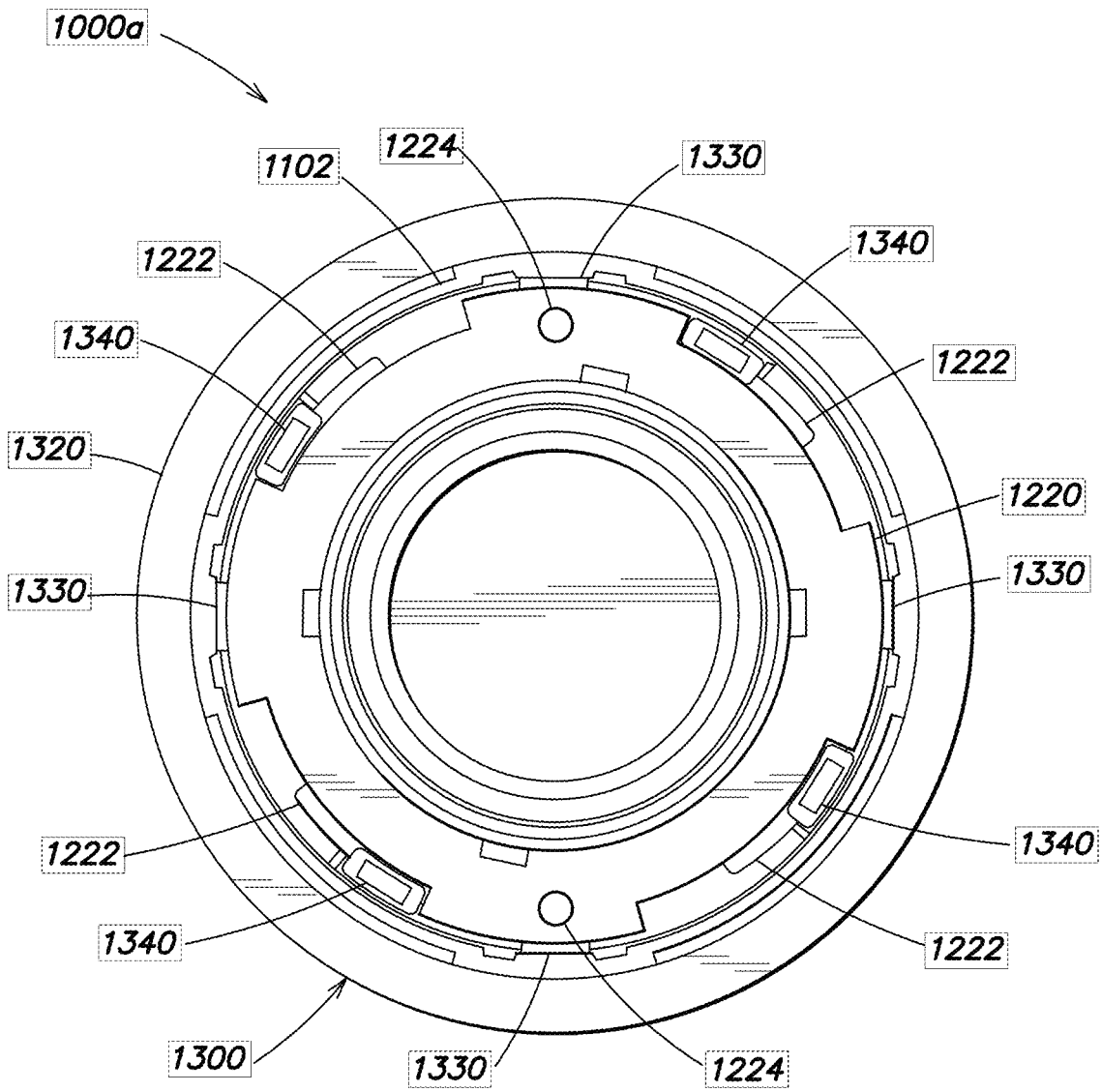
Figures 1, 1E, 2:
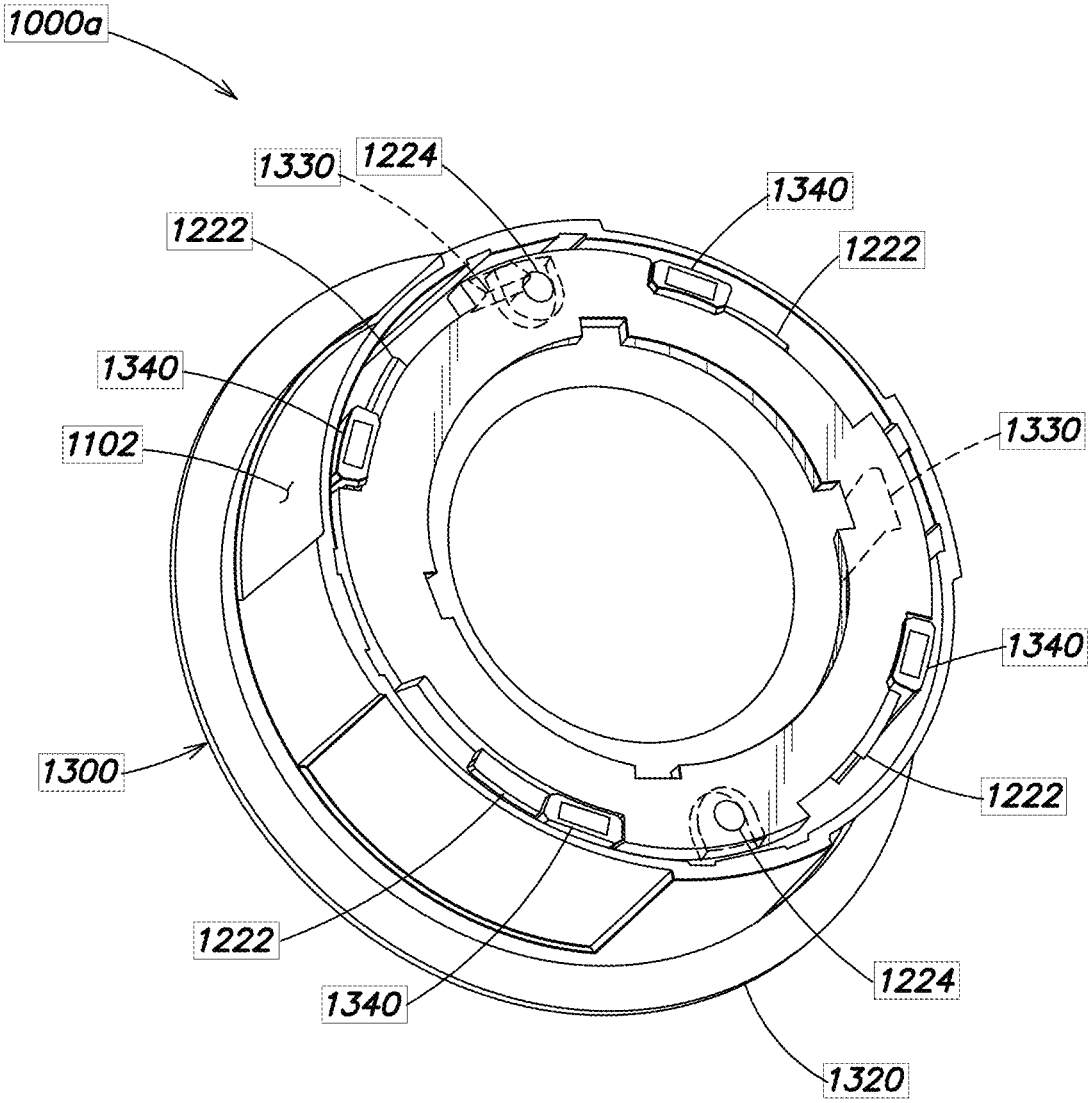

As shown in FIGS. 1B and 1C, the yoke 1400*a* is slidably adjustable along a slot 1422 on an arm 1420 of the yoke 1400*a*. The slot 1422 of the yoke 1400*a* may thus define the limits in the position of the yoke 1400*a* relative to the housing 1100*a*. FIG. 1B shows one exemplary limit where the yoke 1400*a* may be fully recessed into the cavity 1101 of the housing 1100*a* such that the light module 1200 and a portion of the trim 1300 is also contained in the cavity 1101 of the housing 1100*a*. FIG. 1C shows another exemplary limit where the frame 1410 of the yoke 1400*a* abuts the opening 1103 of the housing 1100*a* for the user to more easily mount the light module 200 to the yoke 1400*a*. FIGS. 1D-1E show the trim 1300 may be secured to the light module 1200 via at least one tab 1340 on the trim 1300 that engages a twist and lock connector 1222 on a module housing 1210 of the light module 1200. In particular, FIGS. 1D-1 and 1D-2 show cross-sectional views of the recessed lighting system 1000*a* where the tab 1340 of the trim 1300 is partially engaged with the twist and lock connector 1222 of the light module 1200. FIGS. 1E-1 and 1E-2 show cross-sectional views of the recessed lighting system 1000*a* where the tab 1340 of the trim 1300 if fully engaged with the twist and lock connector 1222 of the light module 1200.

Generally, a method of installing the recessed lighting system 1000*a* may include the following steps: (1) installing the housing 1100*a* into the building structure using the hanger bar assembly, (2) removing a knockout 1140 and/or opening a feedthrough tab 1130 to pass a wire or cable that supplies electrical power to the light module 1200 into the cavity 1101 of the housing 1100*a*, (3) configuring the wire/cable for connection (e.g., attaching a connector, connecting a ground wire to an electrical ground), (4) electrically coupling the light module 1200 to the wire/cable, (5) mounting the light module 1200 to the frame 1410 of the yoke 1400*a*, (6) mounting the trim 1300 to the light module 1200, (7) inserting the light module 1200, trim 1300, and yoke 1400*a* into the cavity 1101 of the housing 1100*a* along the axis defined by the slot 1422 on the arm 1420 of the yoke 1400*a*. The trim 1300 may include a coupling mechanism, such as a friction spring clip, to secure the light module 1200, trim 1300, and yoke 1400*a* to the housing 1100*a*.

FIGS. 2A-2F show several exemplary views of the housing 1100*a*. As shown, the housing 1100*a* may include a sidewall 1102 that defines and substantially surrounds a cavity 1101. The sidewall 1102 may have an opening 1103 through which light from the light module 1200 exits the recessed lighting system 1000*a* into the environment. The sidewall 1102 may also include a cover 1120 to partially enclose the housing 1100*a*. As shown in FIGS. 2A-2F, the sidewall 1102 may define a radially symmetric cavity 1101 along a linear axis. It should be appreciated that the housing 1100*a* in other implementations may define an asymmetric cavity 1101. The cover 1120 may thus be disposed at an opposing end of the sidewall 1102 from the opening 1103. In some implementations, the cover 1120 and the sidewall 1102 may be formed as a single component to reduce the number of manufacturing steps and to simplify assembly. In some implementations, the cover 1120 and the sidewall 1102 may be an assembly of multiple components that are coupled together using various coupling mechanisms including, but not limited to a snap fit, a fastener, a clip, and a clamp. Fabricating the cover 1120 and the sidewall 1102 separately may simplify manufacture by simplifying the complexity of the parts being fabricated.

The sidewall 1102 and the cavity 1101 may generally have various cross-sectional shapes including, but not limited to a circle, an ellipse, a regular polygon (e.g., a polygon where the sides are equal in length), and an irregular polygon (e.g., a polygon where the sides are not equal in length). In one example, the sidewall 1102 and the cavity 1101 may have a circular cross-section, which may reduce the size of the flange 1320 on the trim 1300 to cover the opening 1103 of the housing 1100*a*. In another example, the sidewall 1102 may have an irregular octagonal cross-section such that the shape of the housing 1100*a* may appear as a tapered square (e.g., a square with chamfered or beveled corners). In some implementations, the cross-sectional shape of the sidewall 1102 and/or the cavity 1101 may vary along an axis orthogonal to the opening 1103 or between the cover 1120 and the opening 1103 (e.g., along the length of the sidewall 1102). For example, the cross-sectional shape of the sidewall 1102 may be polygonal near the cover 1120 and cylindrical near the opening 1103. Additionally, the housing 1100*a* and the cavity 1101 may have a similar shape (e.g., the sidewall 1102 is substantially uniform) or a dissimilar shape (e.g., the sidewall 1102 is substantially non-uniform). For example, the sidewall 1102 and the cavity 1101 of the housing 1100*a* in FIGS. 2A-2F may both have a cross-sectional shape that is cylindrical. In another example, the sidewall 1102 may be polygonal and the cavity 1101 is cylindrical. This may result in a sidewall 1102 with a variable thickness. Furthermore, the cover 1120 may have a shape substantially similar to the cross-sectional shape of the sidewall 1102 (e.g., the circular cover 1120 and the circular sidewall 1102 shown in FIGS. 2A-2F) or a shape that is dissimilar to the sidewall 1102 (e.g., a circular cover 1120 and a polygonal sidewall 1102 such that the cover 1120 has an overhanging portion).

Figure 2A:
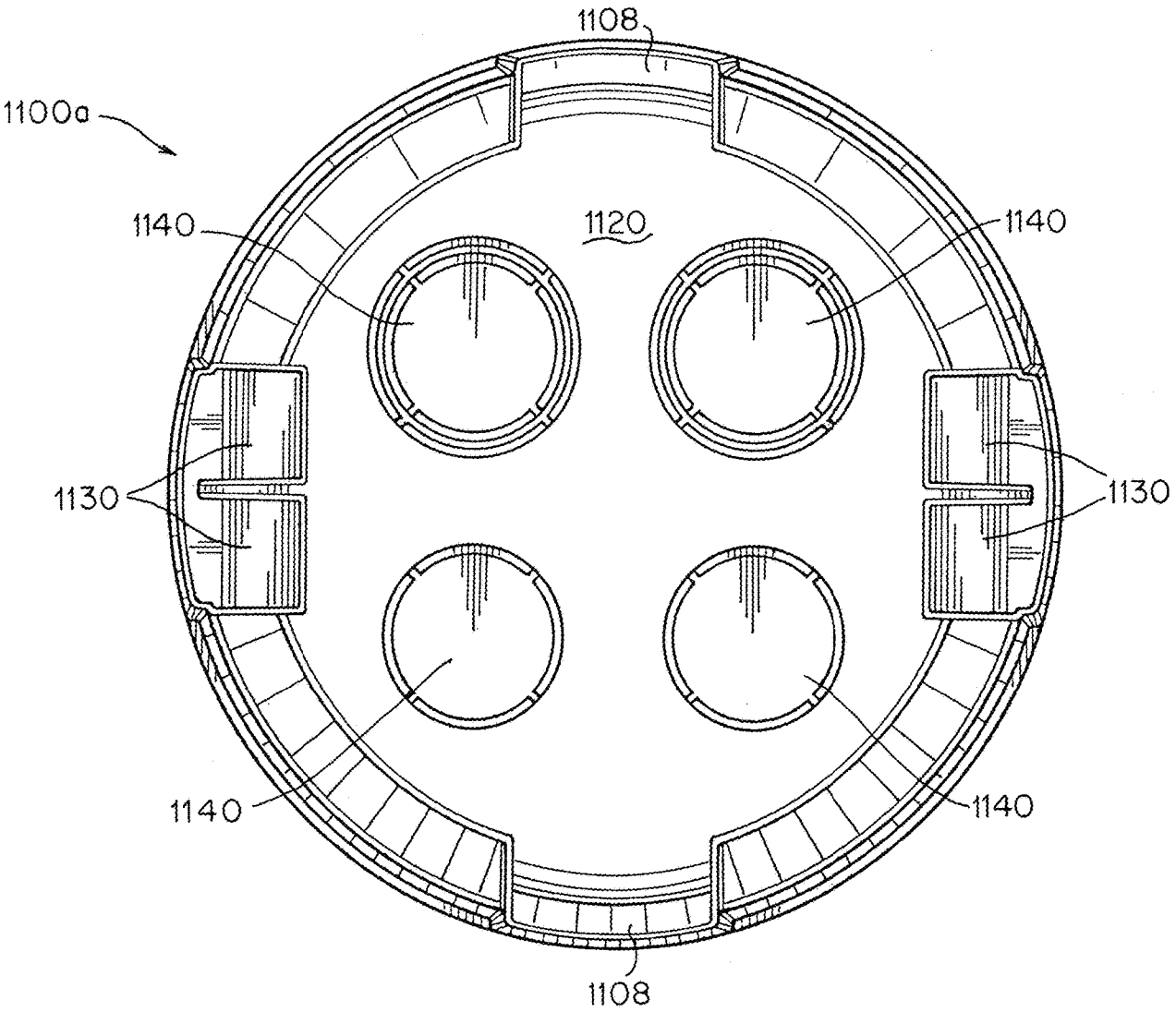
FIG. 2A shows a top view of the junction box of FIG. 1A.
Figure 2B:
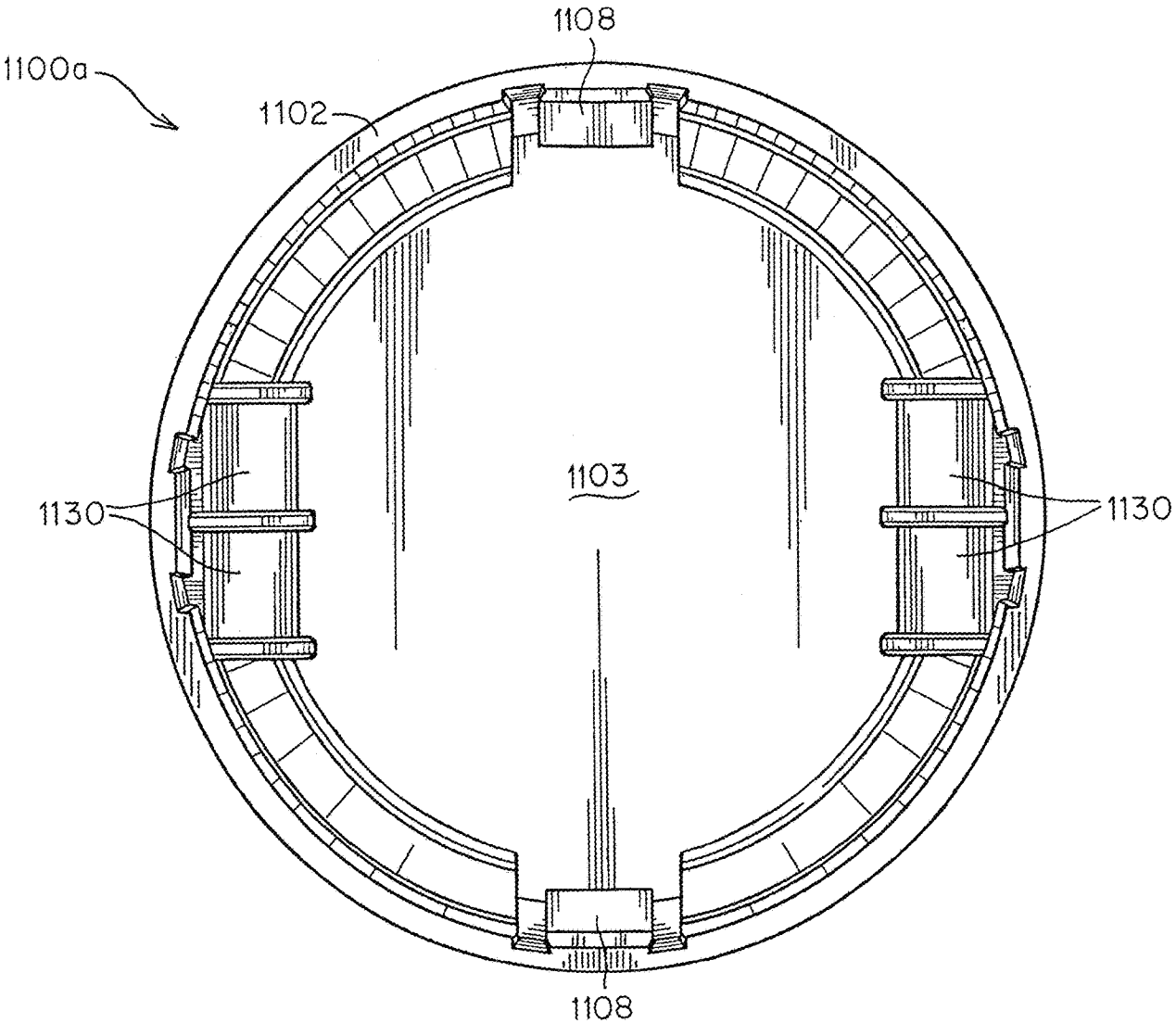
FIG. 2B shows a bottom view of the junction box of FIG. 2A.
Figure 2C:
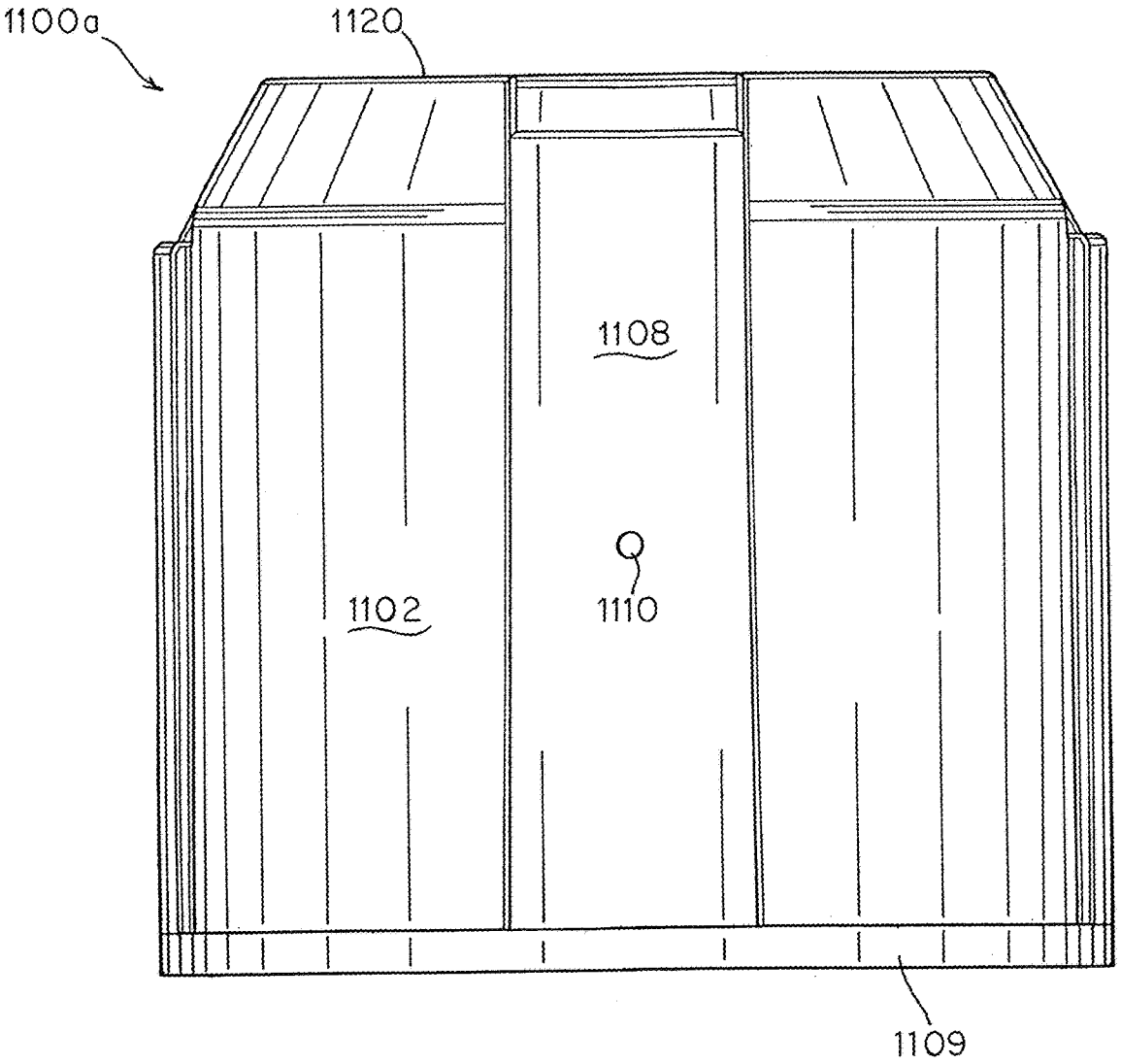
FIG. 2C shows a right-side view of the junction box of FIG. 2A, the left-side view being identical.
Figure 2D:
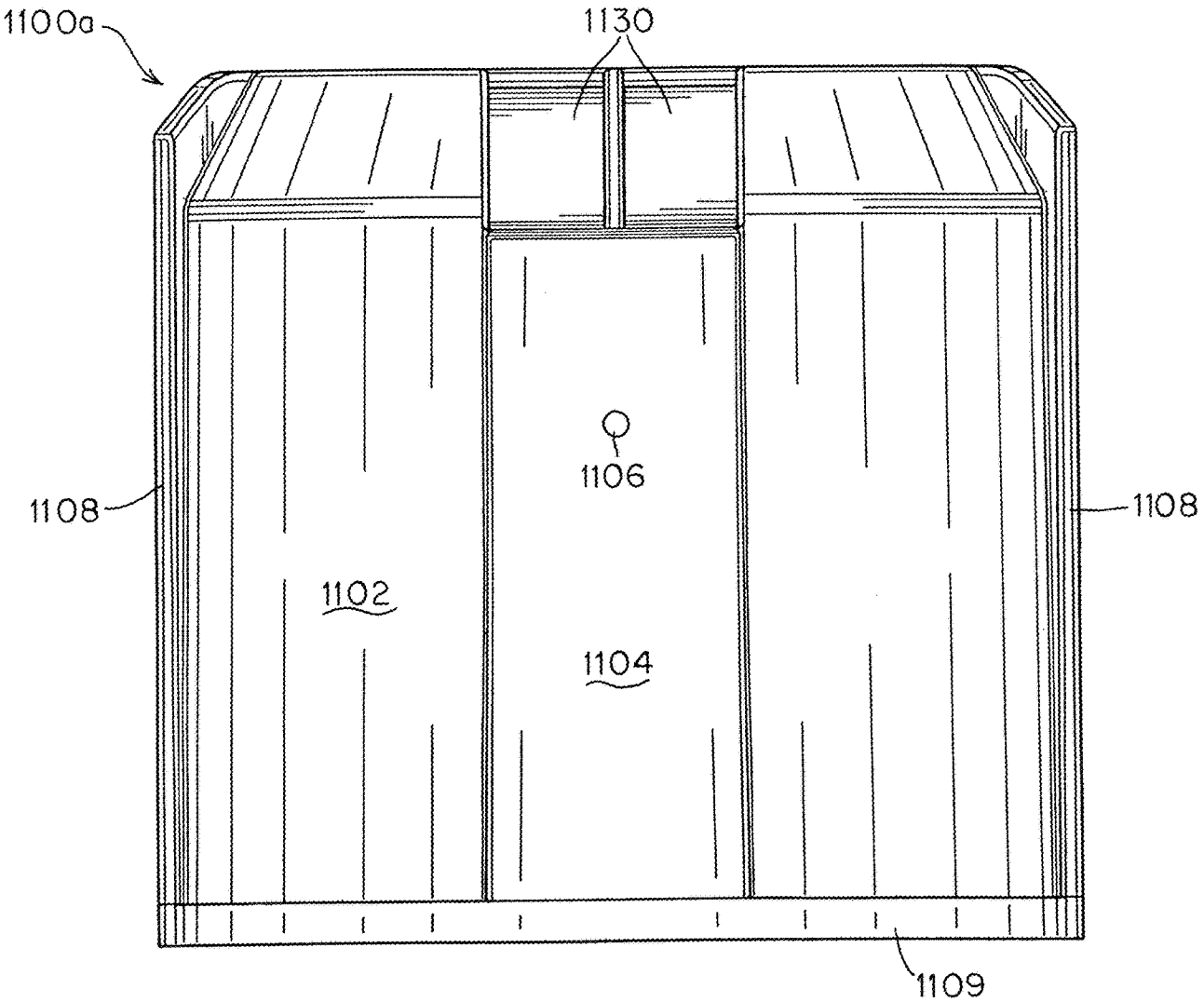
FIG. 2D shows a front-side view of the junction box of FIG. 2A, the rear-side view being identical.
Figure 2E:
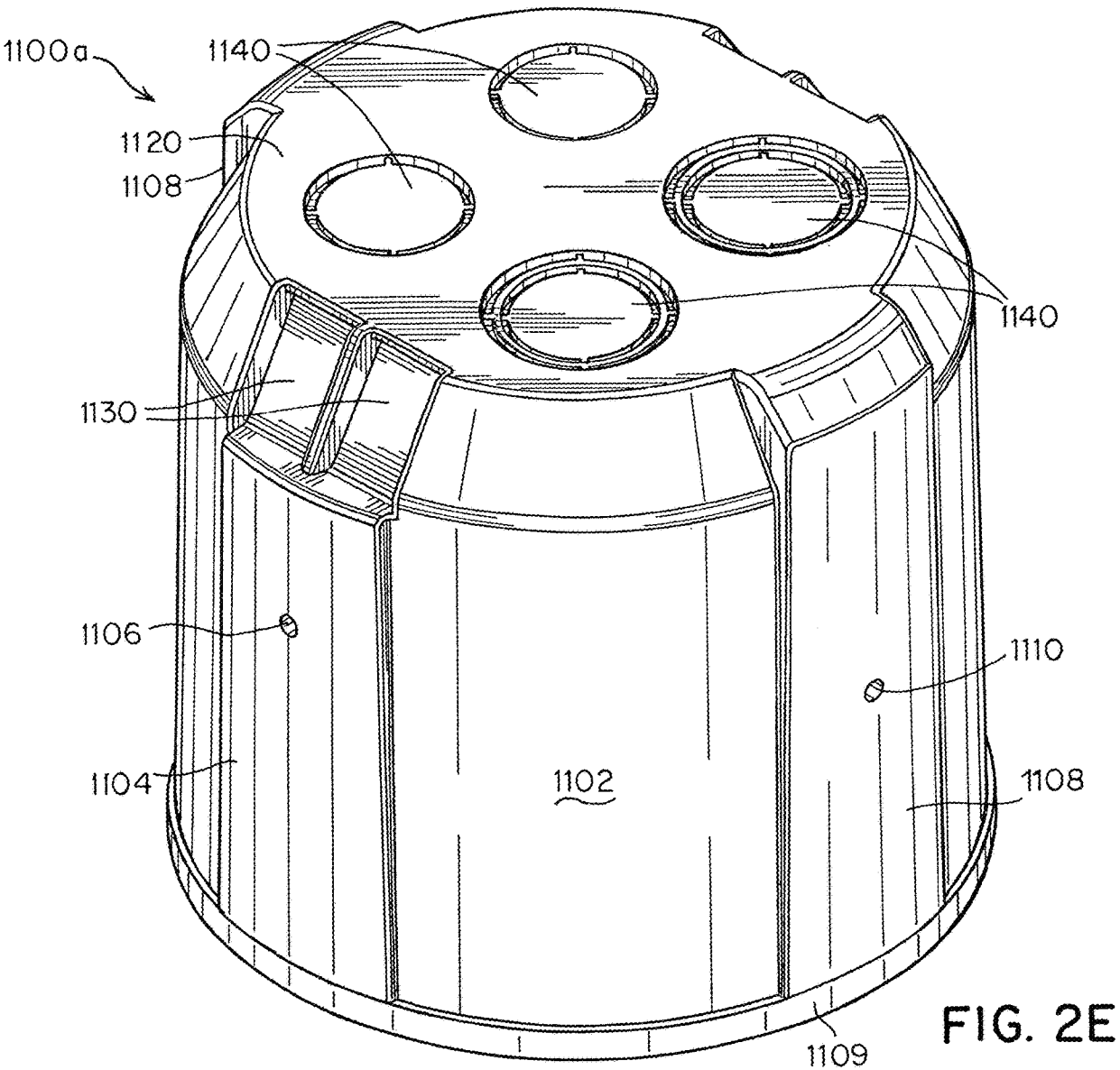
FIG. 2E shows a top, front perspective view of the junction box of FIG. 2A.

The housing 1100*a* may also include a bevel and/or a chamfer between the cover 1120 and the sidewall 1102 to reduce the amount of material used, the presence of sharp corners for safety and wear resistance, and/or to improve manufacturability. The housing 1100*a* may also incorporate structural features to increase the structural rigidity of the housing 1100*a*. For example, FIG. 2E shows the sidewall 1102 include mounting sections 1104 and 1108 to facilitate coupling to a hanger bar assembly and the yoke 1400*a*, respectively. These sections 1104 and 1108 may be made thicker than other portions of the sidewall 1102 to increase the structural rigidity of the sidewall. Additionally, the housing 1100*a* may have a rim 1109 at the opening 1103 to also increase structural rigidity.

In some implementations, the housing 1100*a* may be dimensioned to accommodate the light module 1200 and wires/cables that supply or transfer electrical power to or from the recessed lighting system 1000*a*. For instance, the housing 1100*a* may have a depth of up to about 4 inches and a width (or a diameter) ranging between about 2 inches and about 6 inches. The housing 1100*a* may also be dimensioned such that the cavity 1101 has sufficient volume to contain multiple wires/cables with a gauge at least about 12 or greater (e.g., a higher gauge corresponds to a smaller sized wire/cable). For example, the cavity 1101 may provide sufficient room to contain eight 12 gauge wires/cables to daisy-chain the recessed lighting system 1000*a* with another lighting system in the environment (e.g., another recessed lighting system 1000*a*). Said in another way, a portion of the cavity 1101 of the housing 1100*a* may be dedicated to house wires/cables with a corresponding volume similar to previous electrical junction boxes (e.g., between about 15 cubic inches to about 30 cubic inches). Additionally, the housing 1100*a* may have sufficient volume to contain therein the light module 1200 and at least a portion of the trim 1300.

The housing 1100*a* may also include several features to facilitate assembly with other components of the recessed lighting system 1000*a*. For example, the housing 1100*a* may include a knockout 1140, which is a removable portion of the housing 1100*a* that creates an opening for a wire/cable, such as a conduit cable (e.g., a metallic sheathed cable) to enter or exit the cavity 1101 of the housing 1100*a*. FIGS. 2A and 2E show the cover 1120 of the housing 1100*a* may include multiple knockouts 1140. As shown, the knockouts 1140 may vary in size and shape. Furthermore, the knockout 1140 may have multiple removable portions (e.g., a central portion and an annular portion) to allow the user to progressively enlarge the opening. Although FIGS. 2A and 2E show the knockouts 1140 are only on the cover 1120, it should be appreciated the knockout 1140 may also be disposed on other portions of the housing 1100*a* (e.g., the sidewall 1102). In some implementations, the knockout 1140 may satisfy a pull force specification for a conduit cable set forth by the National Electric Code (NEC).

In another example, the housing 1100*a* may include a feedthrough tab 1130 to facilitate entry of a wire/cable, such as a Romex cable (i.e., a non-metallic sheathed cable). Unlike the knockout 1140 described above, the feedthrough tab 1130 may be a non-removable, compliant feature that allows a user to form an opening by bending the feedthrough tab 1130 into the cavity 1101 of the housing 1100*a*. FIGS. 2A-2E show several exemplary feedthrough tabs 1130 disposed on the beveled portion of the housing 1100*a* between the sidewall 1102 and the cover 1120. In some implementations, the feedthrough tab 1130 may allow a user to open and close openings in the housing 1100*a* by bending the feedthrough tab 1130 into and out of the cavity 1101. The portion of the feedthrough tab 1130 that attaches to the sidewall 1102 may also be prestressed during manufacture such that a restraining force is applied to the wire/cable, thus holding the wire/cable in place in the housing 1100*a* after installation. If a wire/cable is subsequently removed from the housing 1100*a*, the restraining force may cause the feedthrough tab 1130 to return to its original closed position. In some implementations, the feedthrough tab 1130 may satisfy a pull force specification for a Romex cable set forth by the National Electric Code (NEC).

It should be appreciated the wire/cable (e.g., the conduit cable, the Romex cable) supplying electrical power to the recessed lighting system 1000*a* may be an alternating current (AC) source or a direct current source (DC). It should also be appreciated the wire/cable may originate from an electric power supply in the building structure or from another recessed lighting system 1000*a* in a daisy-chaining configuration.

Figure 2F:
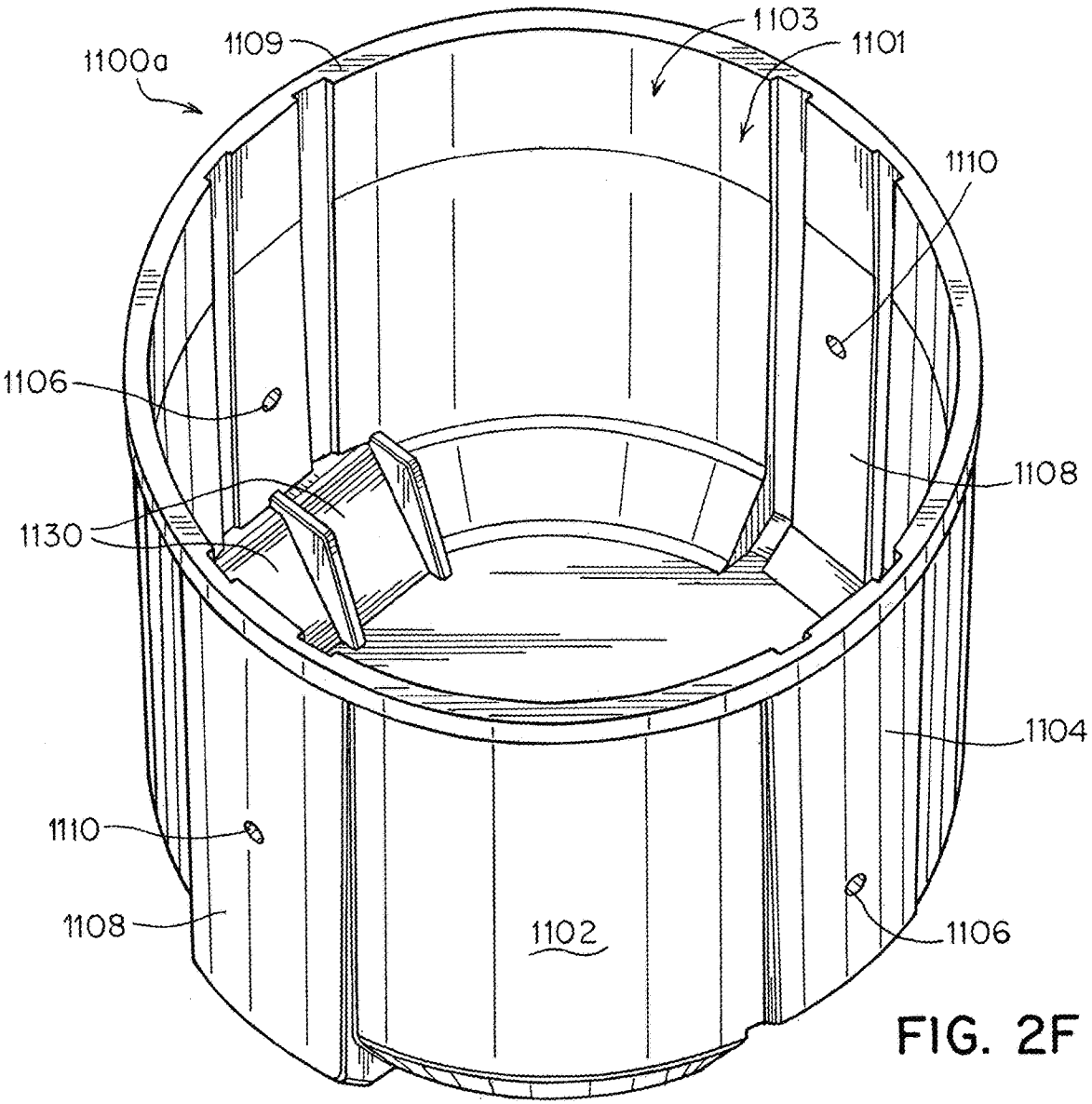
FIG. 2F shows a bottom, front perspective view of the junction box of FIG. 2A.

The housing 1100*a* may also include structural features to couple the yoke 1400*a* to the housing 1100*a*. For example, FIGS. 2C, 2E, and 2F show the housing 1100*a* includes the mounting section 1108, which protrudes outwards from the sidewall 1102. The mounting section 1108 may be protruded in order to define a corresponding recess in the cavity 1101 that mechanically guides the arm 1420 of the yoke 1400*a* as the yoke 1400*a* slides along the slot 1422. The mounting section 1108 may also include an opening 1110 to receive a coupling member (not shown) that passes, at least partially, through the opening 1110. The coupling member may be inserted into the slot 1422 of the arm 1420 of the yoke 1400*a* to constrain and guide the yoke 1400*a*. The coupling member may be various type of coupling mechanisms including, but not limited to a peg, a screw fastener, a bolt fastener, a dowel, and a rod. In some implementations, the coupling member may be tightened (e.g., via a nut, a thumbscrew, a butterfly wing screw) to secure the yoke 1400*a* to the housing 1100*a* at a particular position along the slot 1422. In some implementations, the coupling member may not secure the yoke 1400*a* to the housing 1100*a*, but instead may only guide the yoke 1400*a*. In such designs, another mechanism (e.g., a friction spring clip on the trim 1300) may be used to secure the yoke 1400*a* (along with the light module 1200 and the trim 1300) to the housing 1100*a*.

The housing 1100*a* may also include structural features to couple the hanger bar assembly to the housing 1100*a*. For example, FIGS. 2D, 2E, and 2F show the housing 1100*a* includes the mounting section 1104, which protrudes outwards from the sidewall 1102 to provide a surface against which a hanger bar holder of the hanger bar assembly may be mounted to the housing 1100*a*. The mounting section 1104 may include an opening 1106 to couple the hanger bar holder to the housing 1100*a* via a coupling member (not shown). The coupling member may again be various type of coupling mechanisms including, but not limited to a screw fastener, a bolt fastener, and a snap fit. As will be described in further detail below, the position of the hanger bar assembly relative to the housing 1100*a* may be adjustable to accommodate different building structures (e.g., the spacing and orientation between neighboring studs may vary) in the environment.

The housing 1100*a* may also be configured to satisfy one or more safety standards related to various properties of the recessed lighting system 1000*a* including, but not limited to fire resistance, sound attenuation, air tightness, concrete tightness, structural rigidity, and water resistance. For example, the housing 1100*a* may be qualified as a luminaire fixture and/or a junction box based on the specifications set forth by the NEC and/or the Underwriter's Laboratory (UL). For instance, the housing 1100*a* may be qualified as a junction box if the housing 1100*a* satisfies UL514C, which is the UL standard for nonmetallic outlet boxes, flush-device boxes, and covers. The housing 1100*a* may be qualified as a luminaire fixture if the housing 1100*a* satisfies UL1598, which is the UL standard for luminaires.

The housing 1100*a* may generally be fire-rated or non-fire-rated depending on the material used to form the housing 1100*a* and the gage or thickness of the housing 1100*a*. In terms of safety standards, the housing 1100*a* may be fire-rated if the housing 1100*a* satisfies UL263, which is the UL standard for fire tests of building construction and materials, or the standards set forth by the American Society for Testing and Materials (ASTM) and/or the National Fire Protection Association (NFPA). For instance, the housing 1100*a* may have an hourly rating (e.g., 1 hour, 2 hour) and a location rating (e.g., floor, wall, ceiling) based on where the recessed lighting system 1000*a* is installed in the environment.

As described above, the housing 1100*a* may also incorporate structural features to improve the structural rigidity of the housing 1100*a*. The design of such features may be based, in part, on structural rigidity specifications set forth by the NEC and/or the UL (e.g., UL 1598, UL 541C) for a junction box and a luminaire fixture. The housing 1100*a* may also be insulation contact (IC) rated, which allows insulation in a wall or a ceiling to physically contact the housing 1100*a*. An IC rated housing 1100*a* may enable the recessed lighting system 1000*a* to be installed without use of a separate enclosure unlike non-IC rated recessed lighting systems. The housing 1100*a* may also meet air tightness standards (e.g., ASTM E283 certification) to increase the energy efficiency of a building by reducing air leaks between an interior environment and an exterior environment that may otherwise compromise the thermal insulation of the building. The housing 1100*a* may also meet sound ratings according to the specifications set forth by the Sound Transmission Class (STC) and/or the Impact Insulation Class (IIC).

It should be appreciated the safety standards cited herein are exemplary. The recessed lighting system 1000*a* may generally satisfy similar and/or equivalent safety standards from other organizations and/or associations, which may vary by municipality, county, state, province, or country. Furthermore, the recessed lighting system 1000*a* may satisfy the specifications set forth by safety standards as they are modified and/or updated over time.

The housing 1100*a* may be formed from various thermoplastic and thermosetting polymers including, but not limited to polyvinyl chloride (PVC), acrylonitrile butadiene styrene (ABS), polycarbonate (PC), polyurethane (PU), polyethylene, polyethylene terephthalate, polypropylene, and polystyrene. The housing 1100*a* may be fabricated using various manufacturing methods including, but not limited to injection molding, 3D printing, and blow molding.

As described above, the yoke 1400*a* may be used to facilitate the installation of the light module 1200 into the housing 1100*a* by providing a user a more accessible surface to mount the light module 1200 to the housing 1100*a*. In some implementations, the yoke 1400*a* may not be removable from the housing 1100*a* once the coupling member is inserted into the opening 1106 of the mounting section 1104 through the slot 1422. In this manner, the yoke 1400*a* may also function as a safety feature of the recessed lighting system 1000*a* by preventing the light module 1200 from inadvertently falling out of the cavity 1101 of the housing

1100*a*. In some implementations, the yoke 1400*a* may also allow the light module 1200 to be tilted within the cavity 1101 of the housing 1100*a* in order to adjust the direction of the light from the light module 1200 into the environment. For example, the coupling member in the opening 1106 may function as a pivot, allowing the yoke 1400*a* to rotate about the coupling member. The orientation of the light module 1200 may be maintained by tightening the coupling member to secure the yoke 1400*a* to the housing 1100*a* and/or using a trim 1300 with an opening 1310 shaped to support the tilted orientation of the light module 1200.

The yoke 1400*a* may include a frame 1410 that defines a frame opening 1430. The frame 1410 and the frame opening 1430 may have various shapes including, but not limited to a circle, an ellipse, a regular polygon, and an irregular polygon. In some implementations, the frame 1410 may have an irregular thickness such that the exterior shape of the frame 1410 and the frame opening 1430 are different. For example, the exterior shape of the frame 1410 may be polygonal and the frame opening 1430 may be circular. In some implementations, the exterior shape of the frame 1410 may correspond to the shape of the cavity 1101 of the housing 1100*a* and the shape of the frame opening 1430 may correspond to the shape of the module housing 1210 of the light module 1200. In this manner, the frame 1410 may substantially enclose a portion of the cavity 1101 of the housing 1100*a* when the light module 1200 is installed. Furthermore, the frame 1410 may be shaped to abut against a portion of the module housing 1210.

Figure 3A:
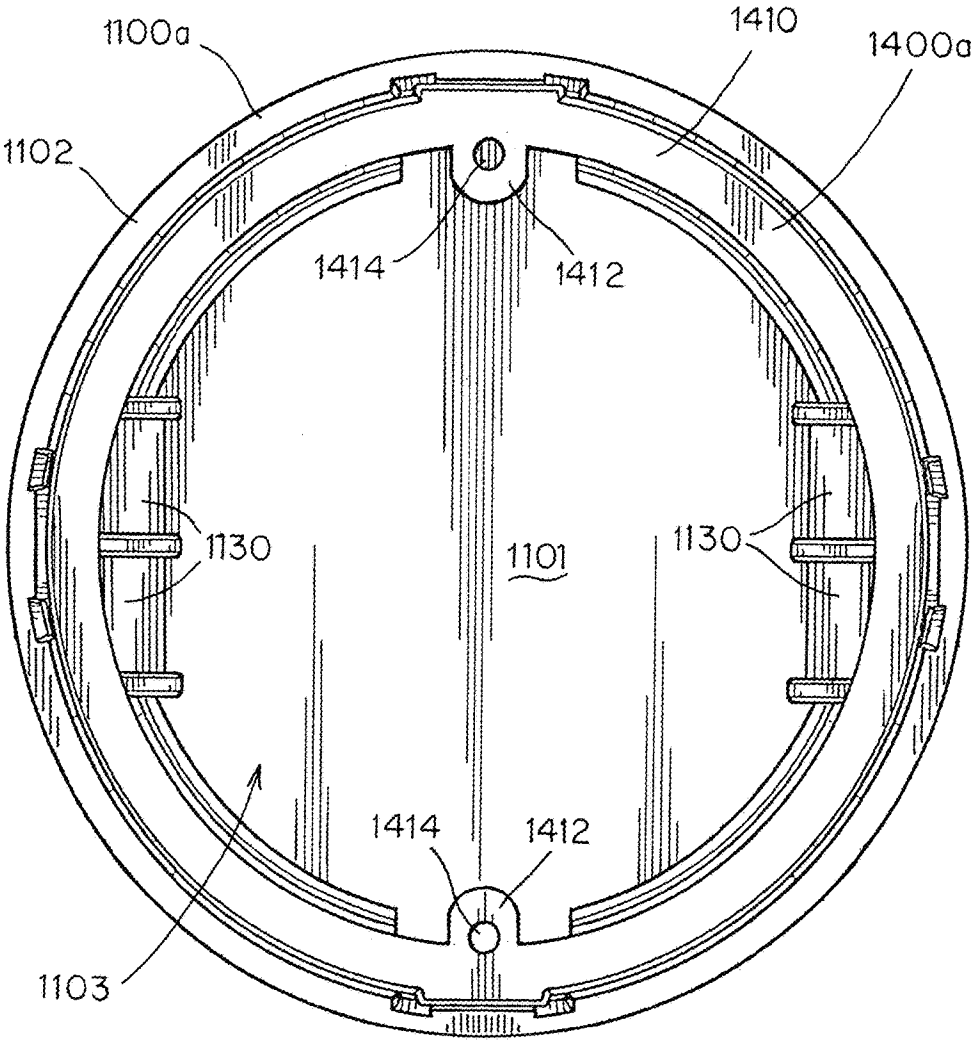
FIG. 3A shows a bottom view of the junction box of FIG. 2A with the yoke inserted into the junction box.
Figure 3B:
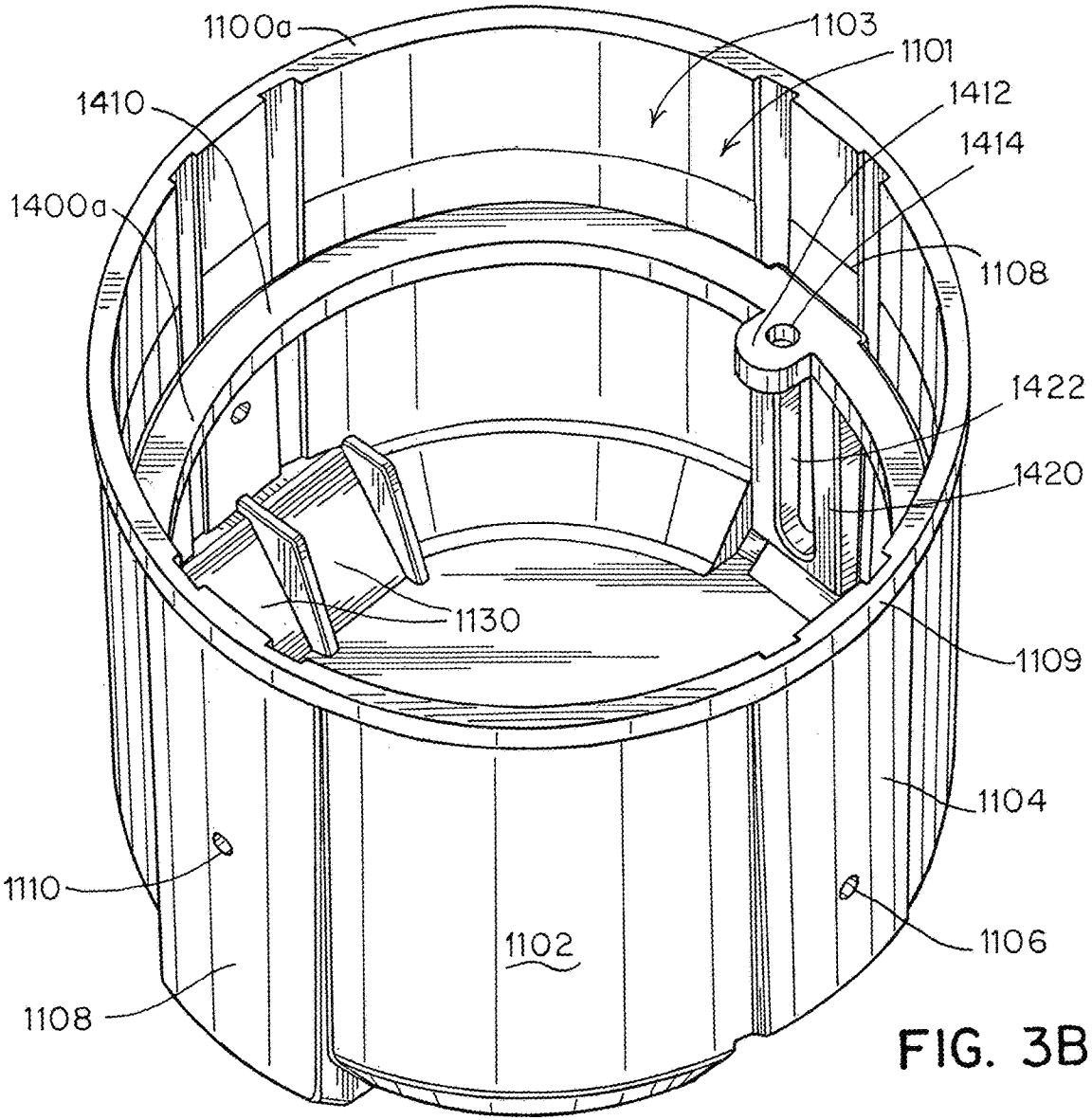
FIG. 3B shows a bottom, front perspective view of the junction box of FIG. 3A where the yoke is at a fully recessed position.
Figure 3C:
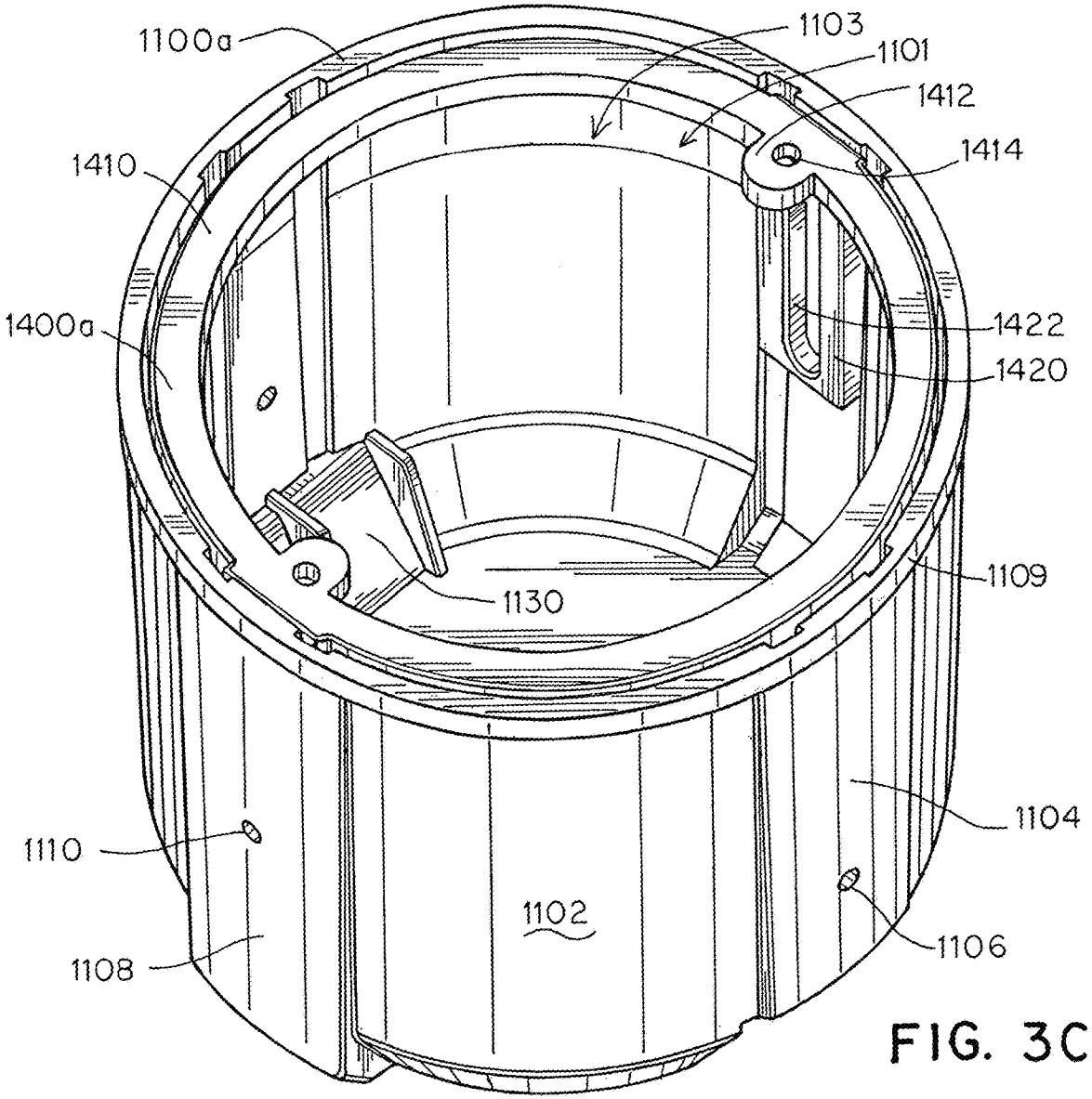
FIG. 3C shows a bottom, front perspective view of the junction box of FIG. 3A where the yoke is at a neutral position.

The frame 1410 may also include various coupling mechanisms to couple the light module 1200 to the yoke 1400*a* including, but not limited to a screw fastener, a bolt fastener, and a snap fit connector. FIGS. 3A-3C show several views of an exemplary yoke 1400*a* deployed in the housing 1100*a*. As shown, the yoke 1400*a* may include a tab 1412 that extends into the frame opening 1430. The tab 1412 may be used to define an opening 1414 where a fastener may be inserted through the opening 1414 to couple the yoke 1400*a* to the module housing 1210. As shown, the yoke 1400*a* may include multiple openings 1414 arranged to match corresponding openings on the module housing 1210 for assembly. The frame opening 1430 may also be dimensioned such that the light module 1200 is at least partially inserted through the frame opening 1430. For instance, FIGS. 1B and 1C show the module housing 1210 is partially inserted through the frame opening 1430 such that a flange 1220 on the module housing 1210 abuts the frame 1410. The flange 1220 may include through hole openings 1224 aligned to the openings 1414, which in this case may be threaded to secure respective fasteners.

The yoke 1400*a* may also include an arm 1420 attached to the frame 1410. The arm 1420 may protrude from the frame 1410 along an axis substantially orthogonal to a plane coincident with the frame opening 1430. For example, the yoke 1400*a* depicted in FIGS. 3B-3D-2 has a flat, circular frame 1410. Thus, a plane may be defined based on the frame opening 1430 that is substantially parallel to the opening 1103 of the housing 1100*a*. The arm 1420 may protrude along an axis normal to the plane. Said in another way, the arm 1420 may include a proximal end coupled to the frame 1410 and a distal end that is positioned some distance (e.g., the length of the arm 1420) from the proximal end. The linear axis defined between the proximal end and the distal end may be normal to the plane defined by the frame opening 1430.

Figures 1, 3D:
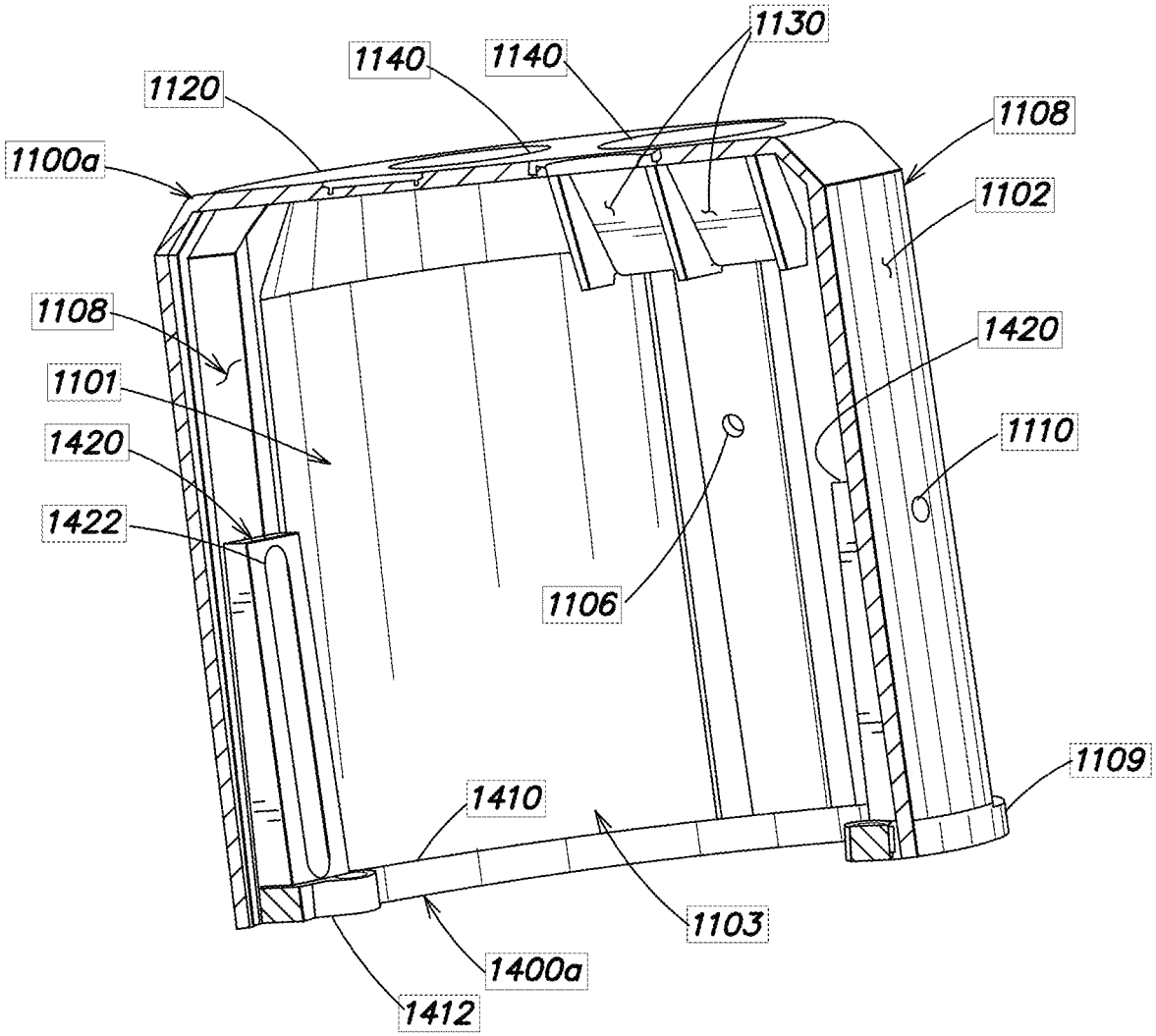
Figures 2, 3D:
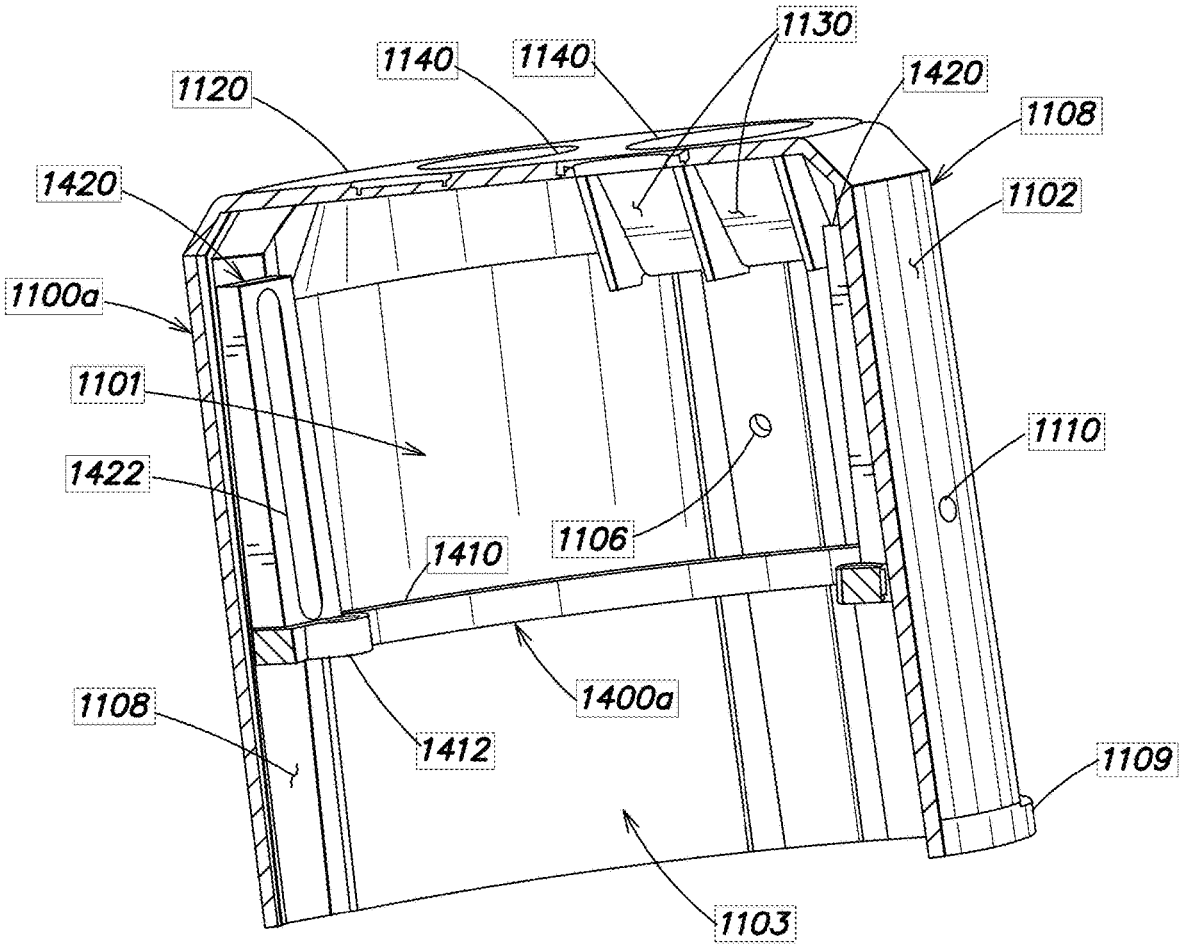

The arm 1420 may also include a slot 1422 that runs along the length of the arm 1420. The slot 1422, as described above, may define the translational axis along which the yoke 1400*a* is slidably adjustable. The length of the slot 1422 may determine the range of translational motion of the yoke 1400*a* with respect to the housing 1100*a*. The position of the slot 1422 in relation to the arm 1420 and the opening 1106 may determine the available positions of the yoke 1400*a* within the cavity 1101 of the housing 1100*a*. For example, FIGS. 3C and 3D-1 show the yoke 1400*a* may be configured such that at one limit, the frame 1410 of the yoke 1400*a* abuts the opening 1103 of the housing 1100*a* such that the frame 1410 does not extend beyond the opening 1103. FIGS. 3B and 3D-2 show another limit where the distal end of the arms 1420 are proximate to the cover 1120 of the housing 1100*a*. The width of the slot 1422 may correspond to the size of the opening 1110 and/or the size of the coupling member mounted to the opening 1110.

The yoke 1400*a* may be formed from various metals, thermoplastic polymers, and thermosetting polymers including, but not limited to aluminum, steel, stainless steel, polyvinyl chloride (PVC), acrylonitrile butadiene styrene (ABS), polycarbonate (PC), and polyurethane (PU), polyethylene, polyethylene terephthalate, polypropylene, polystyrene, a Makrolon® polycarbonate, and a Therma-Tech™ thermally conductive compound. The yoke 1400*a* may be fabricated using various manufacturing methods including, but not limited to injection molding, 3D printing, blow molding, casting, and machining.

The light module 1200 may include the module housing 1210, which defines a cavity 1101 that contains various components of the light module 1200 including the light source and the driver. The light source emits light and the driver is used to supply and regulate electrical power to the light source. In some implementations, the module housing 1210 may also house various optical elements that modify the spatial and angular distribution of the light outputted from the light source including, but not limited to a reflector, a lens, a diffuser, and a protective cover.

The module housing 1210 may thus be an enclosure with an opening that outputs light from the light source. The module housing 1210 may include a plurality of fins to facilitate convective cooling. The module housing 1210 may also include a flange 1220 defined along the periphery of the opening of the module housing 1210. The flange 1220 may abut the frame 1410 as shown in FIGS. 1B and 1C. The flange 1220 may also contain various structural features to couple the light module 1200 to the yoke 1400*a* and/or the trim 1300. For example, FIGS. 1D-1-1E-2 show the flange 1220 may include a twist and lock connector 1222 to connect to a tab 1340 on the trim 1300. As described above, the flange 1220 may also include openings 1224 that align with the openings 1414 on the frame 1410 of the yoke 1400*a*.

The module housing 1210 may also be used to dissipate heat generated by the light source. In cases where insulation in the building structure substantially covers the housing 1100*a*, the heat may be dissipated along several paths including: (1) from the module housing 1210 directly to the environment via convective cooling and/or (2) from the module housing 1210 to the trim 1300 via heat conduction and then to the environment via convective cooling. If the recessed lighting system 1000*a* is deployed in a building structure with open space around the housing 1100*a*, heat may also be dissipated along a path (3) from the housing 1100*a* to the open space via convection.

The module housing 1210 may be formed from a combination of various metals and polymers including, but not limited to aluminum, steel, stainless steel, copper, polyvinyl chloride (PVC), acrylonitrile butadiene styrene (ABS), polycarbonate (PC), polyurethane (PU), polyethylene, polyethylene terephthalate, polypropylene, polystyrene, a Makrolon® polycarbonate, and a Therma-Tech™ thermally conductive compound. In some implementations, the module housing 1210 may be formed via an overmolding process where a portion of the module housing 1210 made of a first material (e.g., a metal) is then covered by a second material (e.g., a polymer) to form a unitary component.

Exemplary implementations of the light module 1200 may also be found in PCT Application PCT/US19/32281, filed May 14, 2019 and entitled, "LIGHTING MODULE HAVING INTEGRATED ELECTRICAL CONNECTOR," which is incorporated by reference herein in its entirety.

The trim 1300 may be used to cover the opening 1103 of the housing 1100*a* and an opening in a ceiling or a wall on the building structure where the recessed lighting system 1000*a* is installed. As shown in FIGS. 1A-1C, the trim 1300 may include an opening 1310 where light from the light module 1200 exits the recessed lighting system 1000*a* and into the environment. The trim 1300 may also include a flange 1320 disposed along the periphery of the opening 1310 shaped to cover the opening of the ceiling or wall. The opening 1310 may be tapered such that the opening 1310 is conical in shape (e.g., frusto-conical). The flange 1320 and the cross-sectional shape of the opening 1310 may have various shapes including, but not limited to a circle, an ellipse, a regular polygon, and an irregular polygon.

The trim 1300 may also include various features to couple the trim 1300 to the light module 1200 and/or the housing 1100*a*. For example, the trim 1300 may include tabs 1340 that engage with the twist and lock connector 1222 of the light module 1200. The trim 1300 may also include a coupling member 1330 to couple the trim 1300 to the sidewall 1102 of the housing 1100*a* in the cavity 1101. The coupling member 1330 may be various coupling mechanisms including, but not limited to a friction clip, a spring clip, and a snap fit connector. For example, FIG. 1C shows an exemplary trim 1300 where the coupling member 1330 is a friction clip.

In some implementations, the trim 1300 may be rotatably adjustable relative to the light module 1200 and the housing 1100*a*. For example, the twist and lock connector 1222 of the module housing 1210 may include a flat ridge that extends around a portion of the flange 1220 such that the tab 1340 of the trim 1300 may be supported at any position along the ridge. In this manner, the orientation of the trim 1300 may be adjusted to meet user preferences. For example, the trim 1300 may have a square-shaped flange 1320, thus rotating the trim 1300 may allow the recessed lighting system 1000*a* to adhere to a desired aesthetic in the environment or to match the orientation of another recessed lighting system 1000*a* in the environment. In another example, the trim 1300 may be configured for wall washing (e.g., lighting a flat wall), thus rotatable adjustment of the trim 1300 may allow a user to illuminate a particular portion of the wall or an object as desired. Once the desired orientation of the trim 1300 is set, the trim 1300 may be inserted and secured to the housing 1100*a* (along with the light module 1200 and the yoke 1400*a*) by the coupling member 1330 to maintain the orientation.

The trim 1300 may be formed from various metals and polymers including, but not limited to aluminum, steel, stainless steel, copper, polyvinyl chloride (PVC), acrylonitrile butadiene styrene (ABS), polycarbonate (PC), polyurethane (PU), polyethylene, polyethylene terephthalate, polypropylene, polystyrene, a Makrolon® polycarbonate, and a Therma-Tech™ thermally conductive compound.

A Second Example of a Recessed Lighting System with a Yoke

Figure 4:
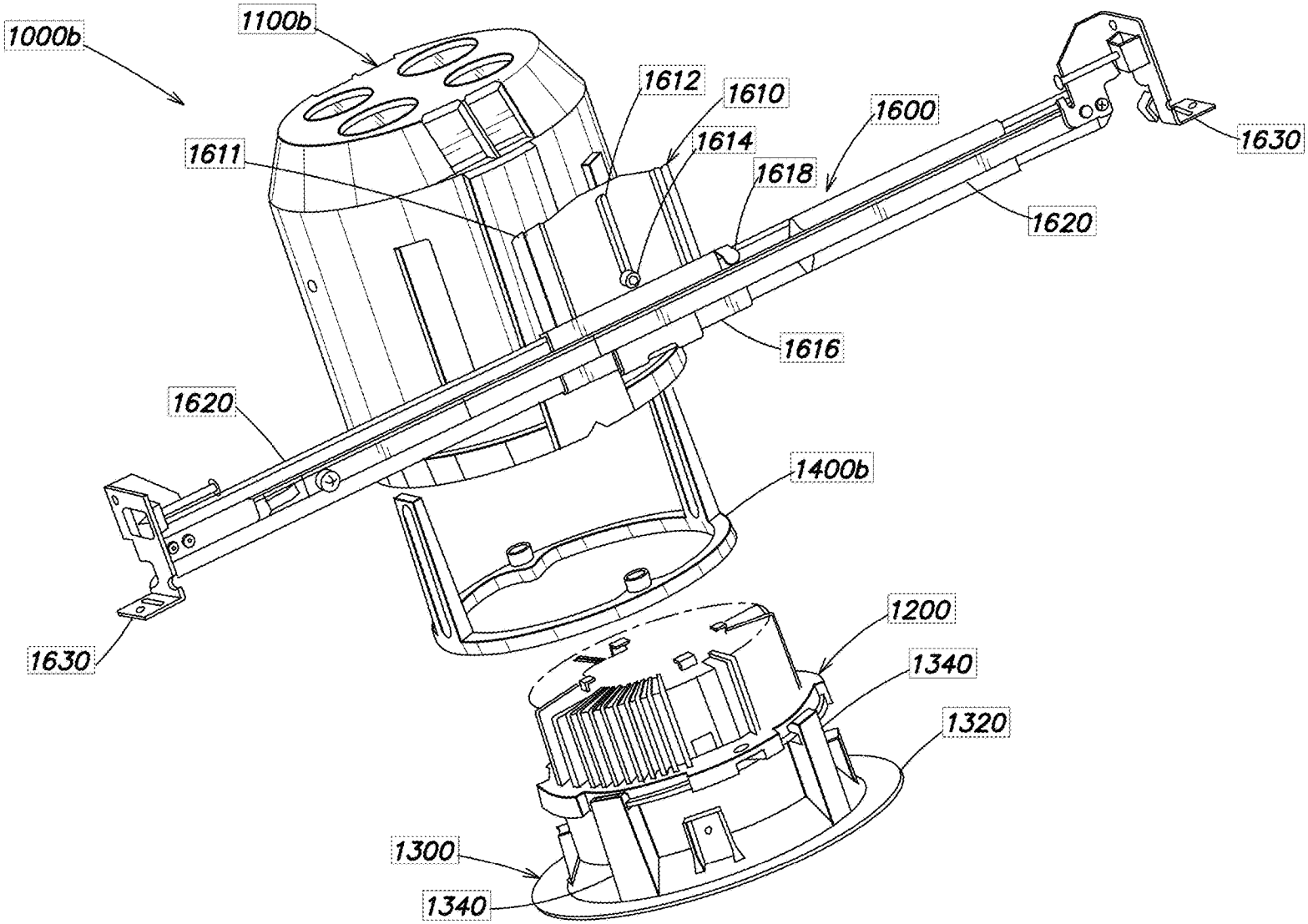
FIG. 4 shows an exploded view of another exemplary lighting fixture.

FIG. 4 shows another exemplary implementation of a recessed lighting system 1000*b* with a yoke 1400*b*. As before, the recessed lighting system 1000*b* may include a housing 1100*b* to cover and support the various components of the recessed lighting system 1000*b*. For instance, a yoke 1400*b* may be inserted into the cavity 1101 of the housing 1100*b*. The yoke 1400*b* may be used to facilitate the installation of a light module 1200. A trim 1300 may also be mounted to the light module 1200. The trim 1300 may further include a coupling member 1330 to secure the assembly of the yoke 1400*b*, the light module 1200, and the trim 1300 to the housing 1100*b*. FIG. 4 also shows a hanger bar assembly 1600 may be mounted to the sidewall 1102 of the housing 1100*b* for installation onto a building structure (e.g., a T-bar, a joist, a stud).

A method of installing the recessed lighting system 1000*b* depicted in FIG. 4 may be substantially similar to the method described above for the recessed lighting system 1000*a*. The various components of the recessed lighting system 1000*b* shown in FIG. 4, in particular the housing 1100*b* and the yoke 1400*b*, may include additional structural features to further improve the ease of installing the recessed lighting system 1000*b*.

FIGS. 5A-5F show several views of the housing 1100*b*. The housing 1100*b* may generally include the same features as described above and below with respect to the other exemplary recessed lighting systems 1000. Additionally, the housing 1100*b* may also include a guide 1160 disposed on the sidewall of the housing 1100*b*. The guide 1160 may be used to facilitate the alignment and adjustment of a hanger bar holder 1610 in the hanger bar assembly 1600. For example, the guide 1160 may be a protrusion from the sidewall 1102 that abuts against a portion of the hanger bar holder 1610, thus constraining the motion of the hanger bar assembly 1600 along a preferred adjustment axis between the hanger bar holder 1610 and the housing 1100*b*. For example, the position of the hanger bar holder 1610 along the length of the sidewall 1102 may be adjustable. Thus, the guide 1160 may limit the lateral movement of the hanger bar holder 1610.

The housing 1100*b* may generally include one or more guides 1160. For example, FIGS. 5A-5F show the housing 1100*b* includes two pairs of guides 1160. Each pair of guides 1160*a* and 1160*b* may be used on opposing sides of the hanger bar holder 1610. The guide 1160 may generally span a portion of the sidewall 1102 (e.g., from the cover 1120 to the opening 1103). In some implementations, the guide 1160 may also be segmented to reduce the amount of material used during fabrication of the housing 1100*b*.

Figure 5A:
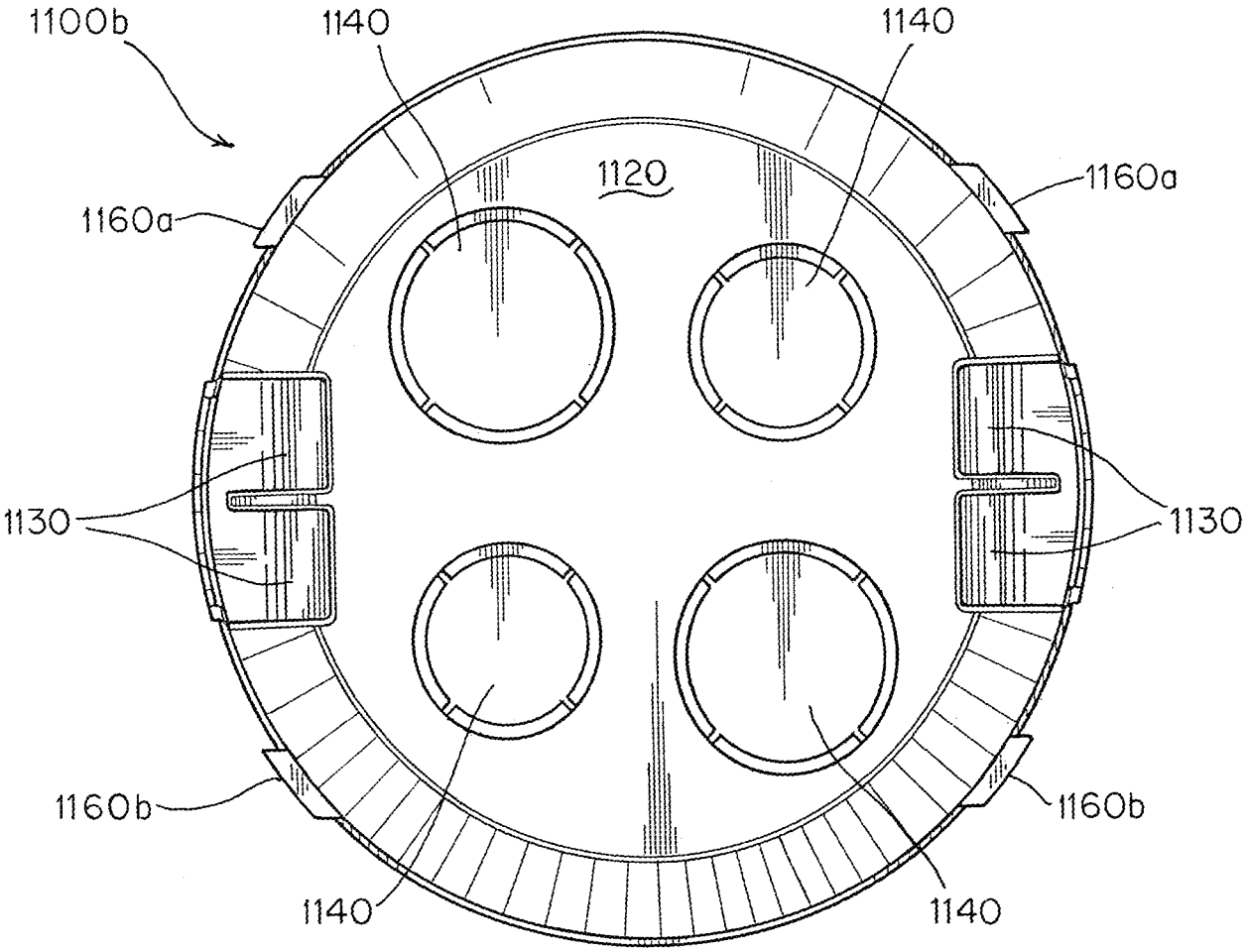
FIG. 5A shows a top view of a junction box in the lighting fixture of FIG. 4.
Figure 5B:
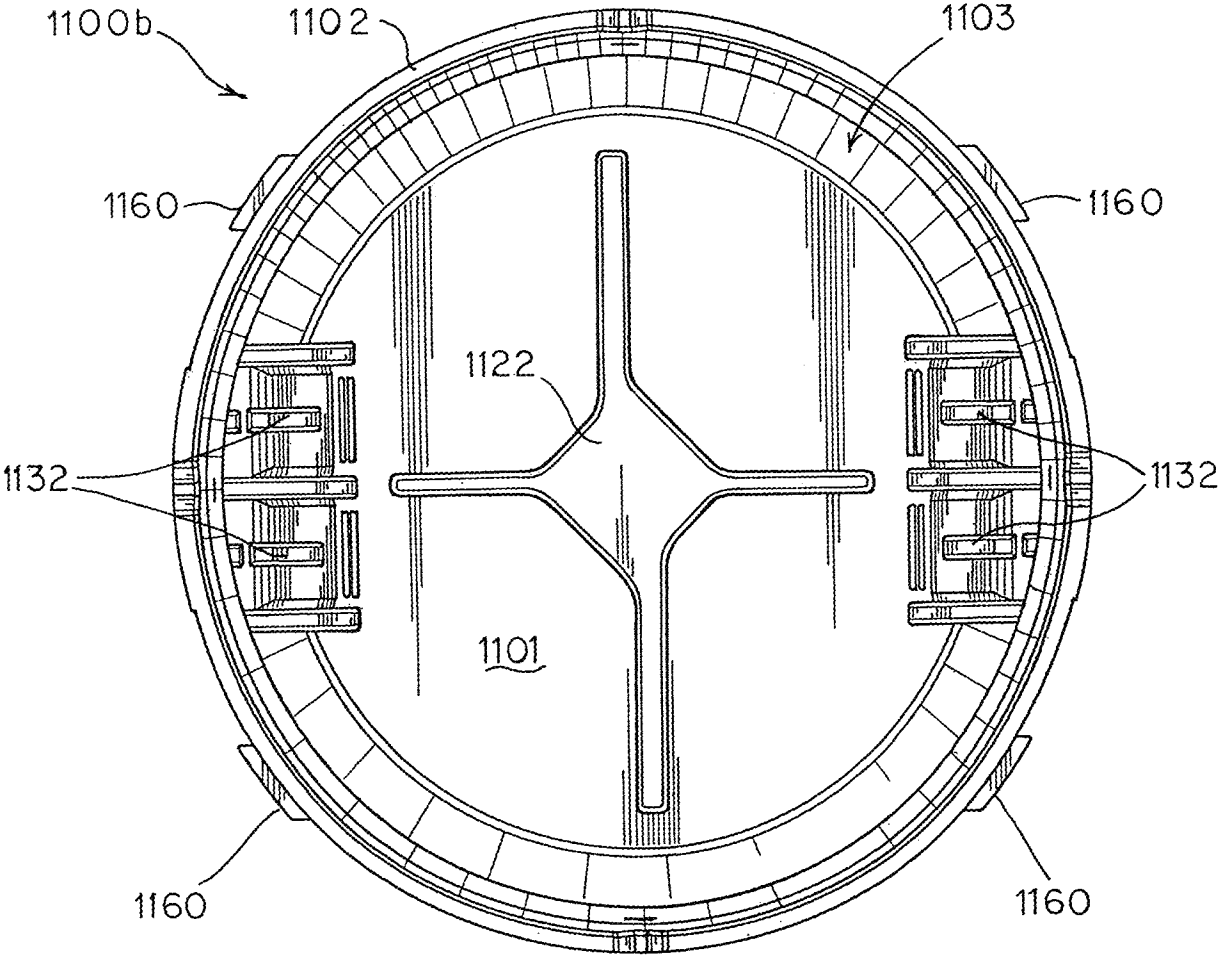
FIG. 5B shows a bottom view of the junction box of FIG. 5A.
Figure 5C:
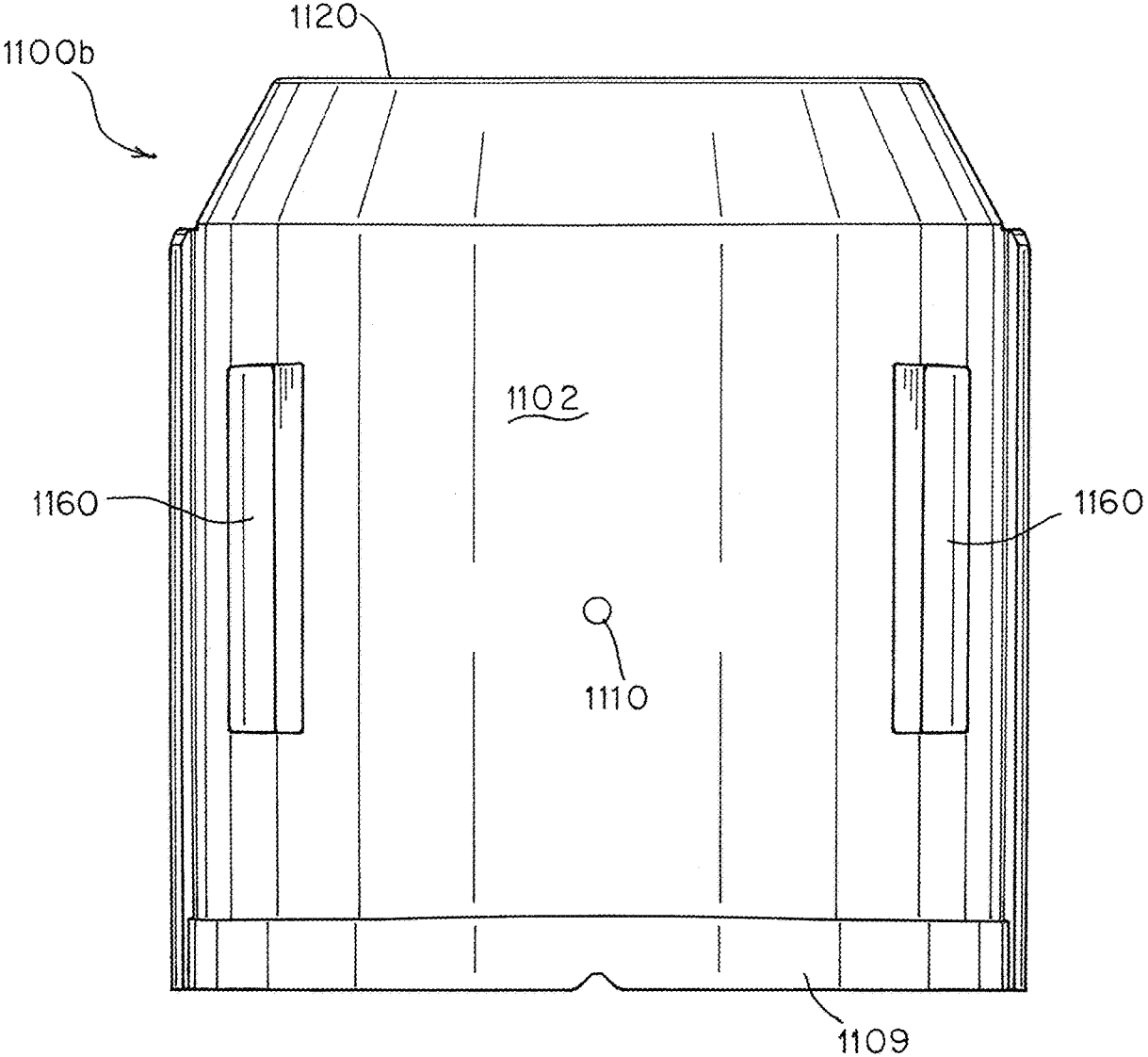
FIG. 5C shows a right-side view of the junction box of FIG. 5A, the left-side view being identical.
Figure 5D:
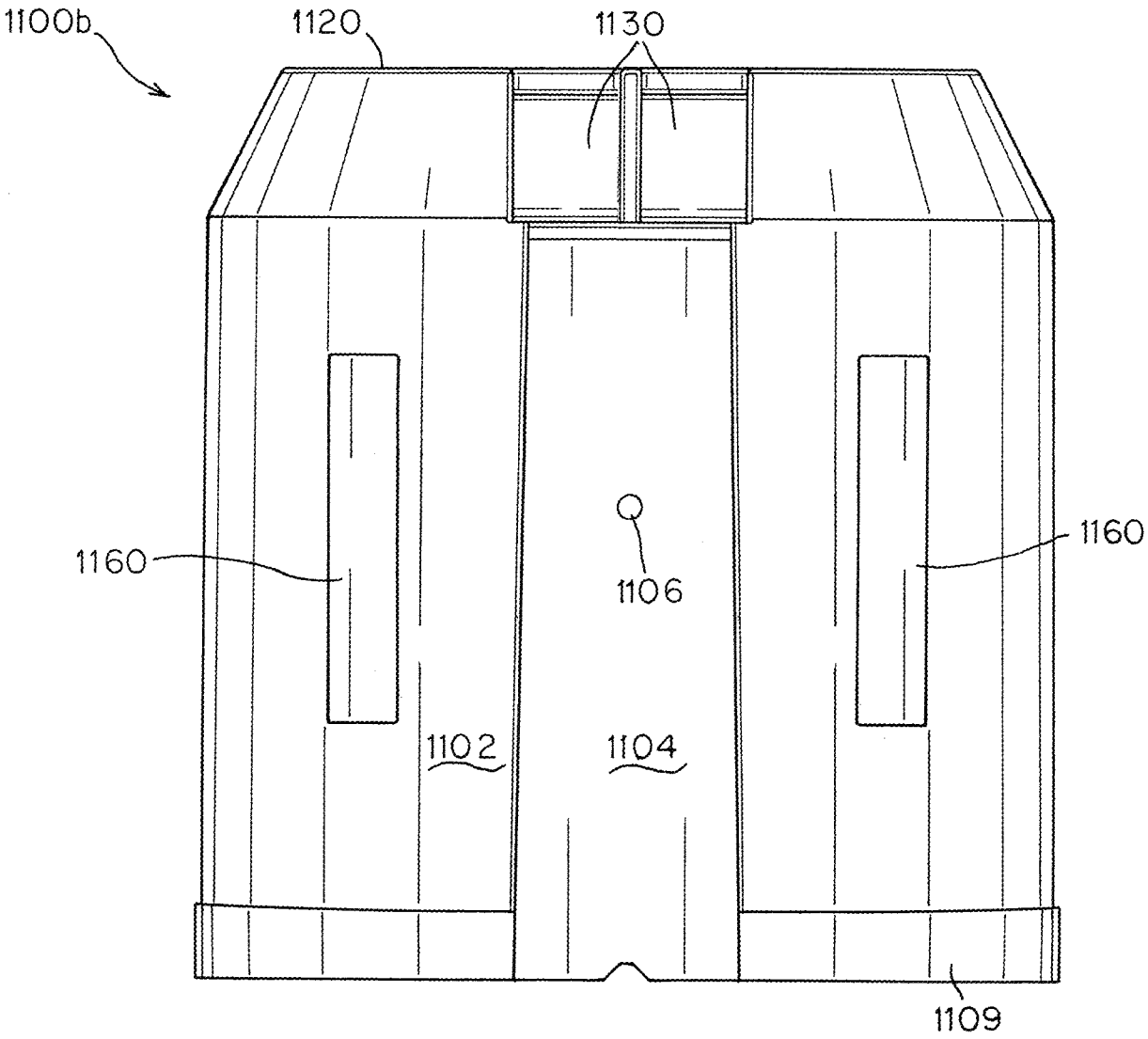
FIG. 5D shows a front-side view of the junction box of FIG. 5A, the rear-side view being identical.
Figure 5E:
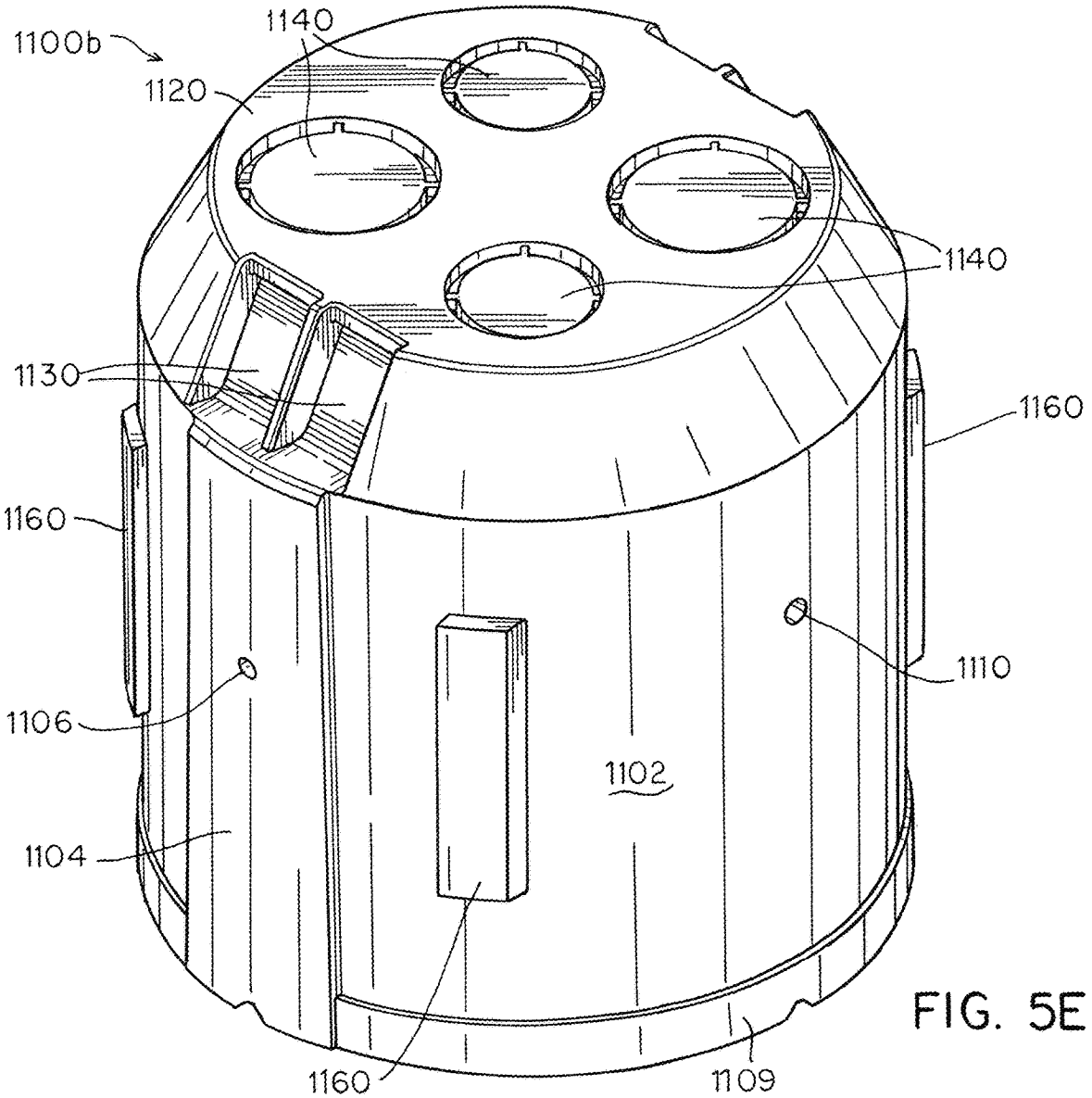
FIG. 5E shows a top, front perspective view of the junction box of FIG. 5A.
Figure 5F:
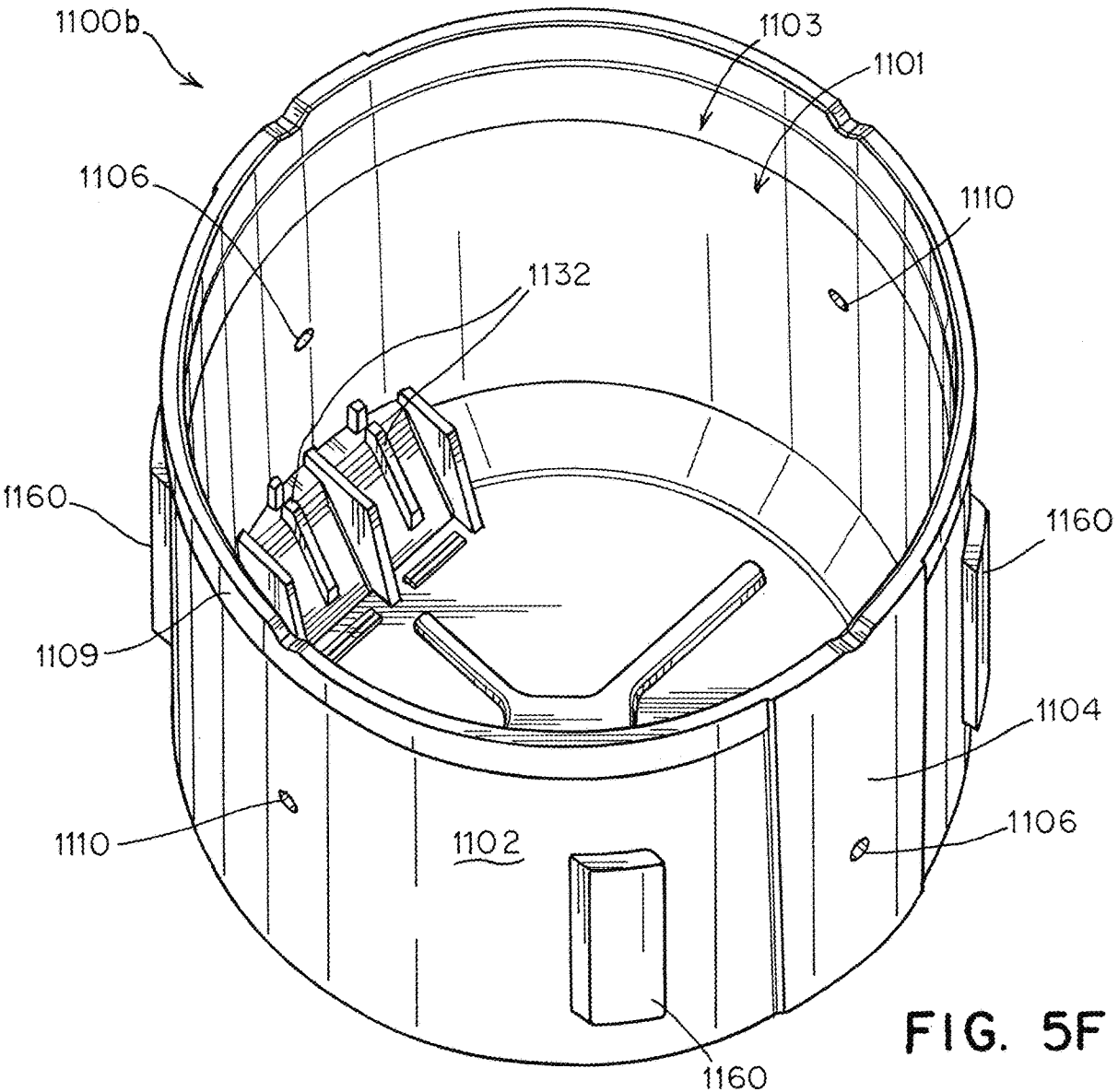
FIG. 5F shows a bottom, front perspective view of the junction box of FIG. 5A.

The housing 1100*b* may also include a reinforcing section 1122 on the cover 1120. As shown in FIGS. 5B and 5F, the reinforcing section 1122 may be a protrusion that extends into the cavity 1101 of the housing 1100*b*. The reinforcing section 1122 may be used to increase the structural rigidity of the housing 1100*b*, especially if one or more knockouts 1140 are removed during installation. As shown, the reinforcing section 1122 may partially surround the respective knockouts 1140 on the cover 1120 for this purpose.

The housing 1100*b* may also include knockouts 1140 and feedthrough tabs 1130 to facilitate entry of a wire/cable into the cavity 1101 of the housing 1100*b* as described above.

The feedthrough tab 1130 on the housing 1100*b* may include mechanical stops 1132 as shown in FIGS. 5B and 5F. The mechanical stops 1132 may be used to limit how far the feedthrough tab 1130 is bent into the cavity 1101 of the housing 1100*b*. For example, the mechanical stops 1132 depicted in FIGS. 5B and 5F include a first portion on the feedthrough tab 1130 and a second portion at the base of the feedthrough tab 1130. As the feedthrough tab 1130 is bent into the cavity 1101, the first portion may physically contact the second portion thus preventing the feedthrough tab 1130 from being bent further inwards.

As before, the housing 1100*b* may be formed from various thermoplastic and thermosetting polymers including, but not limited to polyvinyl chloride (PVC), acrylonitrile butadiene styrene (ABS), polycarbonate (PC), polyurethane (PU), polyethylene, polyethylene terephthalate, polypropylene, and polystyrene. The housing 1100*b* may be fabricated using various manufacturing methods including, but not limited to injection molding, 3D printing, and blow molding.

Figure 6A:
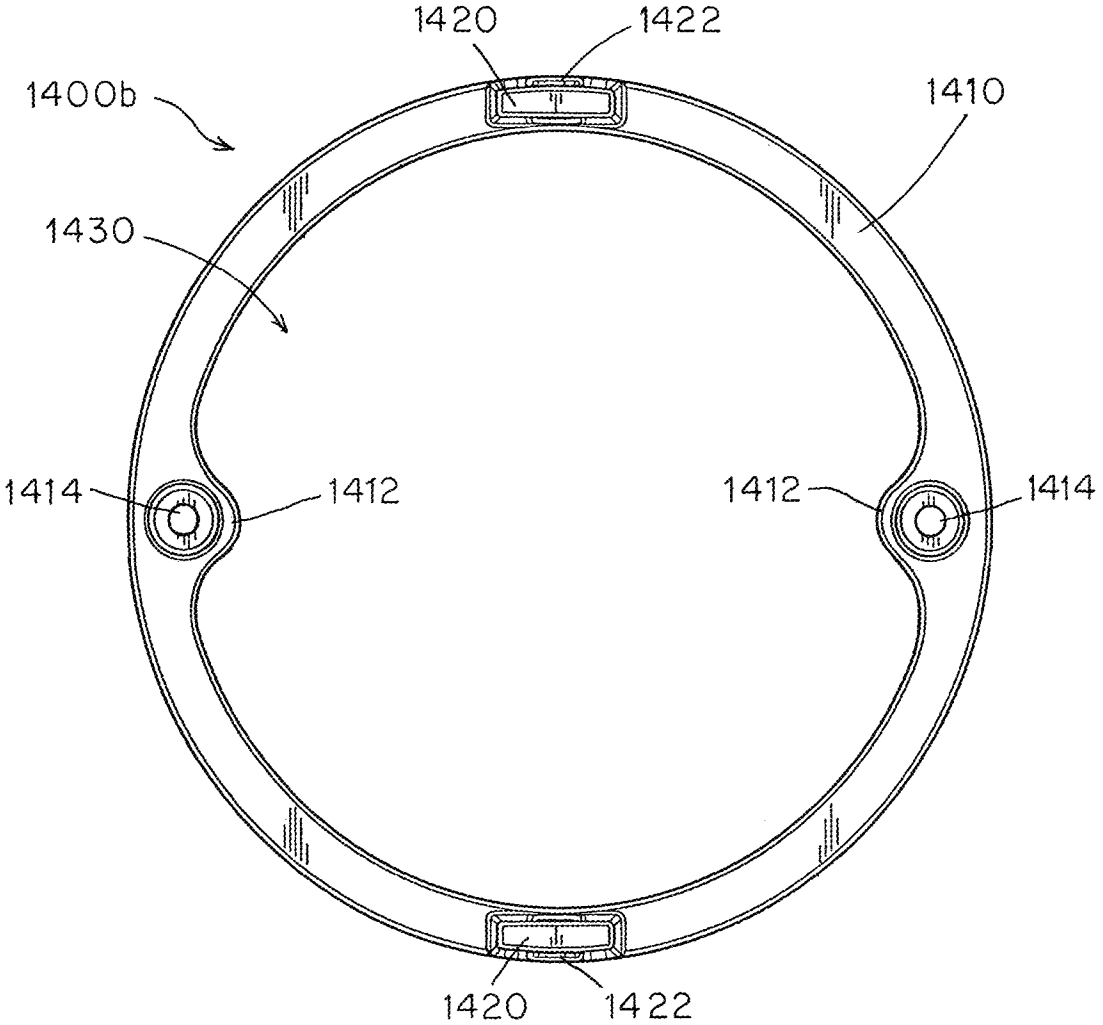
FIG. 6A shows a top view of a yoke in the lighting fixture of FIG. 4.
Figure 6B:
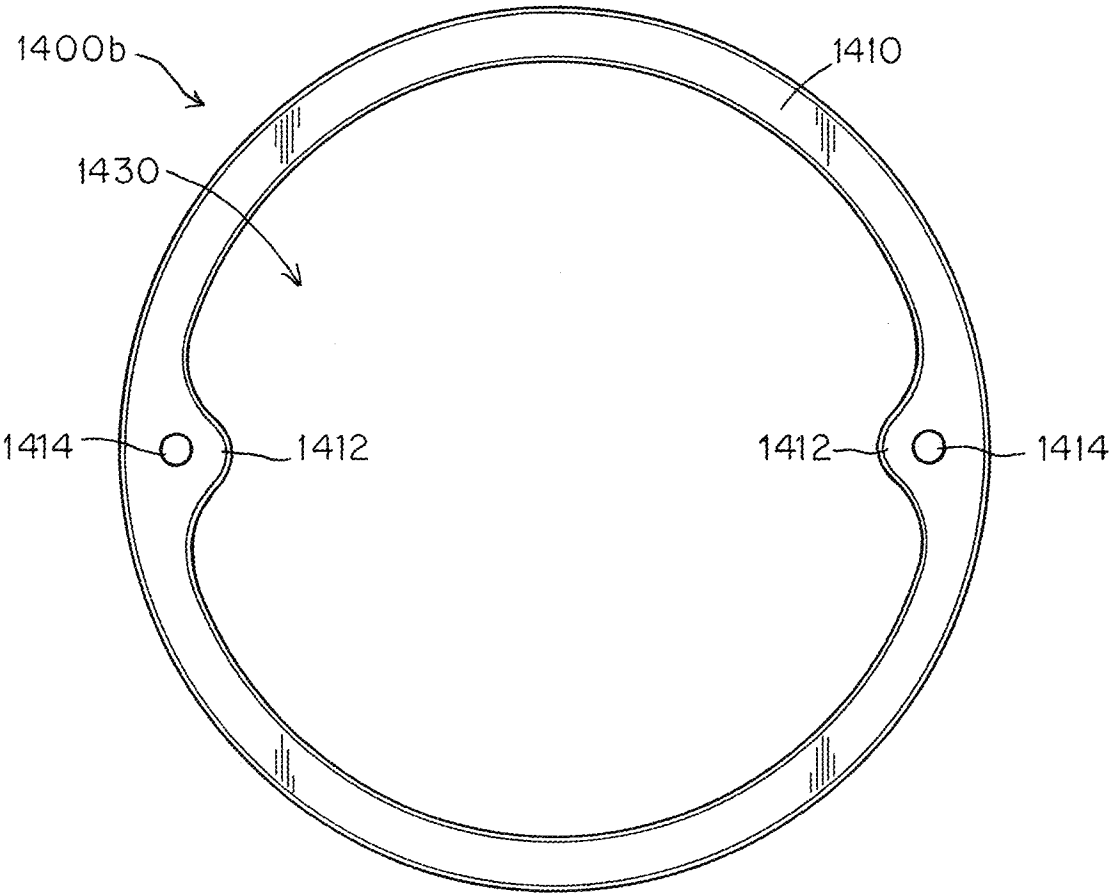
FIG. 6B shows a bottom view of the yoke in FIG. 6A.
Figure 6C:
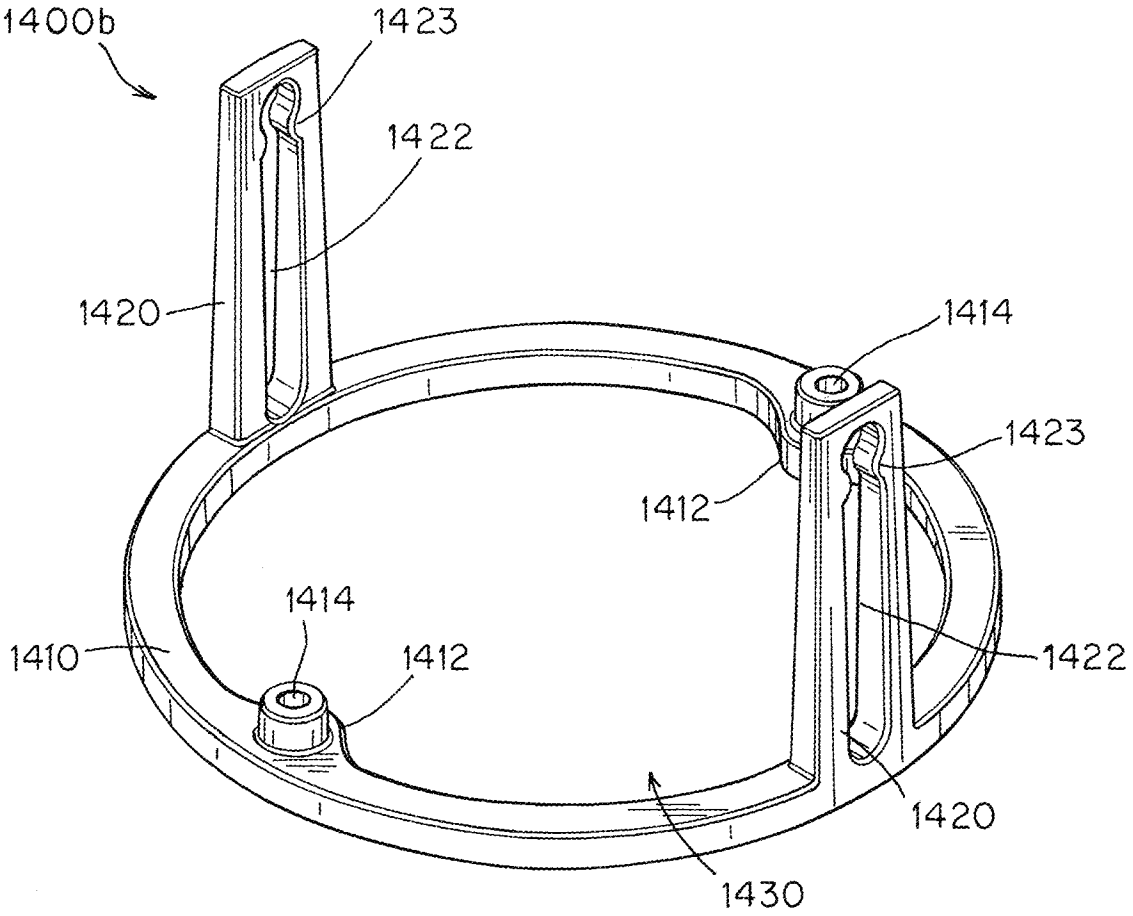
FIG. 6C shows a top, front perspective view of the yoke in FIG. 6A.

FIGS. 6A-6C show several views of the yoke 1400*b*. The yoke 1400*b* may include the same features as the yoke 1400*a* described above with respect to the other exemplary recessed lighting fixtures 1000. As shown in FIG. 6C, the openings 1414 of the yoke 1400*b* may include an extended section that protrudes from the frame 1410. This section may be used to increase the length of the opening 1414 in order to support a longer fastener. In some implementations, the opening 1414 may be threaded, thus the extended section may provide additional threads to engage with a fastener to better secure the light module 1200 to the yoke 1400*b*.

The arm 1420 of the yoke 1400*b* may include a slot 1422, as described above, to allow slidable adjustment of the yoke 1400*b* along an axis defined by the slot 1422. The slot 1422 may generally have a non-uniform width. For example, FIGS. 6A-6C show the slot 1422 having a choke 1423 (e.g., a section with a narrower width). If the width of the slot 1422 is based on the size of the coupling member used to couple and guide the yoke 1400*b* to the housing 1100*b*, the choke 1423 may be used to define a separate section of the slot 1422 where the yoke 1400*b* may be rigidly fixed to the coupling member, thus preventing the yoke 1400*b* from sliding relative to the housing 1100*b*. For the arm 1420 depicted in FIG. 6C, a user may pull the yoke 1400*b* out of the housing 1100*b* such that the coupling member is forced past the choke 1423, thus rigidly securing the yoke 1400*b* to the housing 1100*b*. This may allow a user to more easily mount the light module 1200 to the yoke 1400*b* by preventing the yoke 1400*b* from sliding along the slot 1422 as the user is coupling a fastener through the openings 1224 of the module housing 1210 and the openings 1414 of the yoke 1400*b*. It should be appreciated the arm 1420 may be sufficiently compliant to allow the coupling member to move past the choke 1423 without causing plastic deformation.

Figure 7A:
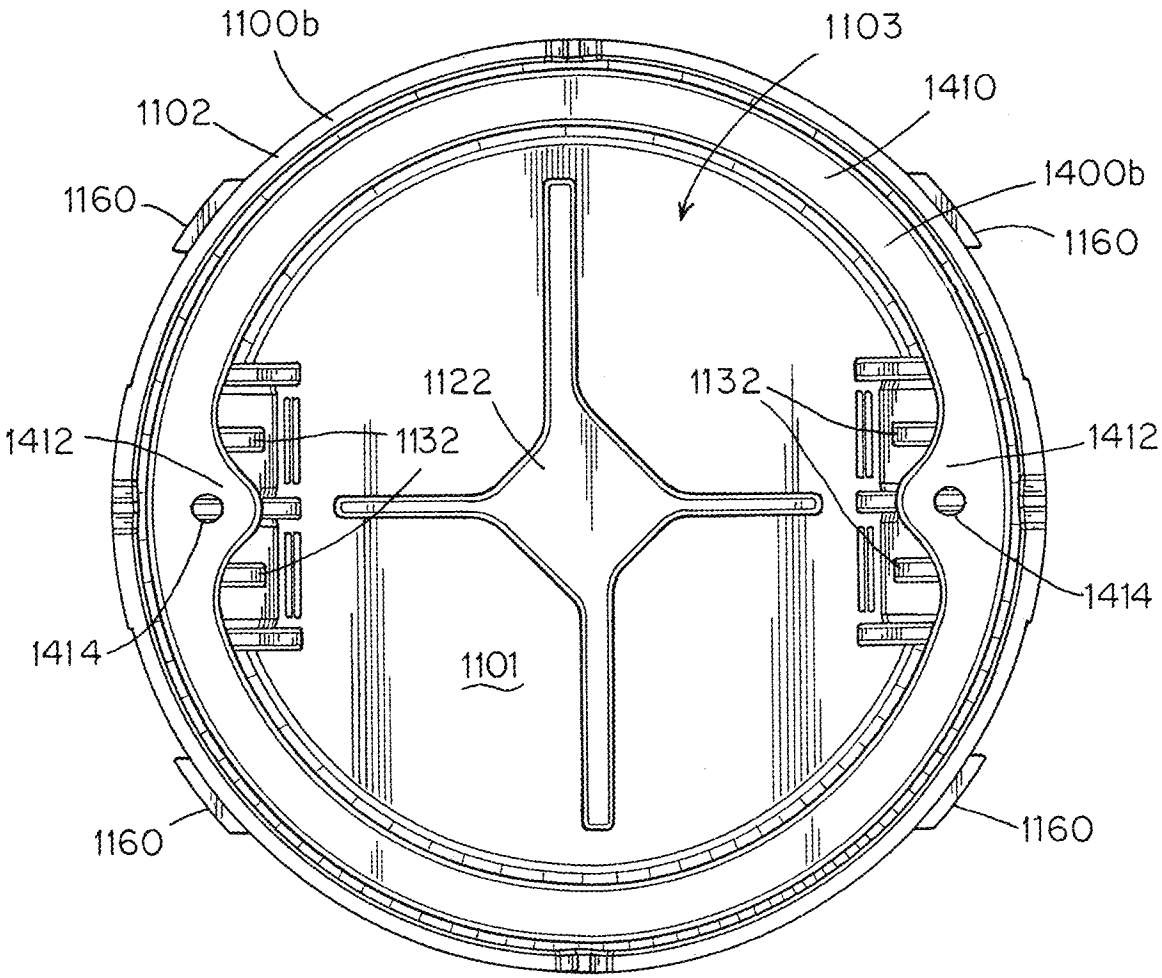
FIG. 7A shows a bottom view of the junction box of FIG. 5A with the yoke of FIG. 6A inserted into the junction box.
Figure 7B:
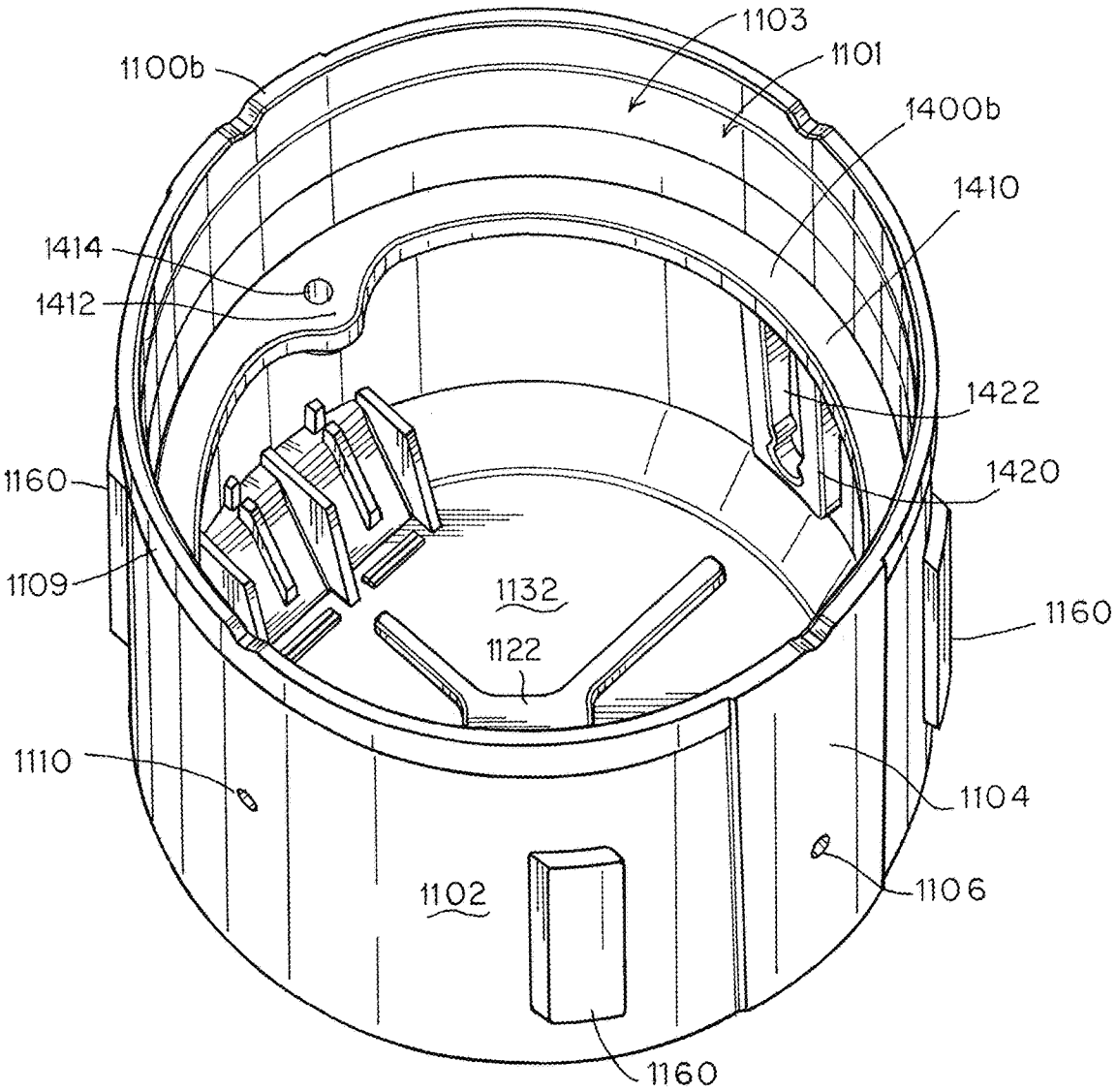
FIG. 7B shows a bottom, front perspective view of the junction box of FIG. 7A where the yoke is at a fully recessed position.
Figure 7C:
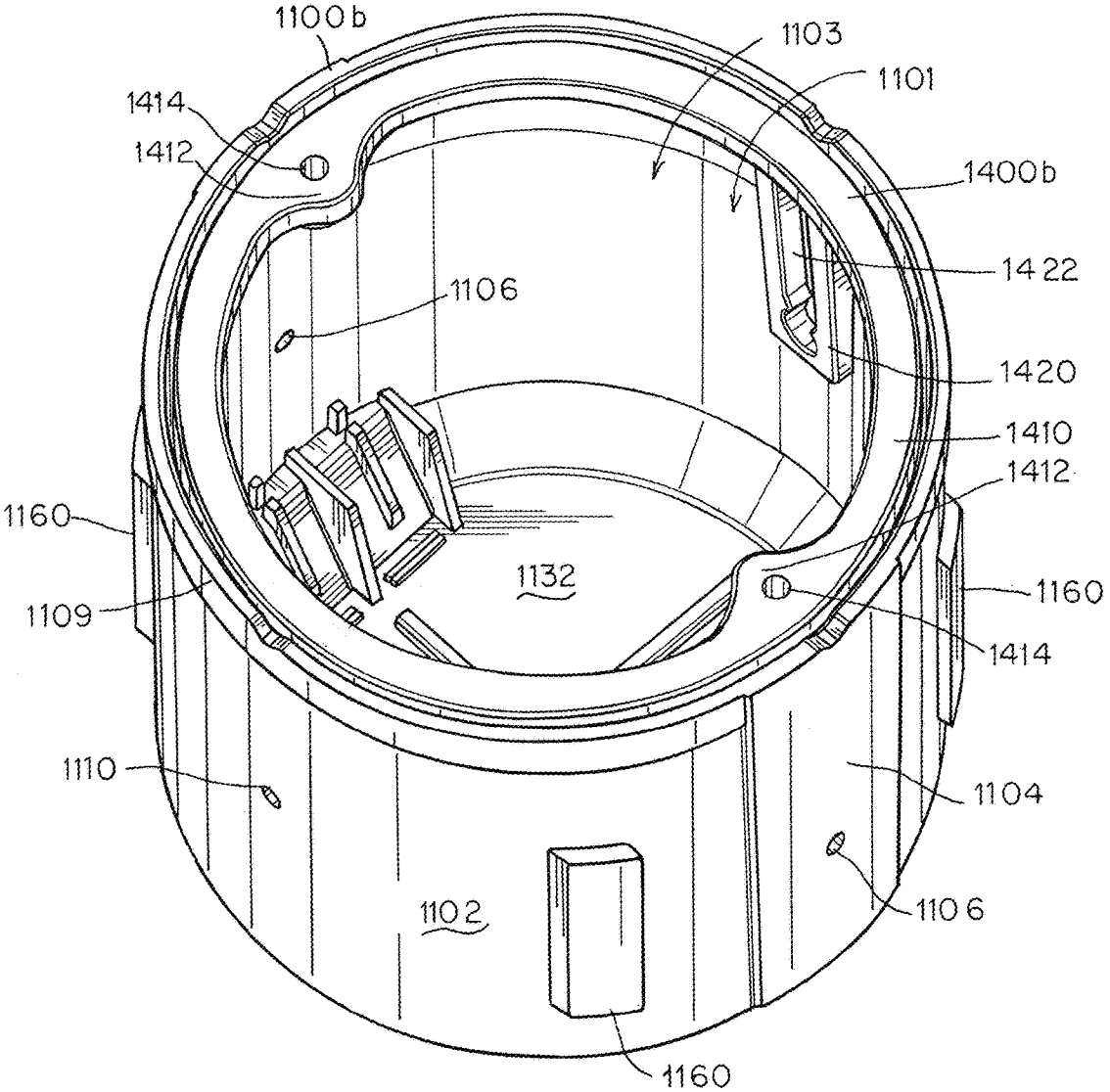
FIG. 7C shows a bottom, front perspective view of the junction box of FIG. 7A where the yoke is at a neutral position.

FIGS. 7A-7C show several views of the yoke 1400*b* disposed in the cavity 1101 of the housing 1100*b*. As before, the position and the length of the slot 1422 may define the positional limits of the yoke 1400*b* within the housing 1100*b*. FIG. 7B shows that at one limit, the arm 1420 of the yoke 1400*b* may be positioned proximate to the cover 1120 of the housing 1100*b* such that the light module 1200 is fully contained inside the cavity 1101 of the housing 1100*b*. FIG. 7C shows that at another limit, the frame 1410 of the yoke 1400*b* may abut the opening 1103 of the housing 1100*b*.

The hanger bar assembly 1600 shown in FIG. 4 may include a hanger bar holder 1610 to mount the hanger bar assembly 1600 to the housing 1100*b*, a hanger bar 1620 to adjust a position of the housing 1100*b* in the building structure, and a hanger bar head 1630 to mount the hanger bar assembly 1600 to the building structure (e.g., a T-bar, a joist, a stud). As shown, the hanger bar holder 1610 may include a frame 1611 that abuts against the sidewall 1102 of the housing 1100*b*. The frame 1611 may be shaped to fit between the guides 1160 on the sidewall housing 1100*b* thereby constraining and guiding the adjustment of the hanger bar holder 1610 along a desired adjustment axis while limiting unwanted motion along other axes.

The frame 1611 may include an adjustment feature that allows the position of the hanger bar assembly 1600 to be adjustable with respect to the housing 1100*b*. For example, FIG. 4 shows the adjustment feature as a slot 1612 where the hanger bar assembly 1600 is slidably adjustable along an axis defined by said slot 1612. The hanger bar holder 1610 may be coupled to the housing 1100*b* via a coupling member 1614 to the opening 1106 on the housing 1100*b*. The coupling member 1614 may be various coupling mechanisms including, but not limited to a screw fastener, a bolt fastener, a butterfly wing screw, and a thumbscrew.

The hanger bar holder 1610 may also include a track 1616 coupled to the frame 1611 to support and guide one or more hanger bars 1620. The track 1616 may constrain the hanger bars 1620 to move along an axis substantially orthogonal to the axis defined by the slot 1612, thus enabling the hanger bar assembly 1600 to be adjustable along multiple axes. In some implementations, the track 1616 may support two telescoping hanger bars 1620 in a manner that reduces unwanted lateral motion of the hanger bars 1620 along other axes orthogonal to the second axis. For example, the track 1616 may be shaped and/or tolerances such that the hanger bars 1620 are in contact with the track 1616, thus preventing the unwanted lateral motion (e.g., slop, backlash) between the hanger bars 1620 and the track 1616. The frame 1611 may also include a locking tab 1618 to secure the one or more hanger bars 1620 to a desired position during installation.

The hanger bar 1620 may be an elongated rail that is slidably adjustable along the track 1616 of the hanger bar holder 1610. In some implementations, the hanger bar 1620 may have a substantially uniform cross-sectional shape along the length of the hanger bar 1620. The cross-sectional shape may be configured to allow the hanger bar 1620 to be telescopically adjustable with respect to another hanger bar 1620. The cross-sectional shape of the hanger bar 1620 may also be configured to reduce unwanted lateral motion between adjoining hanger bars 1620. For example, the cross-sectional shape of the hanger bar 1620 may ensure the hanger bar 1620 maintains physical contact with another hanger bar 1620, thus limiting any unwanted backlash or slop between the hanger bars 1620. In some implementations, the pair of hanger bars 1620 supported by the hanger bar holder 1610 may be substantially identical to simplify manufacture.

The hanger bar head 1630 may be disposed at one end of the hanger bar 1620. The hanger bar head 1630 may include multiple features to facilitate attachment to various building structures including, but not limited to a T-bar, a joist, and a stud. The hanger bar head 1630 may couple to the building structure using various coupling mechanisms including, but not limited to a screw fastener, a bolt fastener, a snap fit connector, and an adhesive.

A First Example of a Recessed Lighting System with a Partition Plate

Figure 8A:
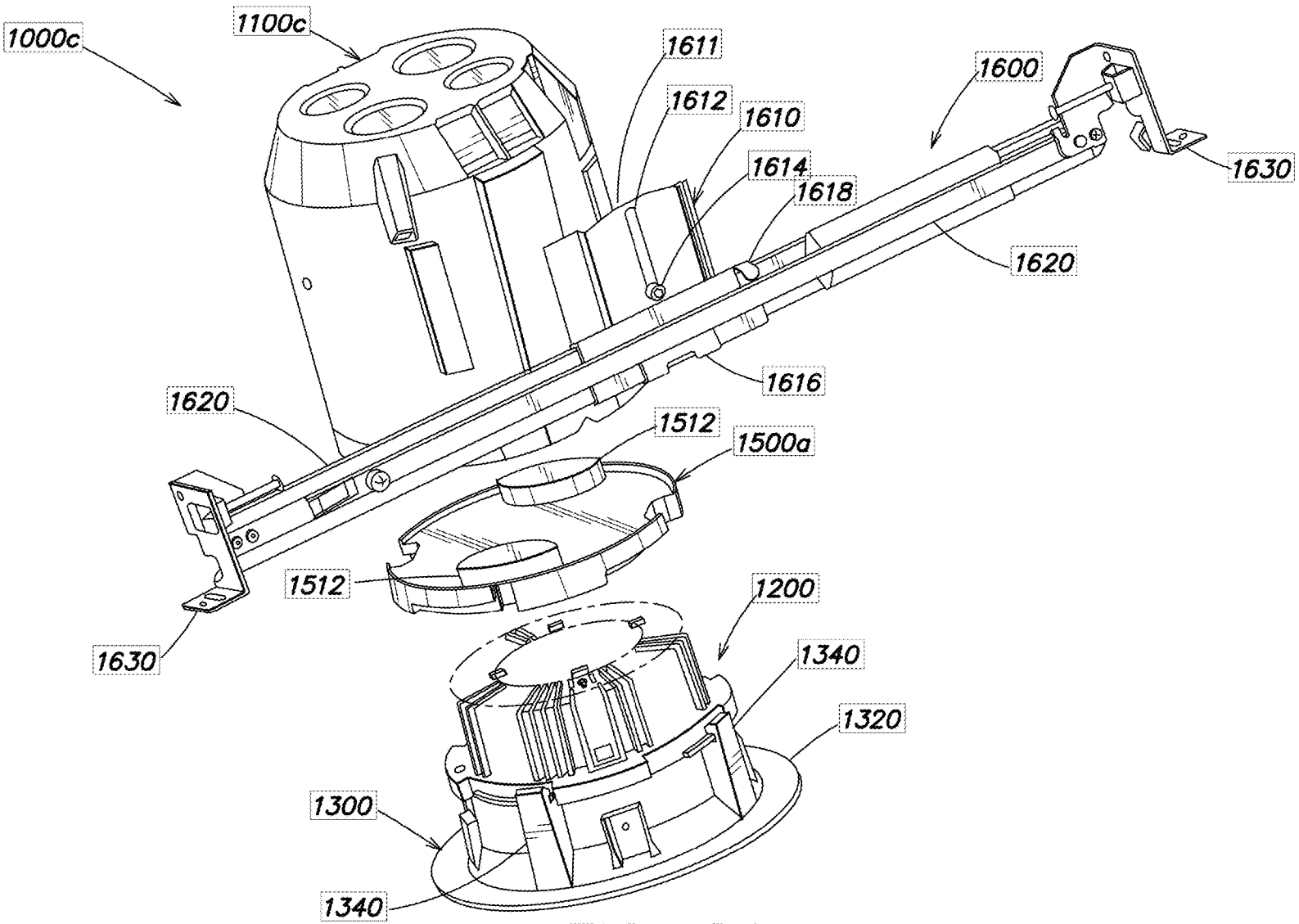
FIG. 8A shows an exploded view of another exemplary lighting fixture.
Figure 8B:
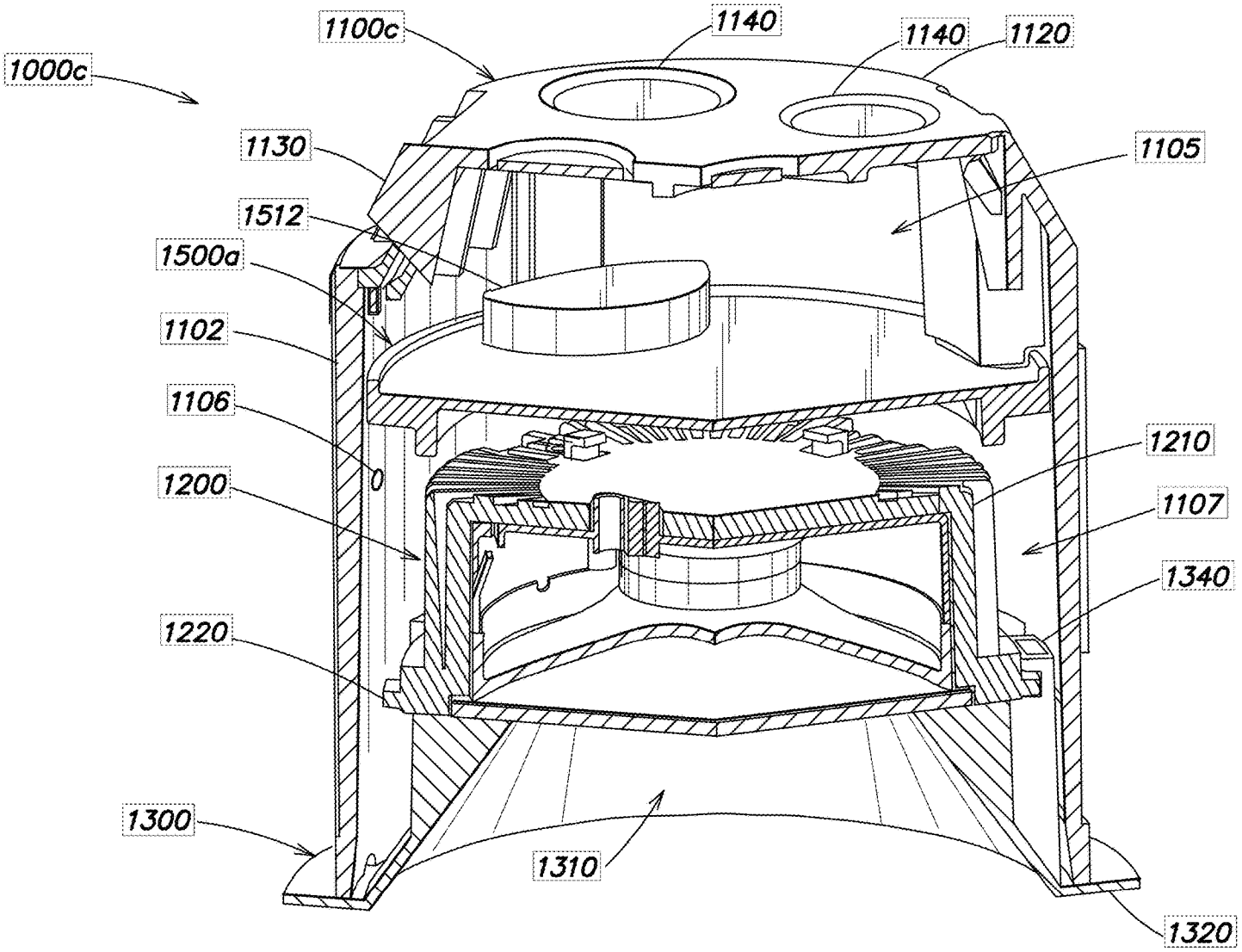
FIG. 8B shows a cross-sectional right perspective view of the lighting fixture of FIG. 8A where the lighting fixture is assembled.

FIGS. 8A and 8B show several views of an exemplary recessed lighting system 1000*c* with a partition plate 1500*a*.

As shown, the recessed lighting system 1000*c* may include a housing 1100*c*. The partition plate 1500*a* may be inserted into the cavity 1101 of the housing 1100*c* and secured to the sidewall 1102 to divide the cavity 1101 into a wiring compartment 1105 and a lighting compartment 1107. Once the partition plate 1500*a* is secured to the housing 1100*c*, a light module 1200 and a trim 1300 may be inserted into the lighting compartment 1107 and secured by a coupling member on the trim 1300. As before, a hanger bar assembly 1600 may be coupled to the sidewall 1102 of the housing 1100*c* to facilitate installation of the recessed lighting system 1000*c* onto a building structure.

The partition plate 1500*a* may be used to improve the ease of installing the light module 1200 and the trim 1300 by pushing the wires/cables disposed in the housing 1100*c* back, thus reducing their interference and/or obstruction of the housing 1100*c* when mounting the light module 1200 and the trim 1300. As shown in FIG. 8B, the partition plate 1500*a* and the light module 1200 may be positioned in the cavity 1101 of the housing 1100*c* such that a gap exists between the partition plate 1500*a* and the module housing 1210 of the light module 1200. In some implementations, the module housing 1210 or another portion of the light module 1200 may directly contact the partition plate 1500*a*. The partition plate 1500*a* may also be used to increase the structural rigidity of the housing 1100*c* by reinforcing the sidewall 1102. In this manner, the partition plate 1500*a* may also improve the thermal performance of the housing 1100*c* when the recessed lighting system 1000*c* is subjected to a fire.

Generally, a method of installing the recessed lighting system 1000*c* may include the following steps: (1) installing the housing 1100*c* into the building structure using the hanger bar assembly, (2) removing a knockout 1140 and/or opening a feedthrough tab 1130 to pass a wire or cable that supplies electrical power to the light module 1200 into the cavity 1101 of the housing 1100*c*, (3) configuring the wire/cable for connection (e.g., attaching a connector, connecting a ground wire to an electrical ground), (4) passing the wire/cable through a feedthrough openings 1514 and 1516 on the partition plate 1500*a*, (5) inserting and securing the partition plate 1500*a* to the cavity 1101 of the housing 1100*c*, (6) electrically coupling the light module 1200 to the wire/cable, (7) mounting the trim 1300 to the light module 1200, (8) inserting the light module 1200 and the trim 1300 into the lighting compartment 1107 of the housing 1100*c*. The trim 1300 may include a coupling mechanism, such as a friction spring clip, to secure the light module 1200 and the trim 1300 to the housing 1100*c*.

Figure 9A:
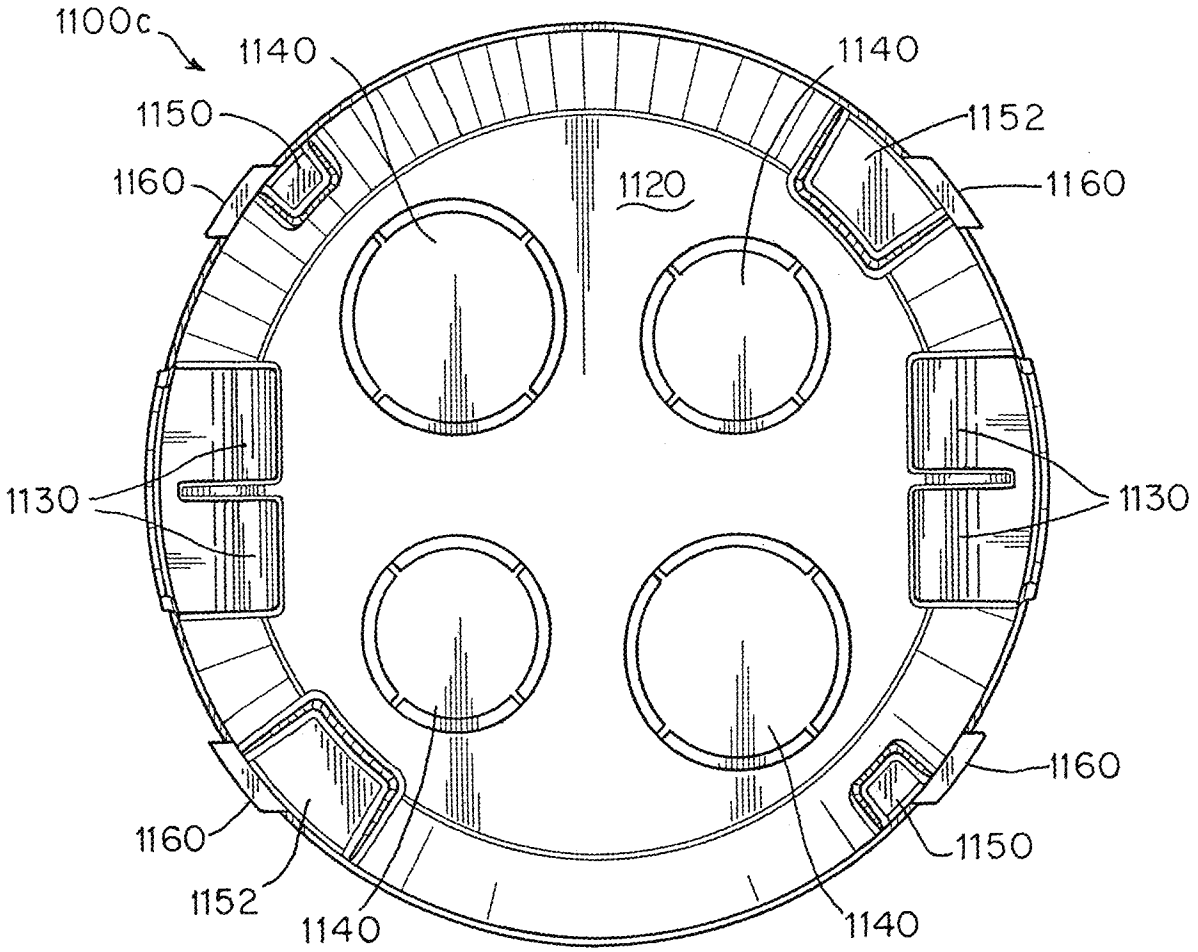
FIG. 9A shows a top view of a junction box in the lighting fixture of FIG. 8A.
Figure 9B:
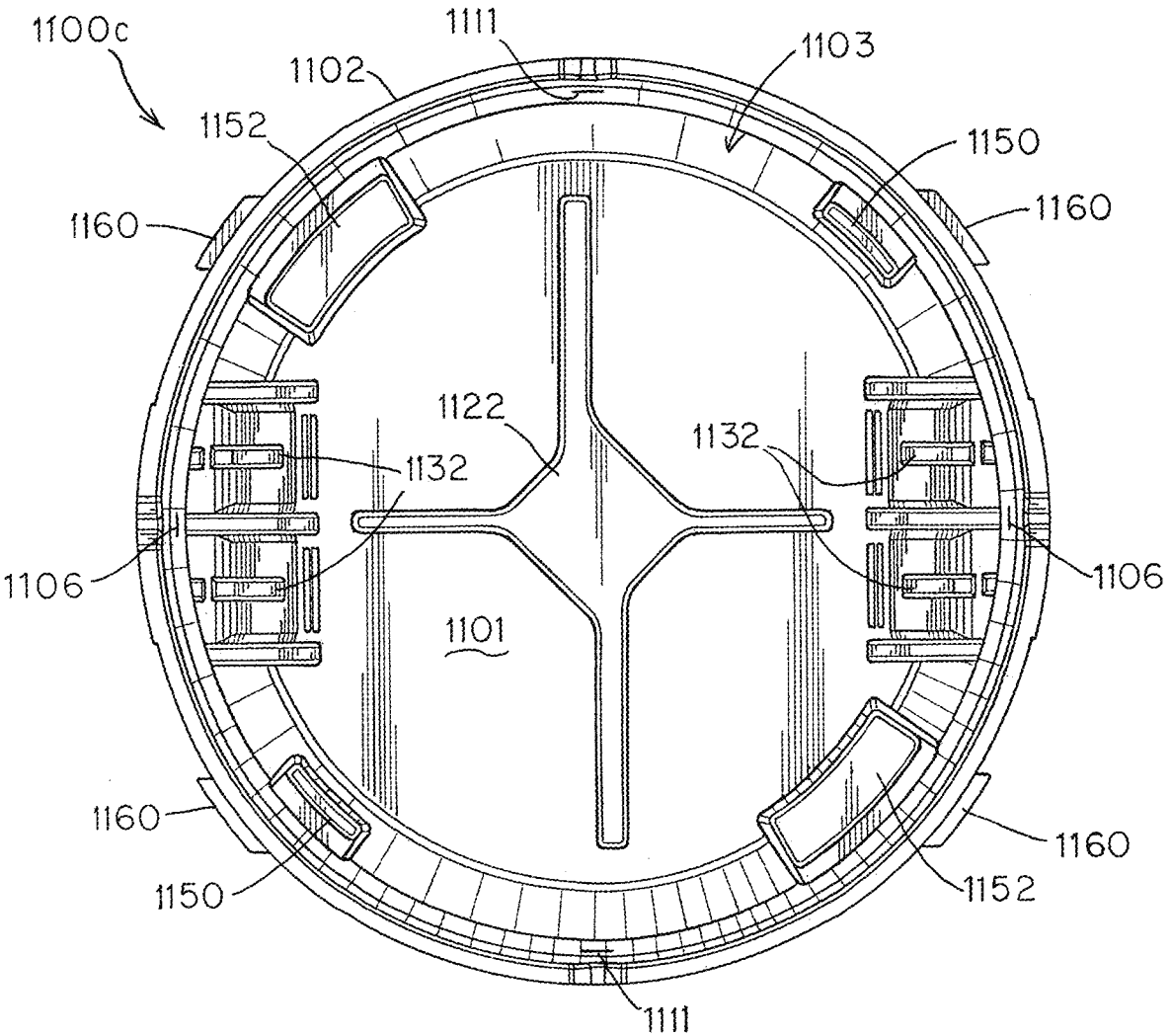
FIG. 9B shows a bottom view of the junction box of FIG. 9A.
Figure 9C:
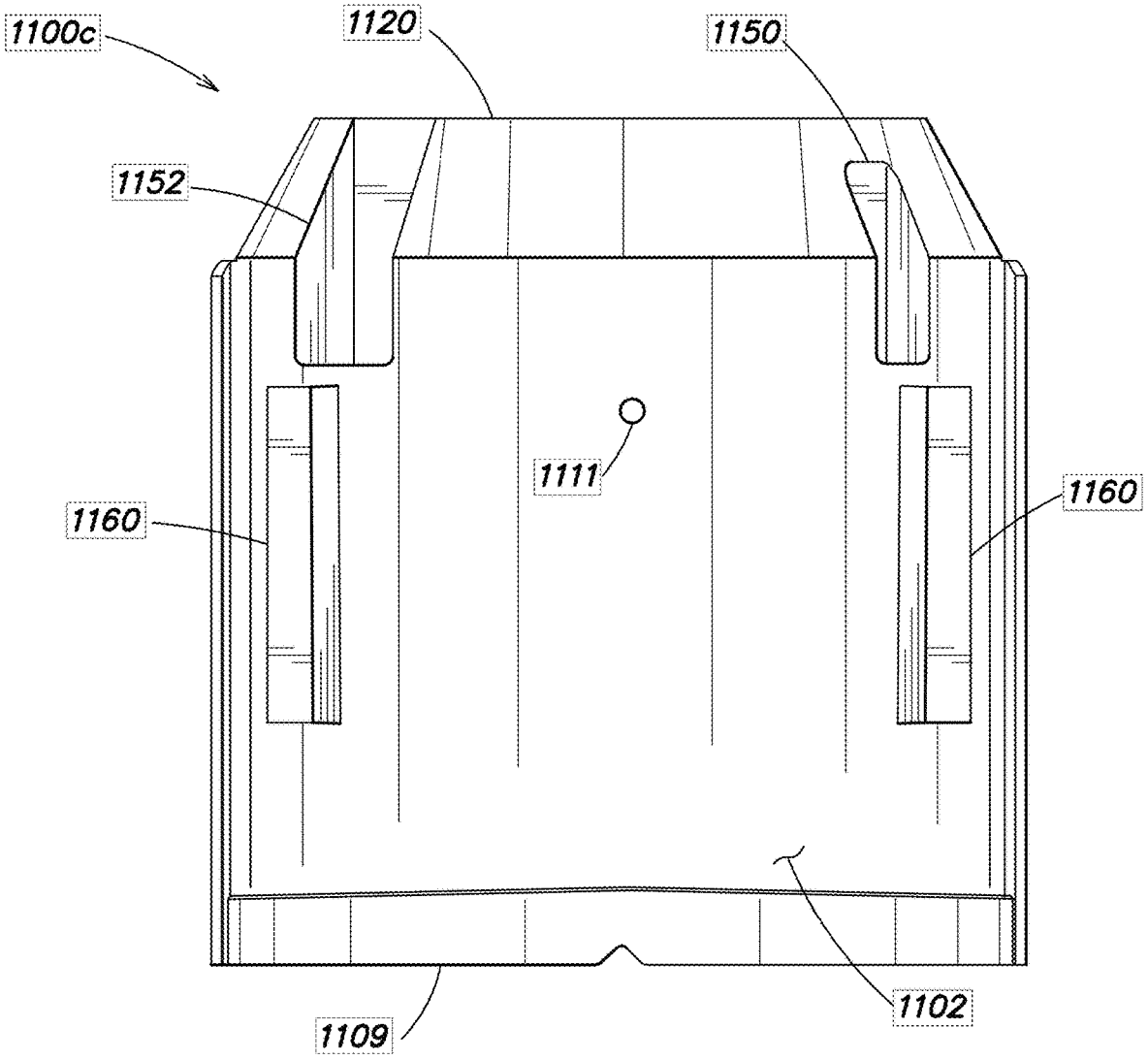
FIG. 9C shows a right-side view of the junction box of FIG. 9A, the left-side view being identical.
Figure 9D:
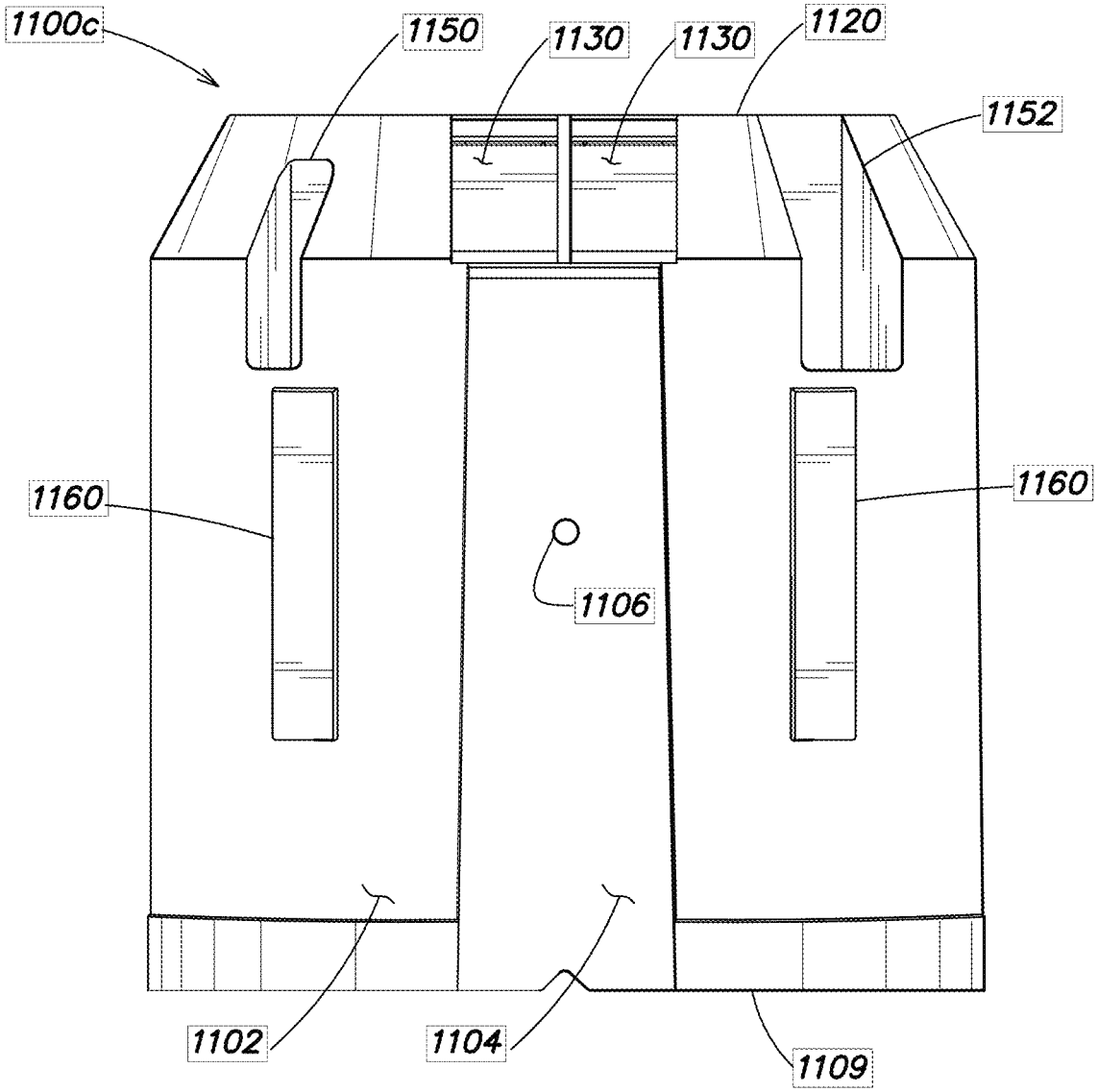
FIG. 9D shows a front-side view of the junction box of FIG. 9A, the rear-side view being identical.
Figure 9E:
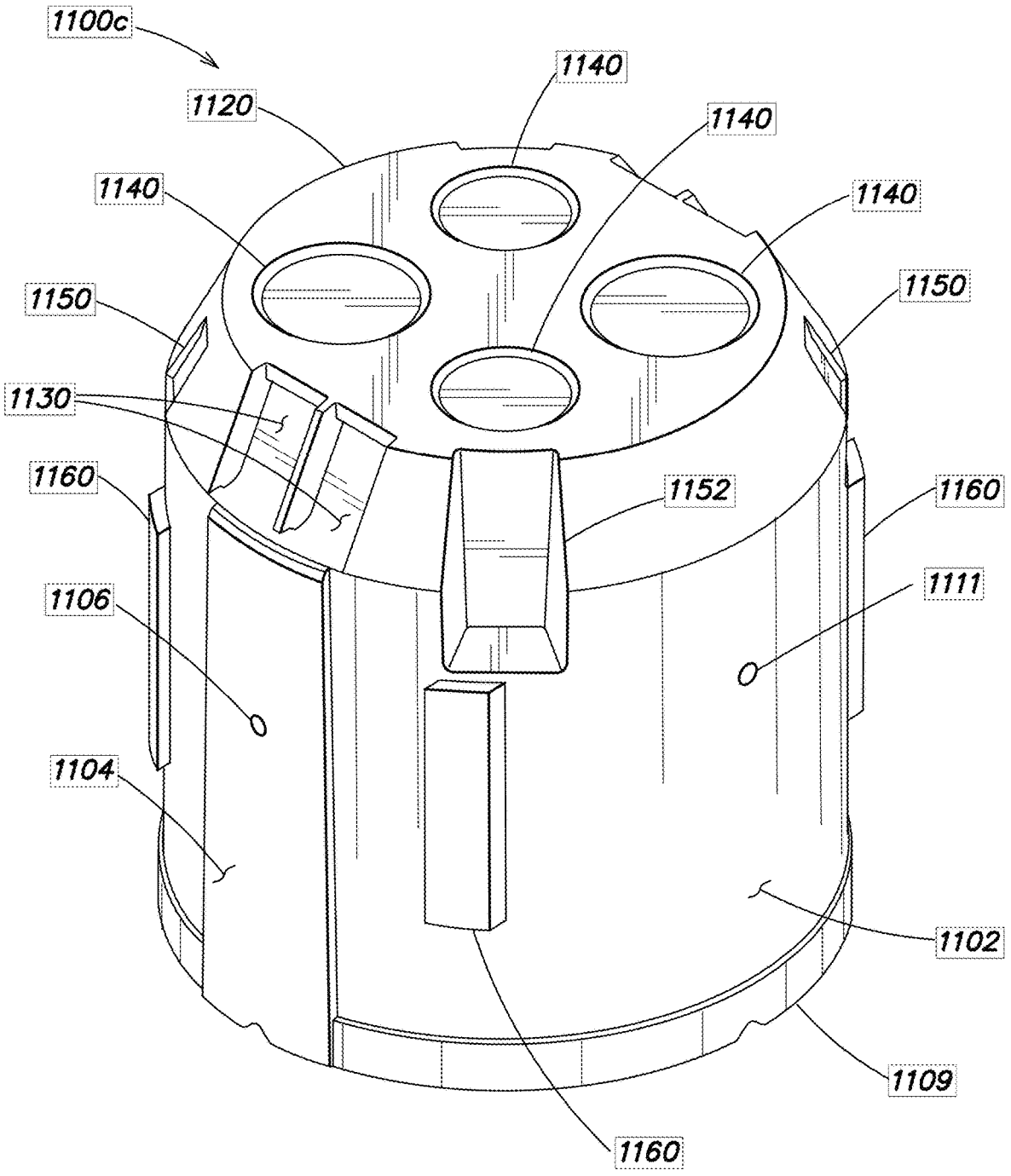
FIG. 9E shows a top, front perspective view of the junction box of FIG. 9A.
Figure 9F:
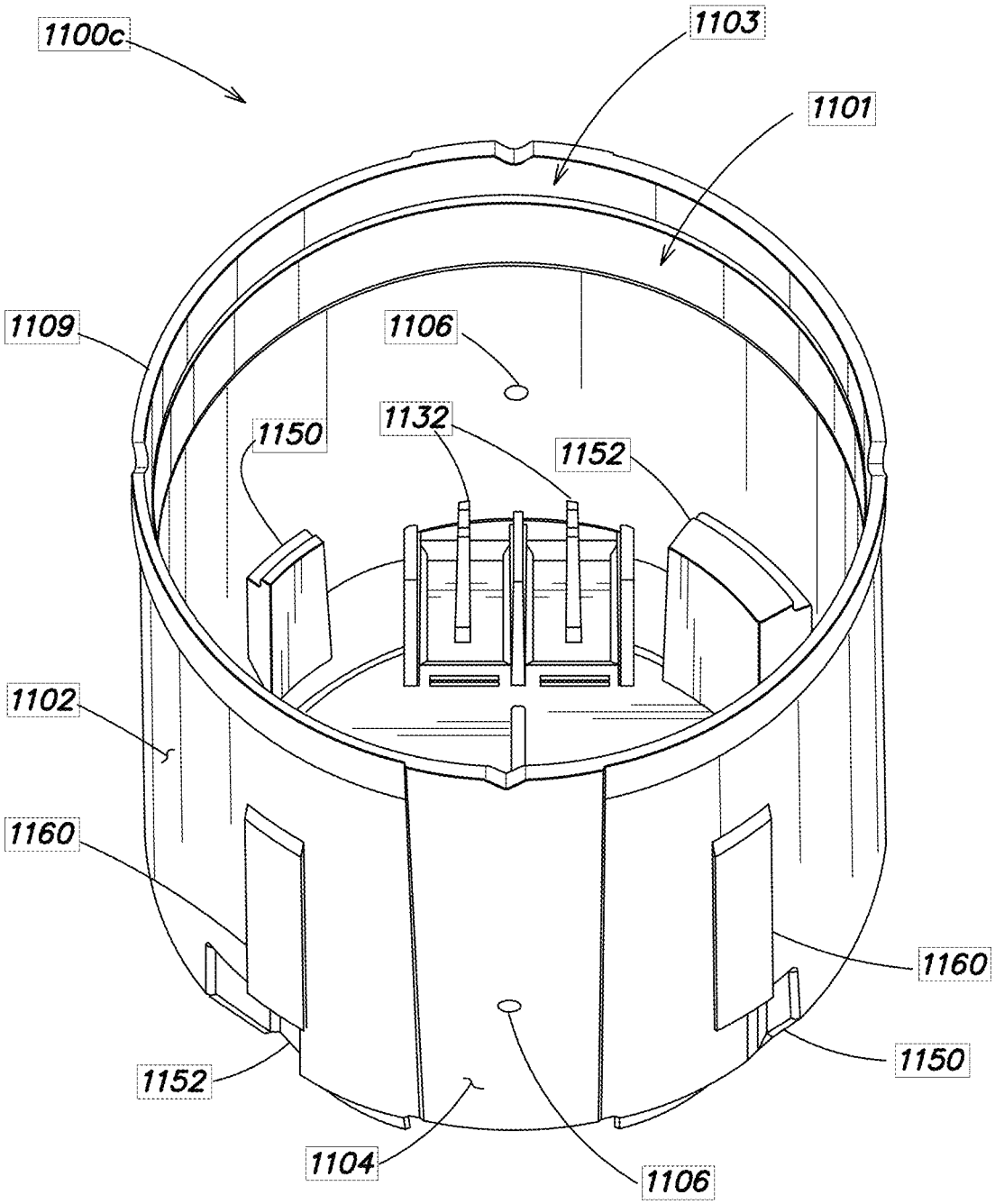
FIG. 9F shows a bottom, front perspective view of the junction box of FIG. 9A.

FIGS. 9A-9F show several views of the housing 1100*c*. The housing 1100*c* may include several of the same features described above and below with respect to the other exemplary recessed lighting fixtures 1000. Additionally, the housing 1100*c* may include support sections 1150 and 1152 to support the partition plate 1500*a*. As shown in FIGS. 9E and 9F, the support sections 1150 and 1152 may be integrated into the sidewall 1102 and/or the cover 1120 and may protrude into the cavity 1101 of the housing 1100*c*. The support sections 1150 and 1152 may have a thickness similar to the sidewall 1102 and/or the cover 1120, thus creating corresponding recesses on the exterior of the housing 1100*c* as shown in FIG. 9E. However, in some implementations, the support sections 1150 and 1152 may be formed with a larger thickness. For example, the support sections 1150 and 1152 may protrude into the cavity 1101 of the housing 1100*c* without forming a recess on the exterior surface of the sidewall 1102. Said in another way, the support sections 1150 and 1152 may be formed with sufficient thickness such that the support sections 1150 and 1152 are not observable on the exterior surface of the housing 1100*c*.

FIG. 9F shows the support sections 1150 and 1152 may each have a supporting surface that abuts a portion of the partition plate 1500*a*. Thus, the shape and dimensions of the support sections 1150 and 1152 may determine where the partition plate 1500*a* is positioned within the cavity 1101 of the housing 1100*c*. This, in turn, may dictate the dimensions and the volume of the wiring compartment 1105 and the lighting compartment 1107. In some implementations, the support sections 1150 and 1152 may be dimensioned such that the volume of the wiring compartment 1105 is similar to previous junction boxes (e.g., between about 15 cubic inches to about 30 cubic inches). The volume of the wiring compartment 1105 may be dimensioned to support multiple wires/cables of varying size as described above. For example, the wiring compartment 1105 may house at least 8 wires/cables that each have a gauge of at least about 12.

Additionally, the supporting surface may include a groove that matches a ridge 1513 on the partition plate 1500*a*. The groove may be used to align and/or register the partition plate 1500*a* to the support sections 1150 and 1152 during installation. In some implementations, the partition plate 1500*a* may be coupled to the housing 1100*c* via a twist and lock connector, thus the grooves may be also be used to guide a twisting motion of the partition plate 1500*a*. To secure the partition plate 1500*a* to the housing 1100*c* via the twist and lock mechanism, the housing 1100*c* may also include an opening 1111 to receive a peg 1112 to engage with and secure the partition plate 1500*a* to the housing 1100*c*. It should be appreciated the peg 1112 may be other coupling members including, but not limited to a screw fastener, a bolt fastener, a dowel, and a rod.

It should be appreciated the housing 1100*c* shown in FIGS. 9A-9F is configured for use with a partition plate 1500*a* and thus does not include structural features for the yoke 1400 (e.g., yokes 1400*a* and 1400*b*). However, in some implementations, the housing 1100*c* may include features to facilitate the installation of both the partition plate 1500*a* and/or the yoke 1400 to provide greater flexibility in configuring the recessed lighting system 1000*c* for different use cases depending on whether the yoke 1400 or the partition plate 1500*a* is more preferable. In this manner, a single design for the housing 1100*c* may be manufactured as opposed to two separate designs. In some implementations, the housing 1100*c* may be configured to support both the partition plate 1500*a* and the yoke 1400 simultaneously.

As before, the housing 1100*c* may be formed from various thermoplastic and thermosetting polymers including, but not limited to polyvinyl chloride (PVC), acrylonitrile butadiene styrene (ABS), polycarbonate (PC), polyurethane (PU), polyethylene, polyethylene terephthalate, polypropylene, and polystyrene. The housing 1100*c* may be fabricated using various manufacturing methods including, but not limited to injection molding, 3D printing, and blow molding.

Figure 10A:
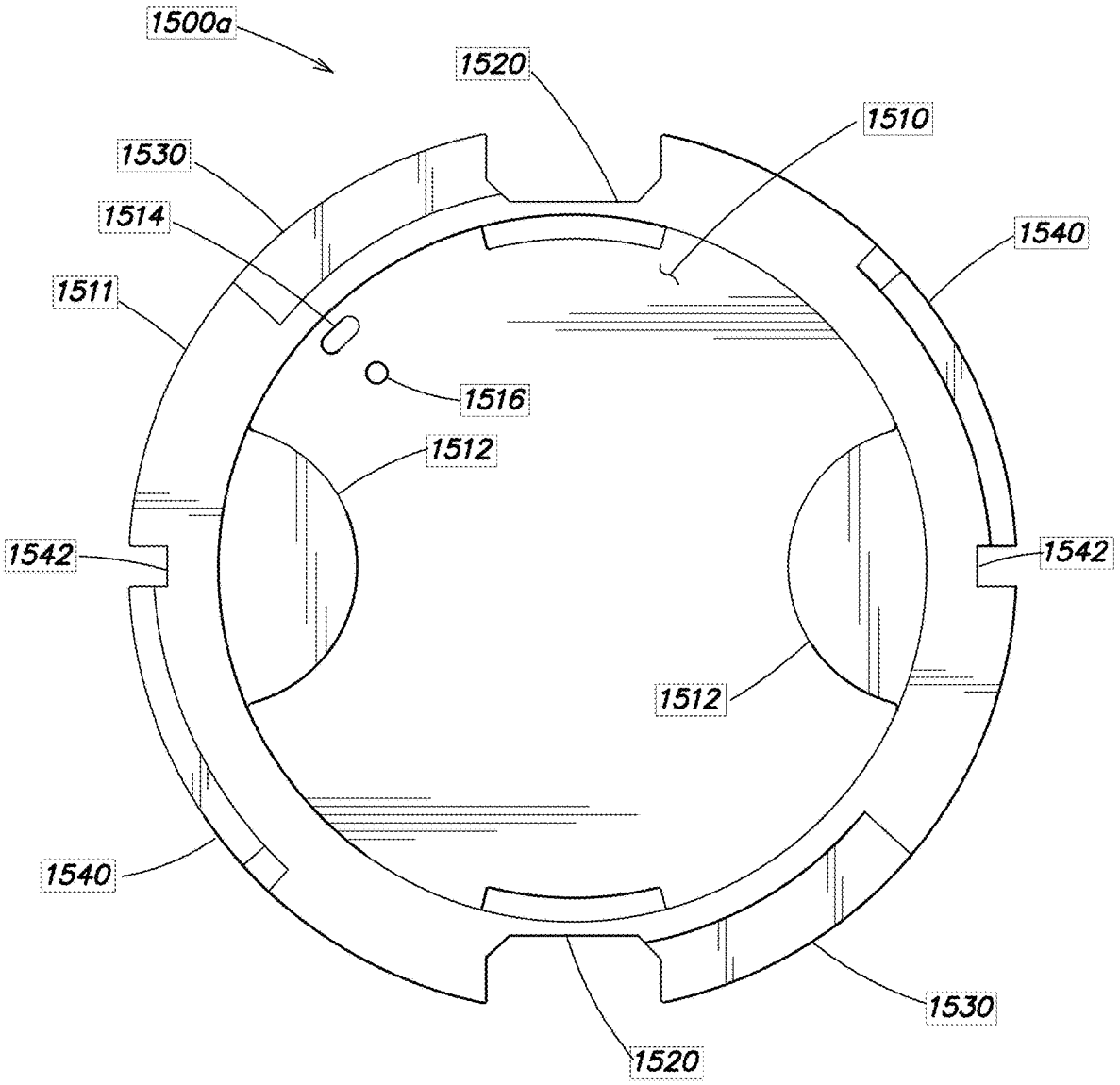
FIG. 10A shows a top view of a partition plate in the lighting fixture of FIG. 8A.
Figure 10B:
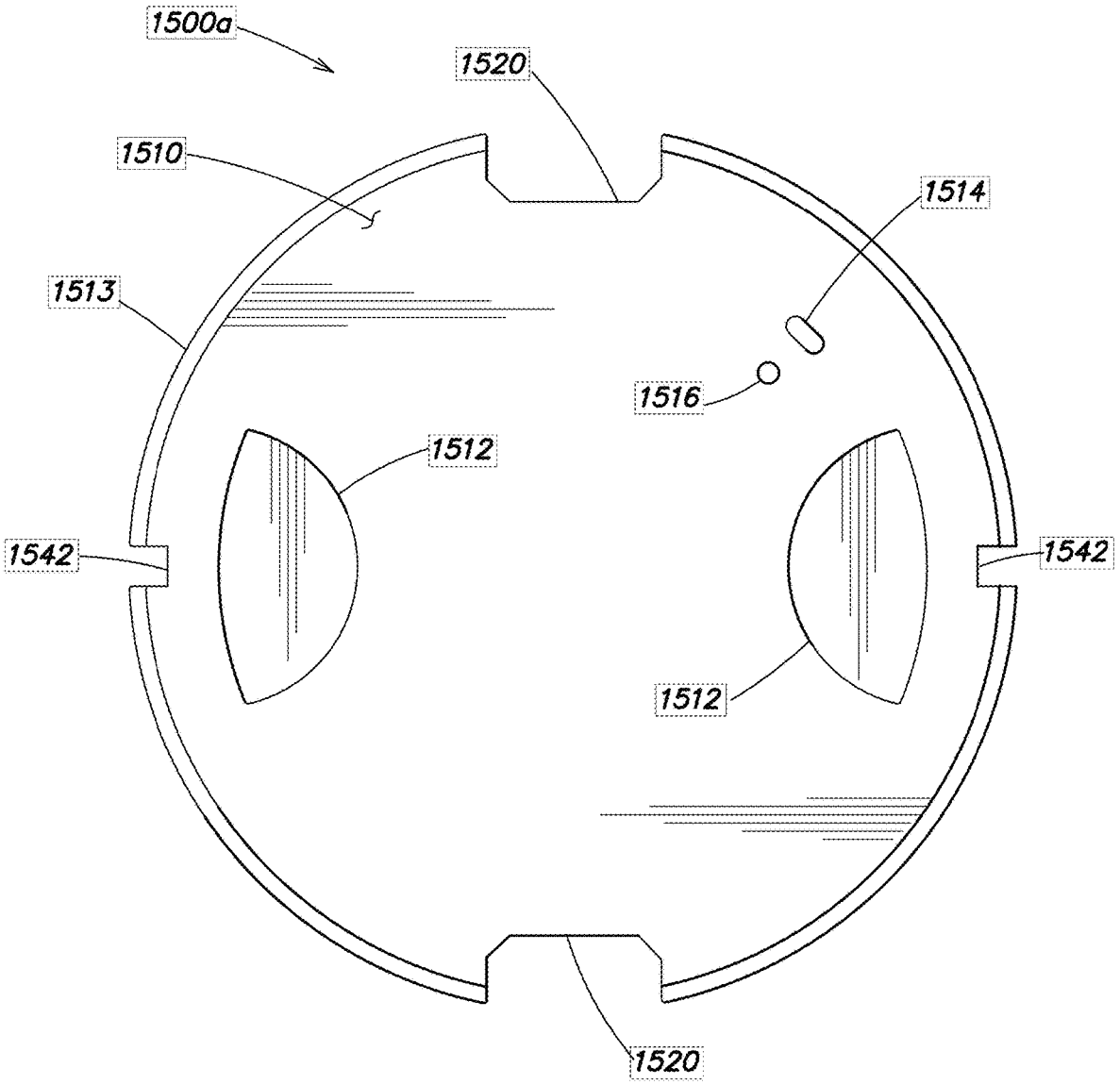
FIG. 10B shows a bottom view of the partition plate in FIG. 10A.
Figure 10C:
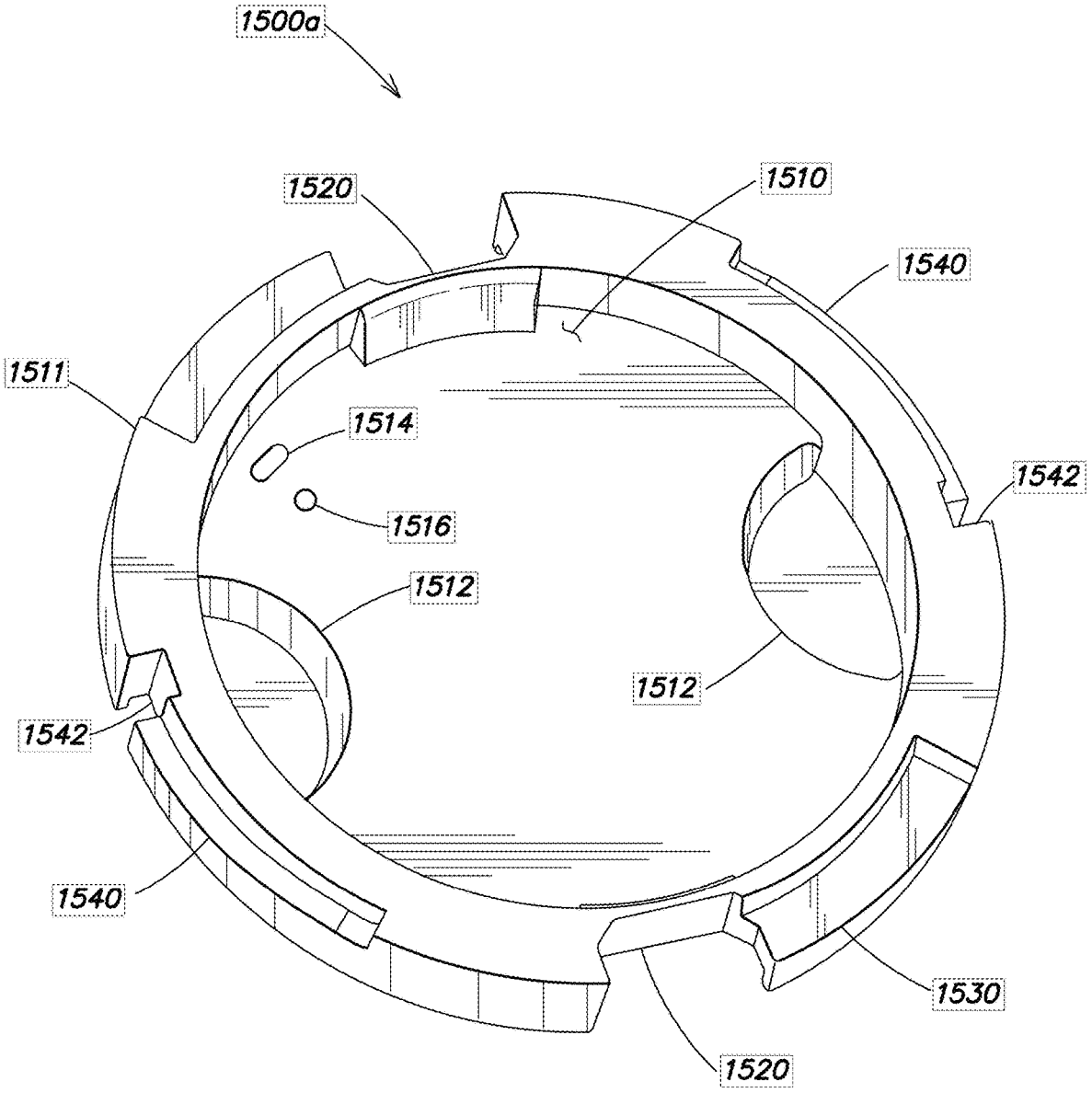
FIG. 10C shows a top, front perspective view of the partition plate in FIG. 10A.

FIGS. 10A-10C show several views of the partition plate 1500*a*. As shown the partition plate 1500*a* includes a base 1510 to support the various features of the partition plate 1500*a*. The base 1510 may include a flange 1511 along the periphery of the base 1510. The flange 1511 may be used, in part, to incorporate a coupling mechanism to couple the partition plate 1500*a* to the housing 1100*c* and to increase the structural rigidity of the partition plate 1500*a*. The partition plate 1500*a* may generally have various cross-sectional shapes (the cross-section being defined along a plane parallel to the opening 1103 of the housing 1100*c*)

including, but not limited to a circle, an ellipse, a regular polygon, and an irregular polygon. In some implementations, the shape of the partition plate 1500*a* may be based on the shape of the cavity 1101 of the housing 1100*c* such that the partition plate 1500*a* may substantially separate the wiring compartment 1105 from the lighting compartment 1107.

Figure 11A:
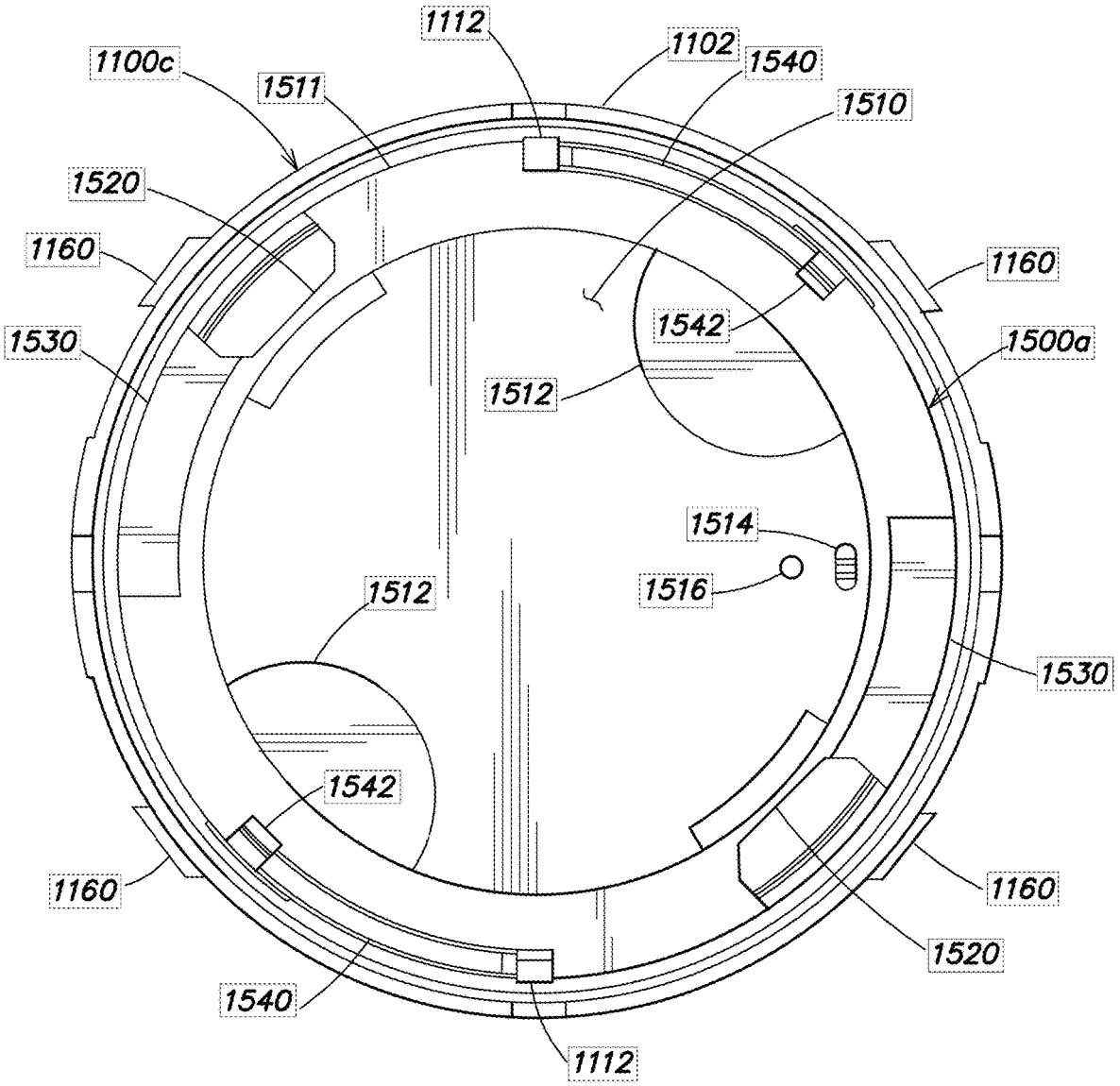
FIG. 11A shows a bottom view of the junction box of FIG. 9A with the partition plate of FIG. 10A inserted into the junction box.

Various types of coupling mechanisms may be used including, but not limited to a twist and lock connector, a snap fit connector, a friction clip, and a spring clip. FIGS. 10A-10C show the partition plate 1500*a* as having a twist and lock connector 1540 and a recessed connector 1530 on the flange 1511 to abut against the support sections 1150 and 1152 of the housing 1100*c*. The twist and lock connector 1540 may include a notch 1542 to allow the peg 1112 on the housing 1100*c* to pass through said notch 1542 when the partition plate 1500*a* is inserted into the cavity 1101 of the housing 1100*c*. As the partition plate 1500*a* is rotated, the peg 1112 may engage with the twist and lock connector 1540 as shown in FIG. 11A. The recessed connector 1530 may include a notch 1520 to allow the partition plate 1500*a* to pass by the coupling member 1614 used to couple the hanger bar assembly 1600 to the housing 1100*c* (e.g., a thumbscrew, a butterfly wing screw) when inserted into the cavity 1101 of the housing 1100*c*. Additionally, the partition plate 1500*a* may include the ridge 1513 protruding from the bottom of the partition plate 1500*a* along the periphery to align with the groove on the support sections 1150 and 1152 of the housing 1100*c*.

The flange 1511 may be dimensioned and shaped to increase the structural rigidity of the partition plate 1500*a*. For example, the flange 1511 may be dimensioned to ensure the partition plate 1500*a* does not have portions that are excessively thin, such as near the notches 1520 and 1542 and/or the connectors 1530 and 1540. The base 1510 may also include features 1512 to structurally reinforce the partition plate 1500*a* by increasing the structural rigidity, such as a gusset. In some implementations, the structural features 1512 may be placed proximate to the depressions formed by the twist and lock connector 1540 to increase the structural rigidity. As shown in FIGS. 10B and 10C, the features 1512 may be a protrusion on the bottom side of the partition plate 1500*a* corresponding to a recess formed on the top side of the base 1510.

The partition plate 1500*a* may also include feedthroughs for a wire/cable to pass from the wiring compartment 1105 into the lighting compartment 1107 to electrically connect the light module 1200 to an electrical power source. As shown in FIGS. 10A-10C, the partition plate 1500*a* may include feedthroughs 1514 and 1516 for AC/DC wires/cables and a ground wire, respectively, disposed on the base 1510. The feedthroughs 1514 and 1516 may be dimensioned according to the size of the respective wire/cable used by the light module 1200. The feedthroughs 1514 and 1516 may also be positioned on the partition plate 1500*a* to improve the ease of routing the wires/cables from the wiring compartment 1105 to the lighting compartment 1107, which may depend on the location of the feedthrough tab 1130 or knockout 1140 used to insert the wire/cable and/or the position of an electrical connector on the light module 1200.

The partition plate 1500*a* may be formed from various metals, thermoplastic polymers, and thermosetting polymers including, but not limited to aluminum, steel, stainless steel, polyvinyl chloride (PVC), acrylonitrile butadiene styrene (ABS), polycarbonate (PC), and polyurethane (PU), polyethylene, polyethylene terephthalate, polypropylene, polystyrene, a Makrolon® polycarbonate, and a Therma-Tech™ thermally conductive compound. The partition plate 1500*a* may be fabricated using various manufacturing methods including, but not limited to injection molding, 3D printing, blow molding, casting, and machining.

Figure 11B:
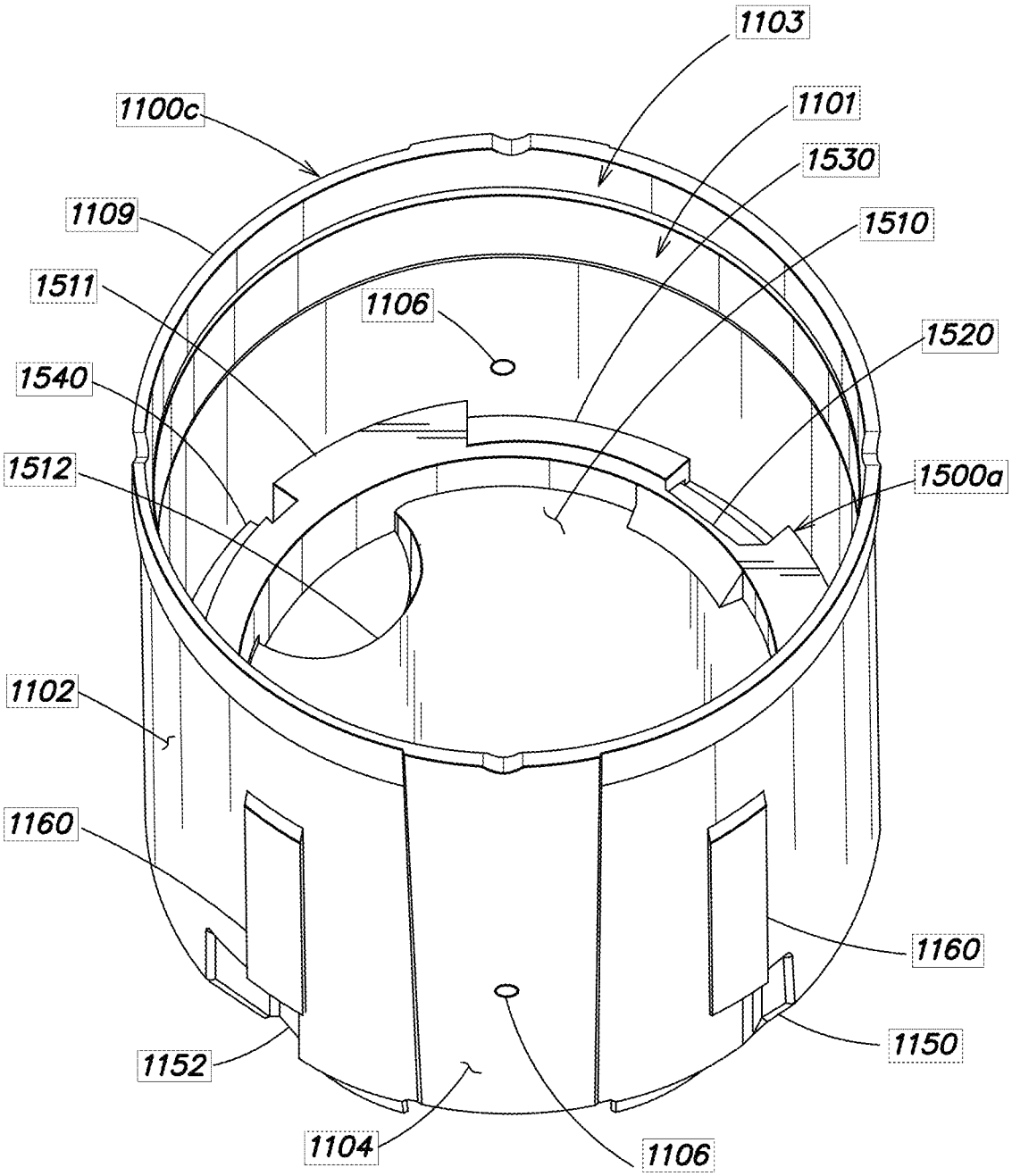
FIG. 11B shows a bottom, front perspective view of the junction box of FIG. 11A where the partition plate is at a fully locked position.

FIGS. 11A and 11B show several views of the partition plate 1500*a* disposed in the cavity 1101 of the housing 1100*c*. As shown in FIG. 11A, the partition plate 1500*a* may be secured to the housing 1100*c* via a peg 1112 that engages with the twist and lock connector 1540. Furthermore, the partition plate 1500*a* may be shaped and dimensioned to match the cross-sectional shape of the cavity 1101 of the housing 1100*c* such that the flange 1511 of the partition plate 1500*a* is proximate to, or, in some instances, contacts the sidewall 1102 of the housing 1100*c*.

A Second Example of a Recessed Lighting System with a Partition Plate

Figure 12A:
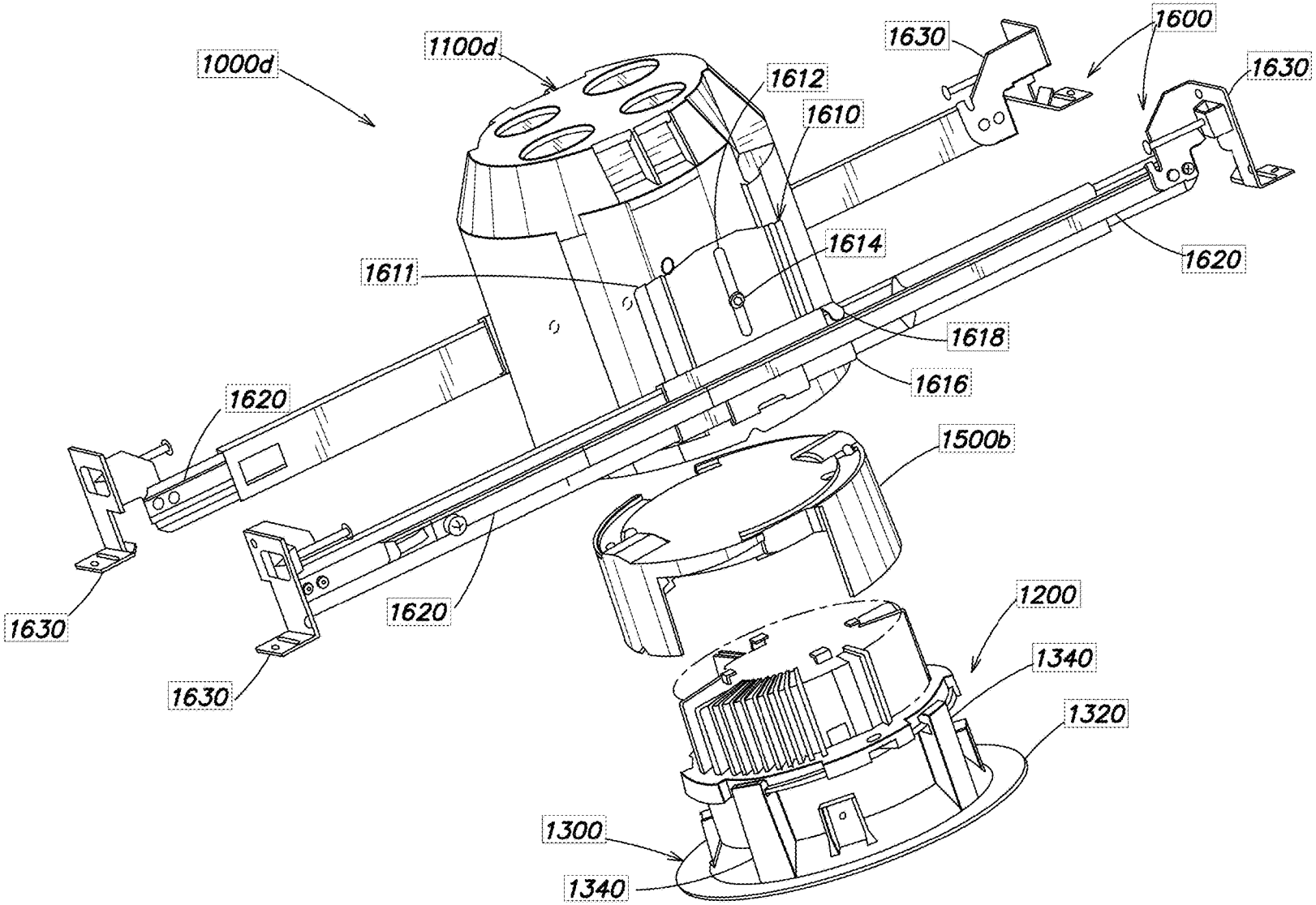
FIG. 12A shows an exploded view of another exemplary lighting fixture.
Figure 12B:
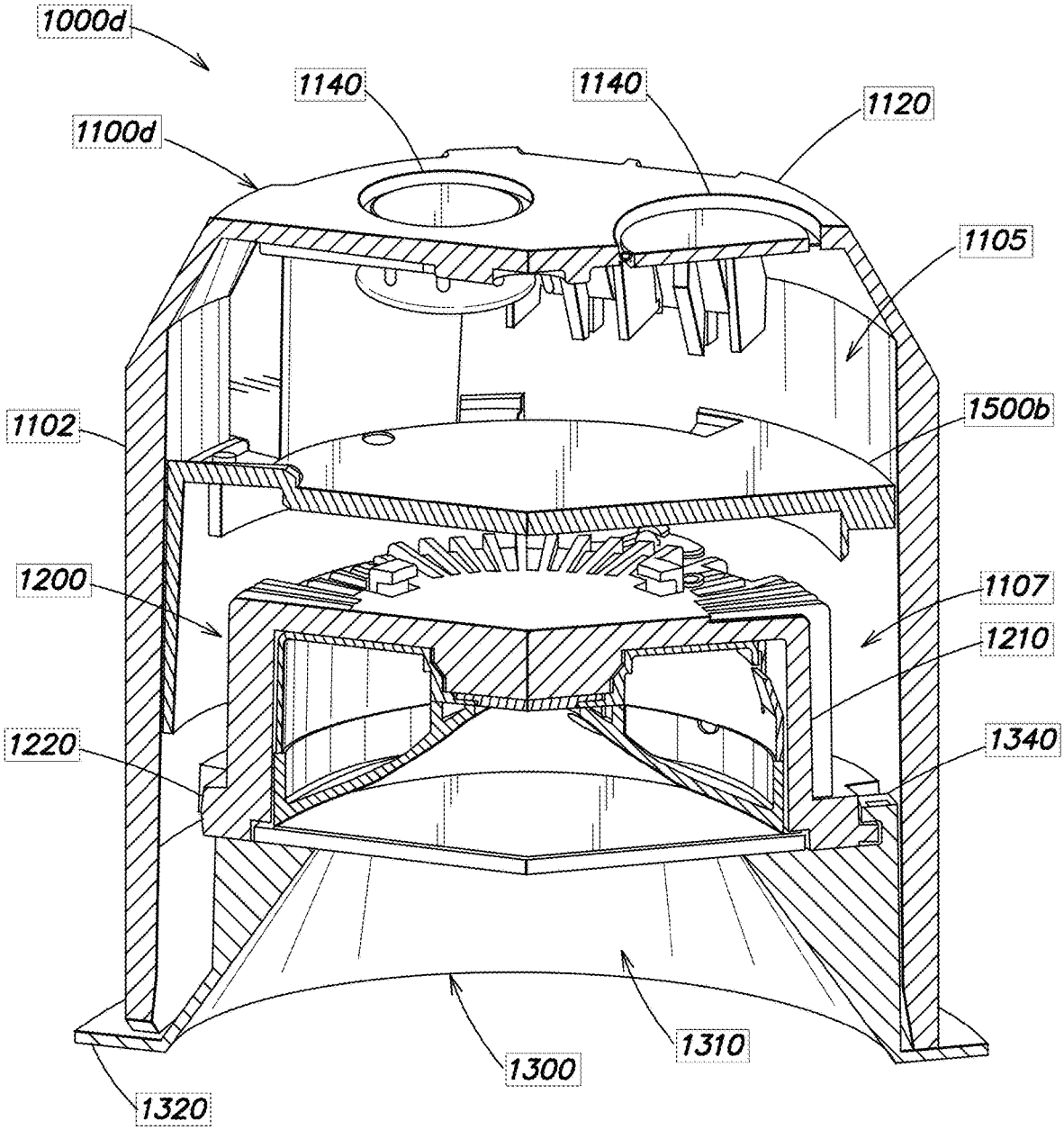
FIG. 12B shows a cross-sectional right perspective view of the lighting fixture of FIG. 12A where the lighting fixture is assembled.
Figure 13A:
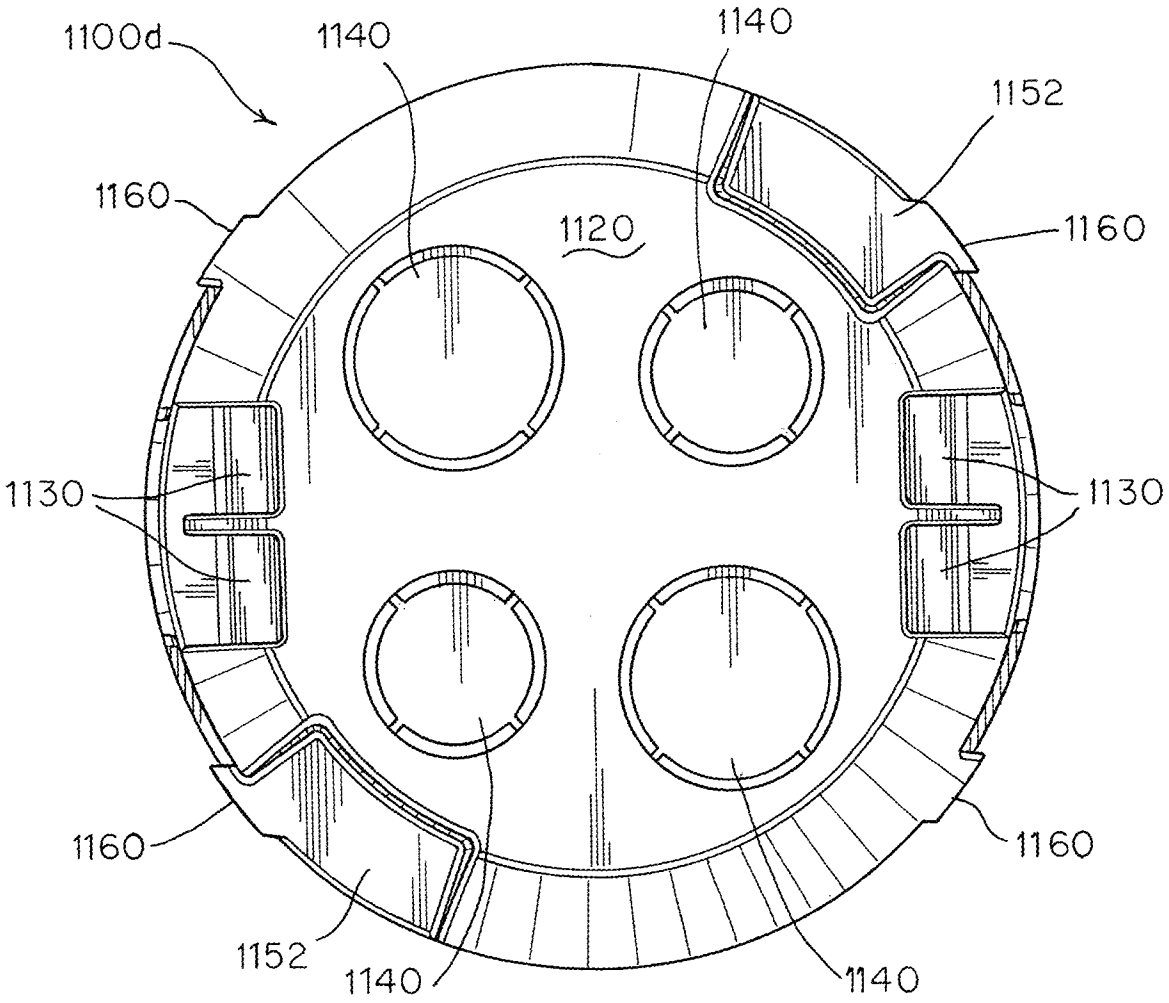
FIG. 13A shows a top view of a junction box in the lighting fixture of FIG. 12A.
Figure 13B:
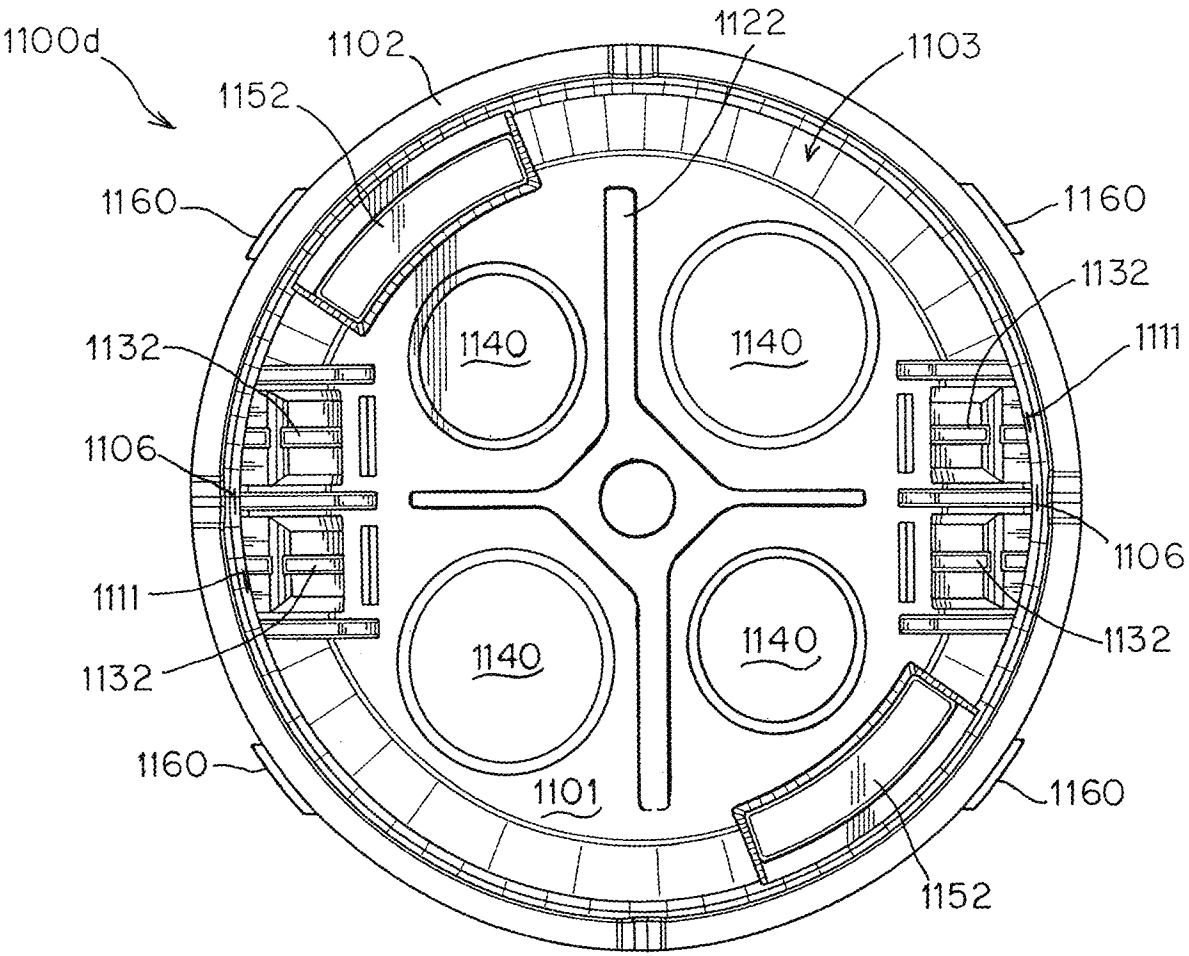
FIG. 13B shows a bottom view of the junction box of FIG. 13A.
Figure 13C:
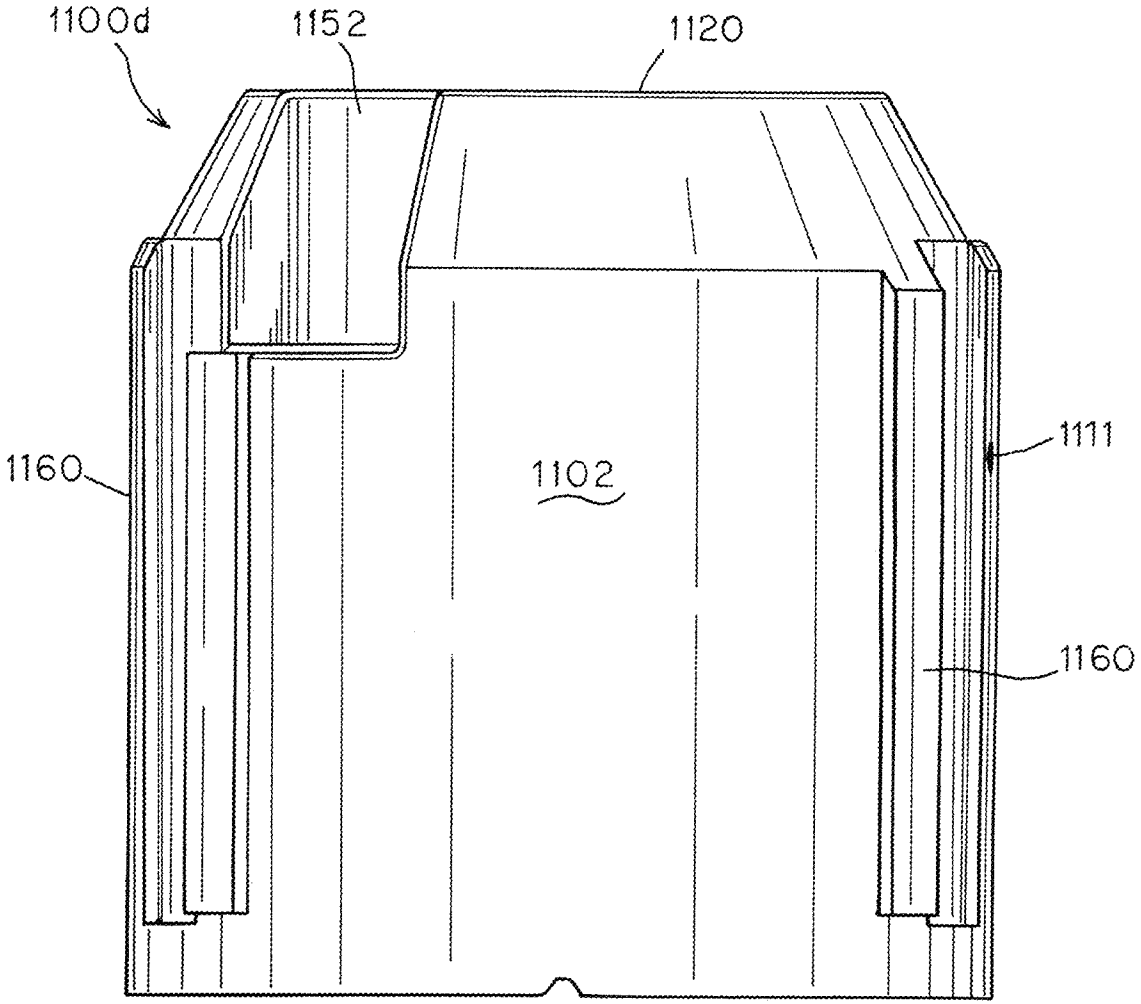
FIG. 13C shows a right-side view of the junction box of FIG. 13A, the left-side view being identical.
Figure 13D:
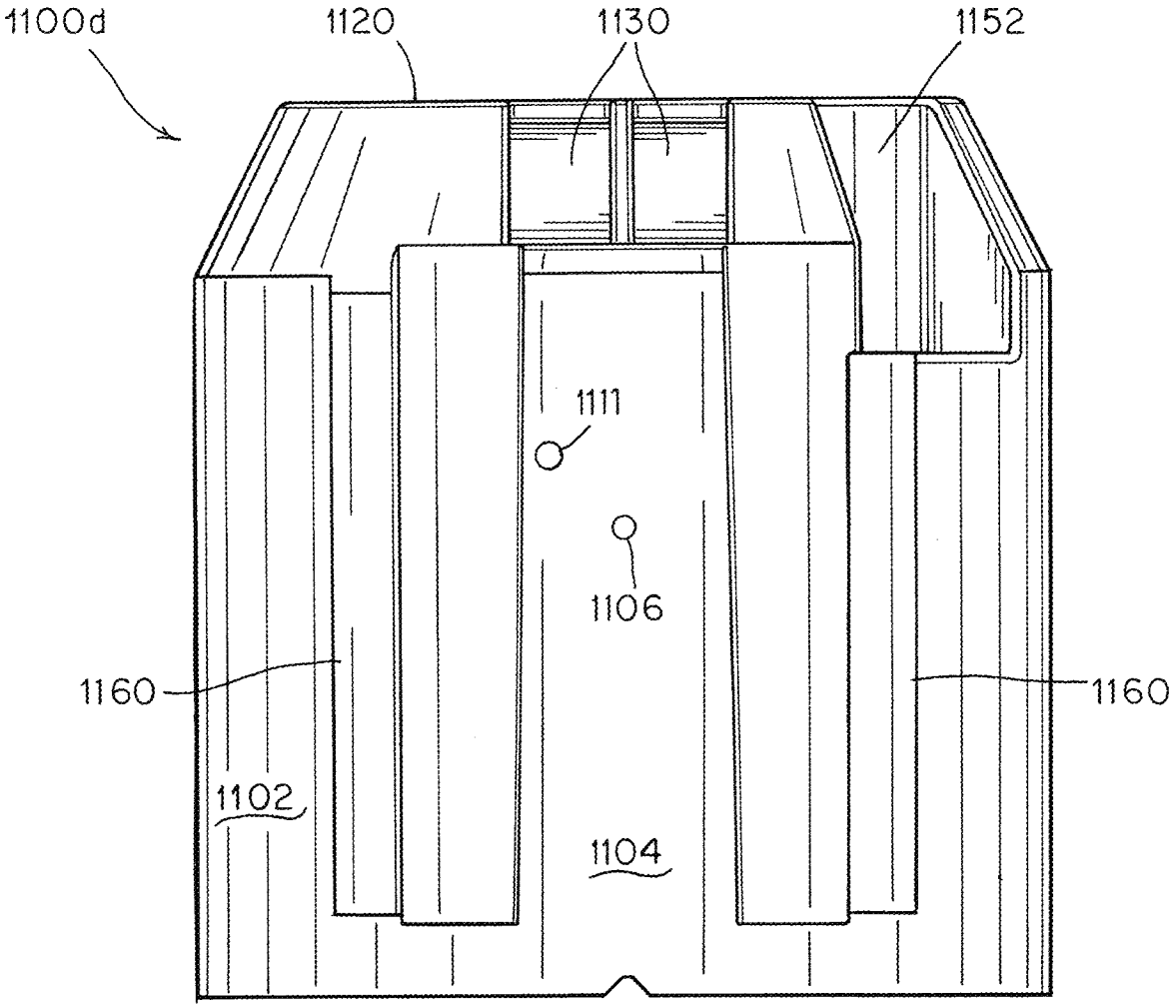
FIG. 13D shows a front-side view of the junction box of FIG. 13A, the rear-side view being identical.
Figure 13E:
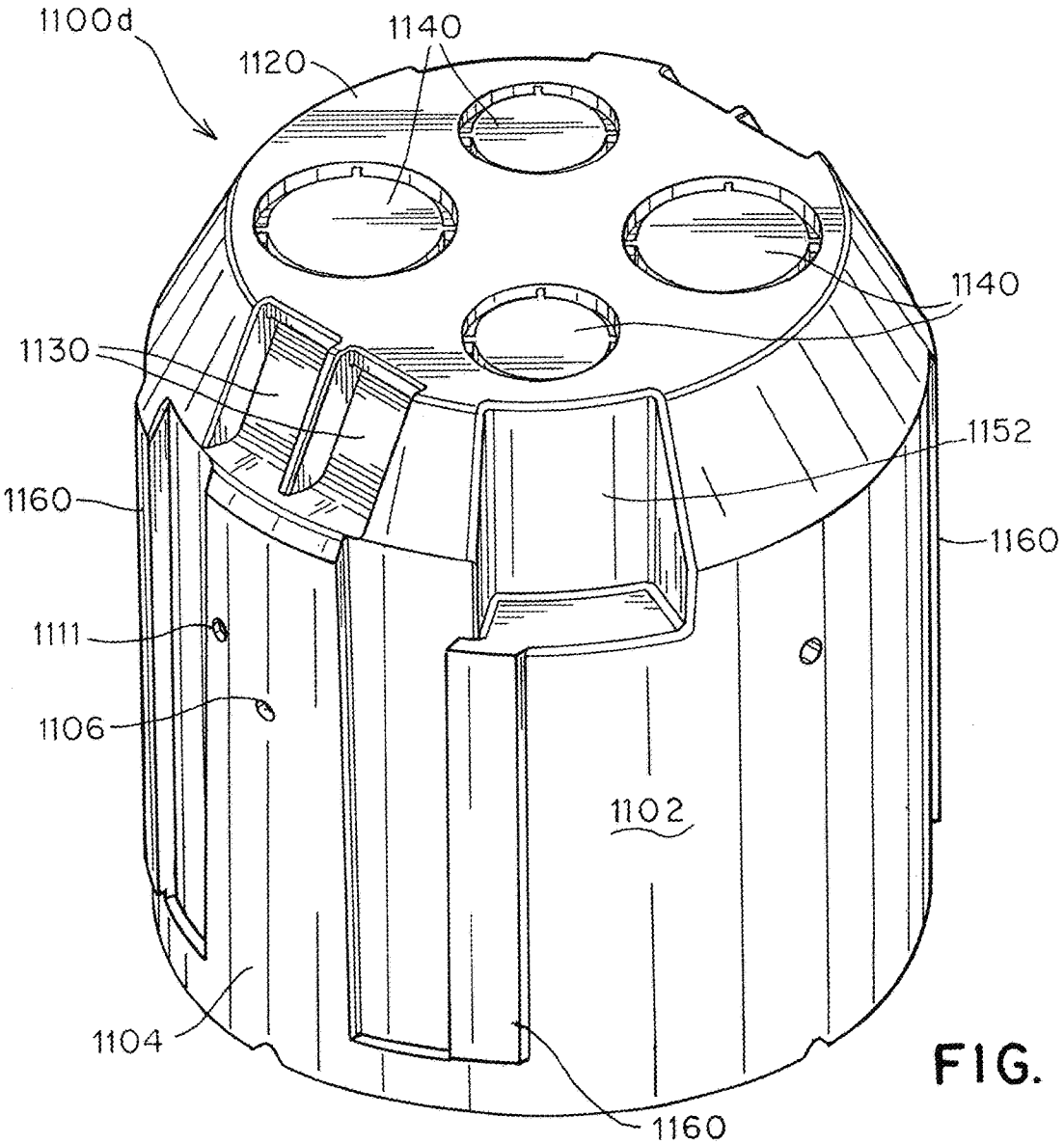
FIG. 13E shows a top, front perspective view of the junction box of FIG. 13A.
Figure 13F:
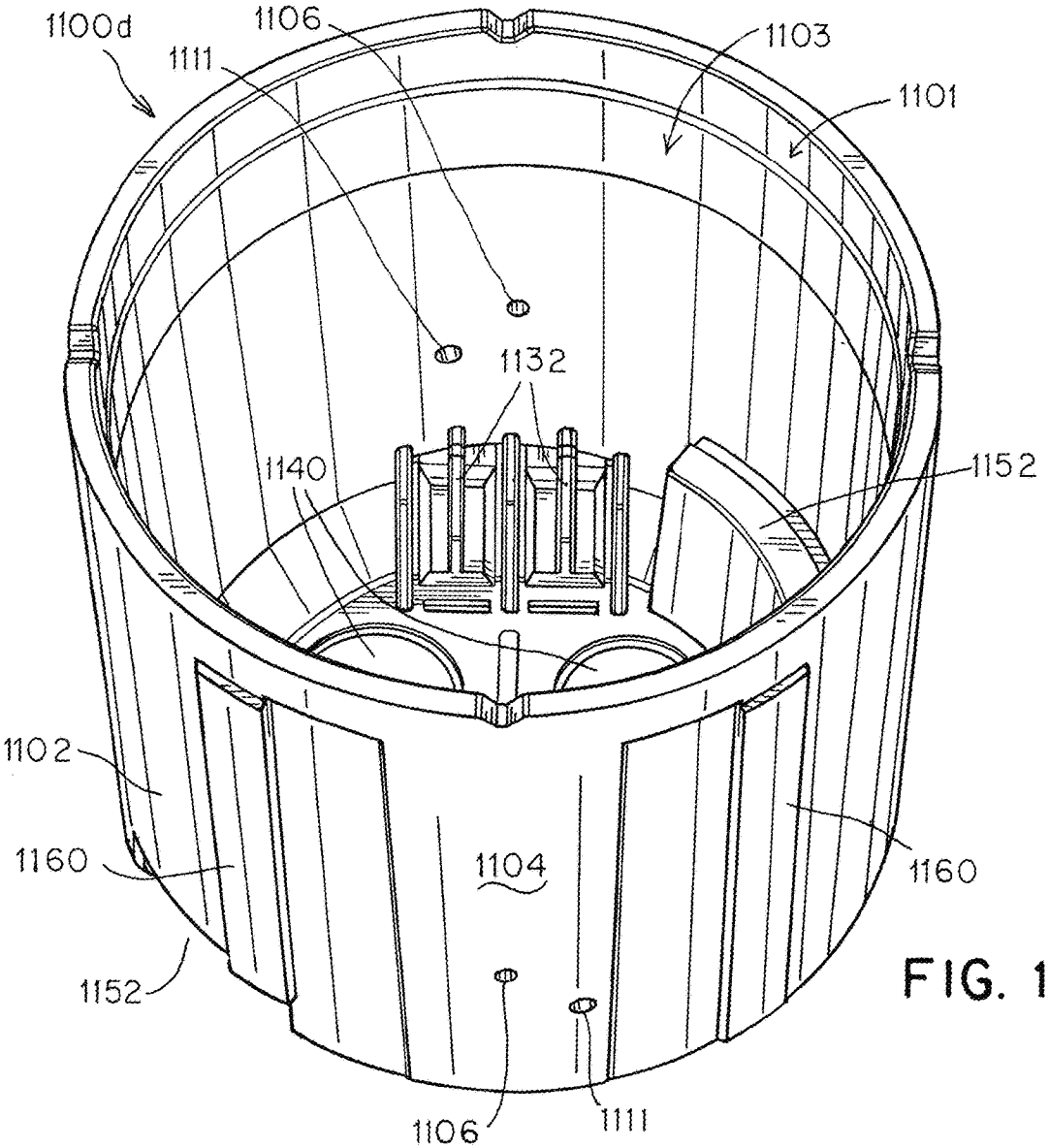
FIG. 13F shows a bottom, front perspective view of the junction box of FIG. 13A.

FIGS. 12A and 12B show several views of a second exemplary implementation of a recessed lighting system 1000*d* with a partition plate 1500*b*. As before, the recessed lighting system 1000*d* may include a housing 1100*d* to cover and support the various components of the recessed lighting system 1000*d*. A partition plate 1500*b* may be inserted into the cavity 1101 of the housing 1100*d* to push back against wires/cables in the housing 1100*d* and to define a wiring compartment 1105 and a lighting compartment 1107. A light module 1200 and a trim 1300 may be inserted into the lighting compartment 1107. The trim 1300 may further include a coupling member 1330 to secure the assembly of the light module 1200 and the trim 1300 to the housing 1100*d*. FIG. 12A also shows a hanger bar assembly 1600 may be mounted to the sidewall 1102 of the housing 1100*d* for installation onto a building structure (e.g., a T-bar, a joist, a stud). A method of installing the recessed lighting system 1000*d* depicted in FIG. 12A may be substantially similar to the method described above for the recessed lighting system 1000*c*.

FIGS. 13A-13F show several views of the housing 1100*d*. The housing 1100*d* may include several of the same features described above and below with respect to the other exemplary recessed lighting fixtures 1000. For the housing 1100*d* depicted in FIGS. 13A-13F, the guides 1160 may be extended to cover a larger portion between the opening 1103 and the cover 1120 in order to provide additional alignment to the hanger bar assembly 1600 during assembly. Additionally, the housing 1100*d* may only have support section 1152 (the support sections 1150 are no longer included) to simplify manufacture of the housing 1100*d*. The location of the opening 1111 used to receive the peg 1112 that engages with the partition plate 1500*b* may correspondingly be relocated based on the position of the support section 1152 on the housing 1100*d*.

As before, the housing 1100*d* may be formed from various thermoplastic and thermosetting polymers including, but not limited to polyvinyl chloride (PVC), acrylonitrile butadiene styrene (ABS), polycarbonate (PC), polyurethane (PU), polyethylene, polyethylene terephthalate, polypropylene, and polystyrene. The housing 1100*d* may be fabricated using various manufacturing methods including, but not limited to injection molding, 3D printing, and blow molding.

Figure 14A:
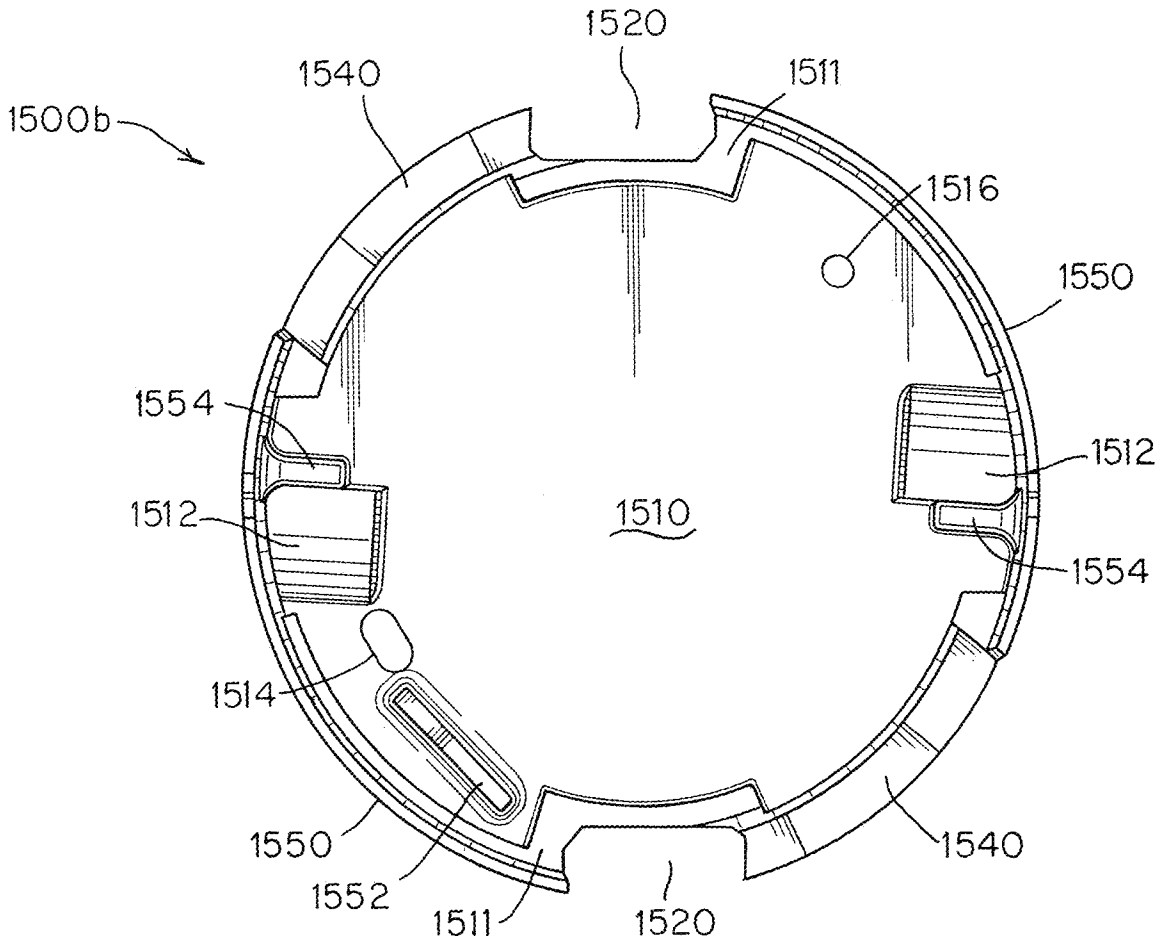
FIG. 14A shows a top view of a partition plate in the lighting fixture of FIG. 12A.
Figure 14B:
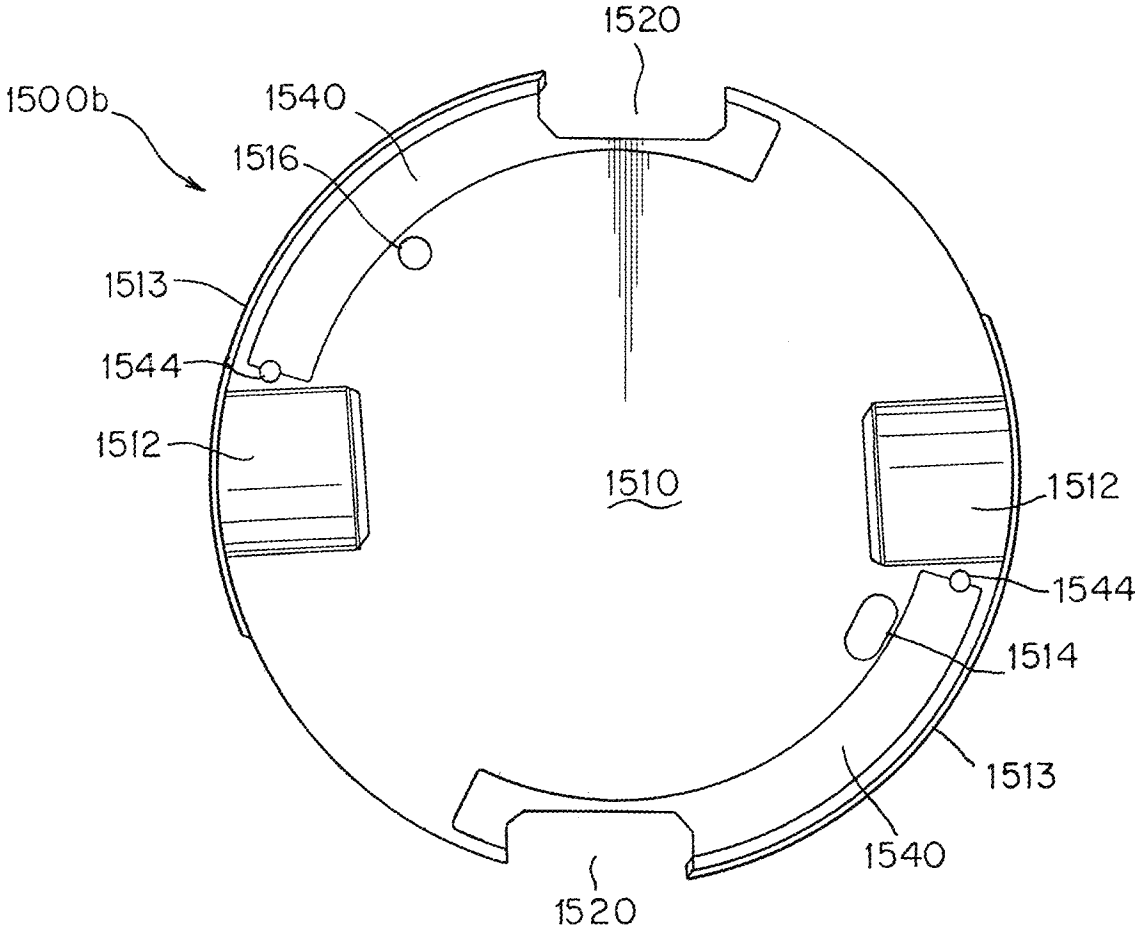
FIG. 14B shows a bottom view of the partition plate in FIG. 14A.
Figure 14C:
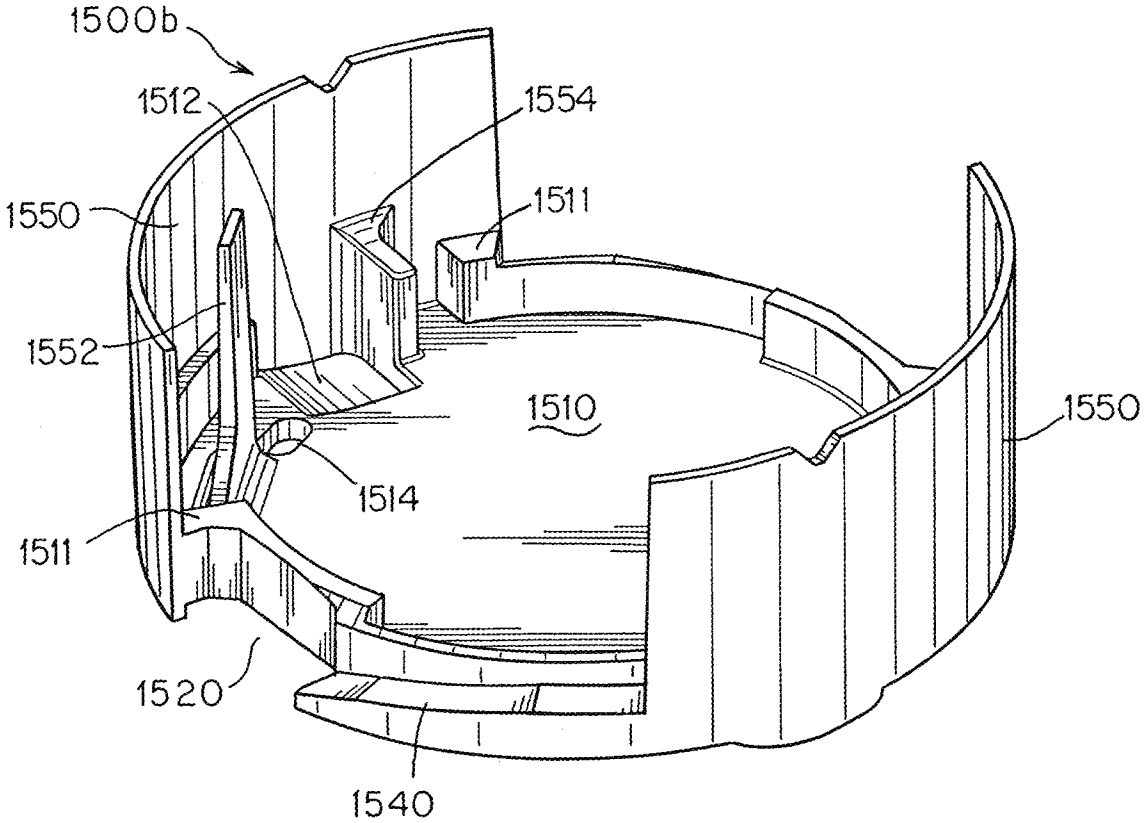
FIG. 14C shows a top, front perspective view of the partition plate in FIG. 14A.

FIGS. 14A-14C show several views of the partition plate 1500*b*. The partition plate 1500*b* may include several of the same features as described above and below with respect to the other exemplary recessed lighting fixtures 1000. The partition plate 1500*b* shown in FIGS. 14A-14C may further include additional structural features to improve ease of installation and/or the structural properties of the partition plate 1500*b*. For example, FIG. 14C shows the partition plate 1500*b* includes walls 1550 on the flange 1511, which may be used, in part, to guide the partition plate 1500*b* into the cavity 1101 of the housing 1100*d* by reducing the amount of side to side movement and/or rotation of the partition plate 1500*b* as the partition plate 1500*b* is being inserted into the housing 1100*d*. The walls 1550 may also increase the structural rigidity of the partition plate 1500*b* and the housing 1100*d* once the partition plate 1500*b* is installed.

The partition plate 1500*b* may also include a structural feature 1554 on top of the base 1510 that abuts the feature 1512 disposed on the bottom of the partition plate 1500*b*. The structural feature 1554 may be used to increase the structural rigidity near the structural feature 1512. Additionally, the structural feature 1554 may provide a surface against which a user may press against when rotating the partition plate 1500*b* to engage the twist and lock connector 1540.

FIGS. 14A and 14C also show the partition plate 1500*b* may include a cable restraint 1552 disposed on the top of the base 1510. The cable restraint 1552 may be used to secure a portion of a wire/cable (e.g., AC/DC wire/cable) inserted through the feedthrough 1514 such that the wire/cable is kept to the side when the light module 1200 is inserted into the housing 1100*d*. For example, the cable restraint 1552 may also be positioned proximate to the flange 1511 such that a portion of the wire/cable or a connector at the end of the wire/cable is constrained by a combination of the cable restraint 1552 and the flange 1511. In this manner, the connector at the end of the wire/cable does not interfere with the light module 1200 as the light module 1200 is pushed into the cavity 1101 of the housing 1100*d*. In some implementations, a wire/cable with excess length may be wrapped around the cable restraint 1552.

The partition plate 1500*b* of FIGS. 14A-14C also removes the recessed connector 1530 and includes only the twist and lock connector 1540 thus simplifying manufacture of the partition plate 1500*b*. The notch 1520 may thus allow the partition plate 1500*b* to pass through the peg 1112 and the coupling member 1614 for the hanger bar assembly 1600. The partition plate 1500*b* may also include a mechanical stop 1544 at an end of the twist and lock connector 1540. The mechanical stop 1544 may prevent the partition plate 1500*b* from rotating beyond a desired position when installed into the cavity 1101 of the housing 1100*d*. Additionally, the inclusion of the mechanical stop 1544 may enable the twist and lock connector 1540 to have a shallower depth on the flange 1511, thus increasing the structural rigidity of the partition plate 1500*b*.

As before, the partition plate 1500*b* may be formed from various metals, thermoplastic polymers, and thermosetting polymers including, but not limited to aluminum, steel, stainless steel, polyvinyl chloride (PVC), acrylonitrile butadiene styrene (ABS), polycarbonate (PC), and polyurethane (PU), polyethylene, polyethylene terephthalate, polypropylene, polystyrene, a Makrolon® polycarbonate, and a Therma-Tech™ thermally conductive compound. The partition plate 1500*b* may be fabricated using various manufacturing methods including, but not limited to injection molding, 3D printing, blow molding, casting, and machining.

Figure 15A:
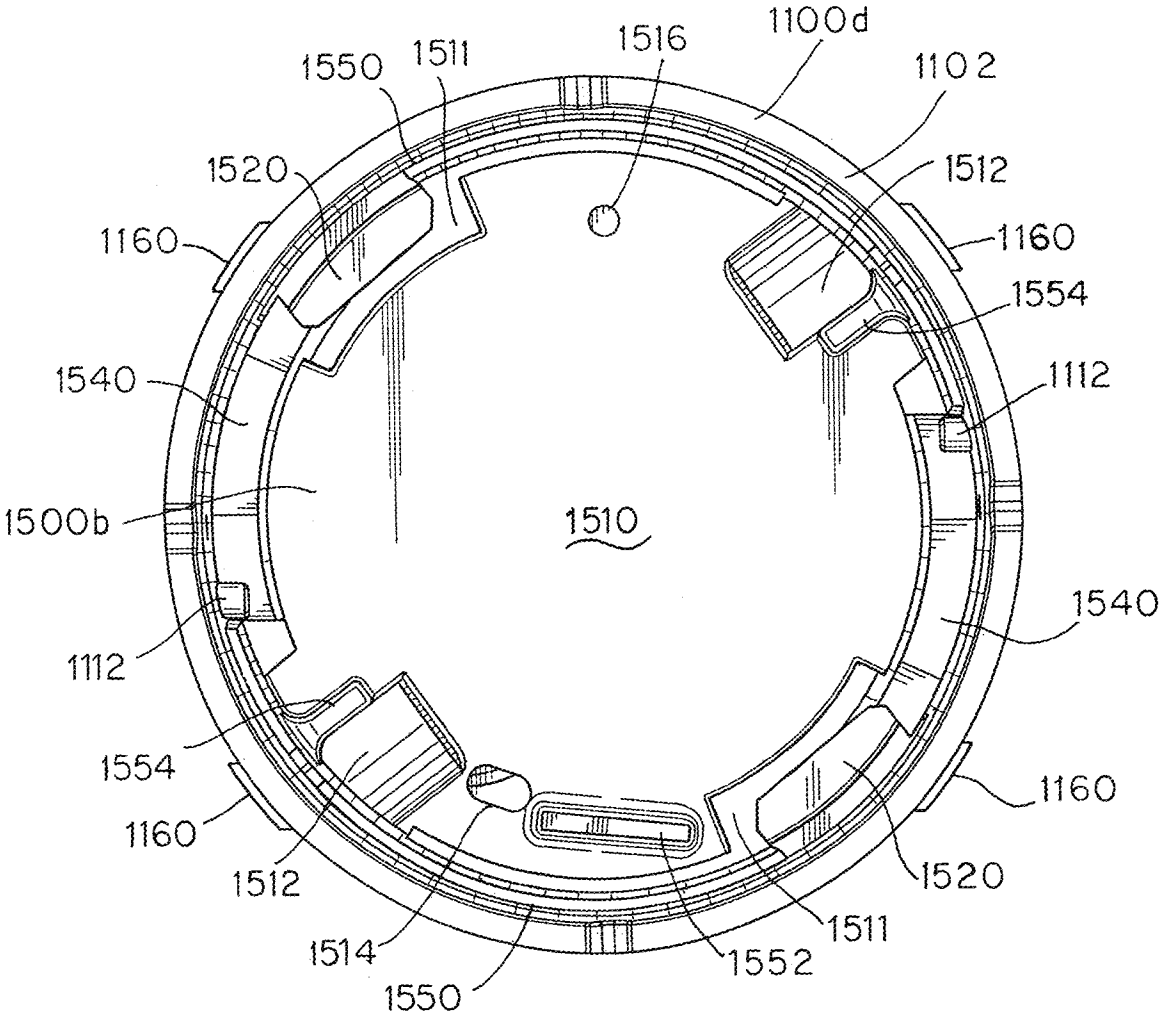
FIG. 15A shows a bottom view of the junction box of FIG. 13A with the partition plate of FIG. 14A inserted into the junction box.
Figure 15B:
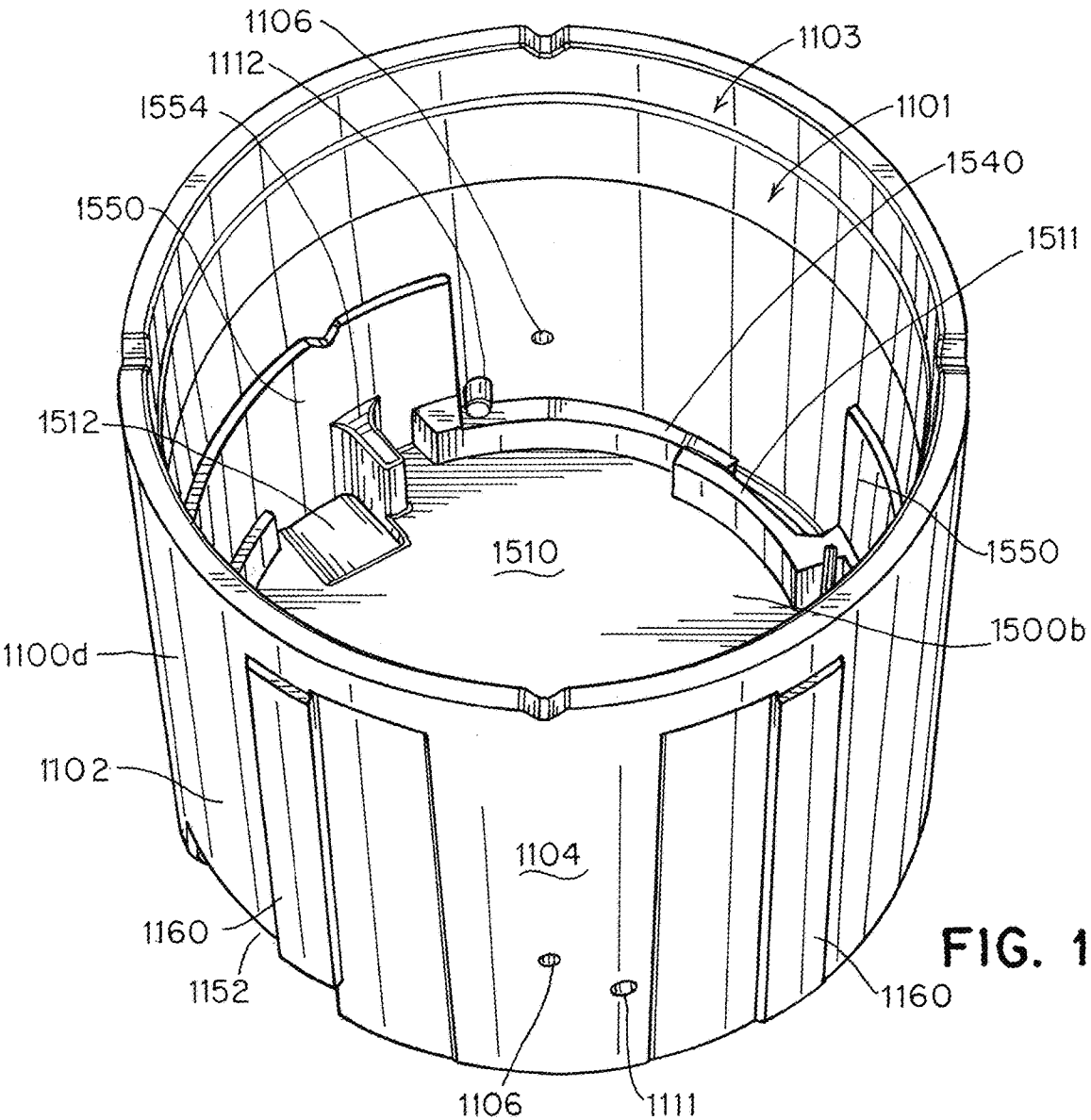
FIG. 15B shows a bottom, front perspective view of the junction box of FIG. 15A where the partition plate is at a fully locked position.

FIGS. 15A and 15B show several views of the partition plate 1500*b* disposed in the cavity 1101 of the housing 1100*d*. As shown, the walls 1550 on the partition plate 1500*b* may be proximate to or, in some instances, contact the sidewall 1102 of the housing 1100*d*. As before, the peg 1112 on the housing 1100*d* may engage the twist and lock connector 1540 thus securing the partition plate 1500*b* to the housing 1100*d*.

A Third Example of a Recessed Lighting System with a Partition Plate

Figure 16:
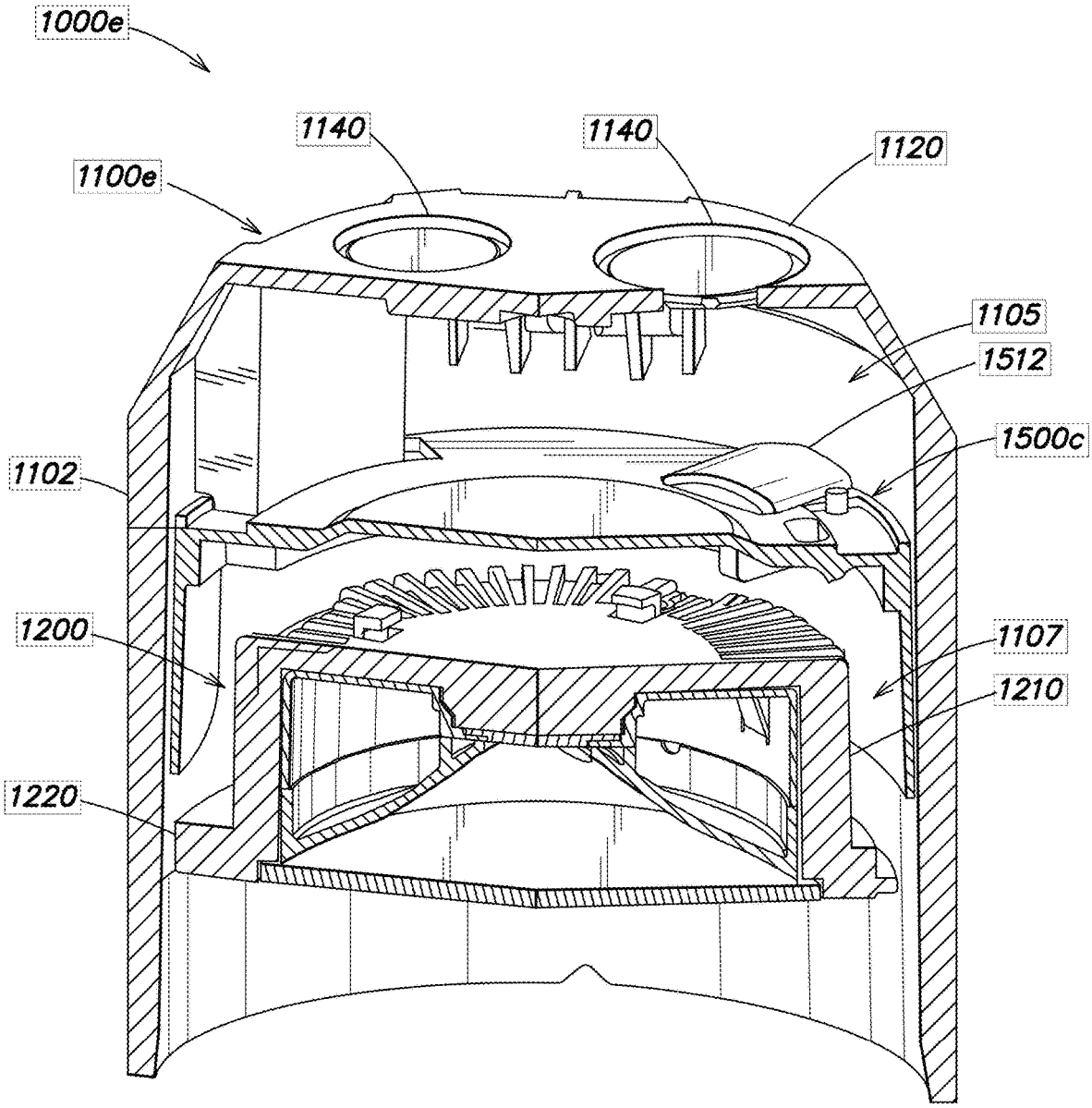
FIG. 16 shows a cross-sectional right perspective view of another exemplary lighting fixture.

FIG. 16 shows a third exemplary implementation of a recessed lighting system 1000*e* with a partition plate 1500*c*. In this implementation, the housing 1100*e* is the same as the housing 1100*d* shown in FIGS. 13A-13F. As before, a partition plate 1500*c* may be inserted into the cavity 1101 of the housing 1100*e* to push back against wires/cables in the housing 1100*e* and to define a wiring compartment 1105 and a lighting compartment 1107. A light module 1200 and a trim 1300 may be inserted into the lighting compartment 1107. The trim 1300 may further include a coupling member 1330 to secure the assembly of the light module 1200 and the trim 1300 to the housing 1100*e*. A hanger bar assembly (not shown) may be mounted to the sidewall 1102 of the housing 1100*e* for installation onto a building structure (e.g., a T-bar, a joist, a stud). A method of installing the recessed lighting system 1000*e* depicted in FIG. 16 may be substantially similar to the method described above for the recessed lighting system 1000*c*.

Figure 17A:
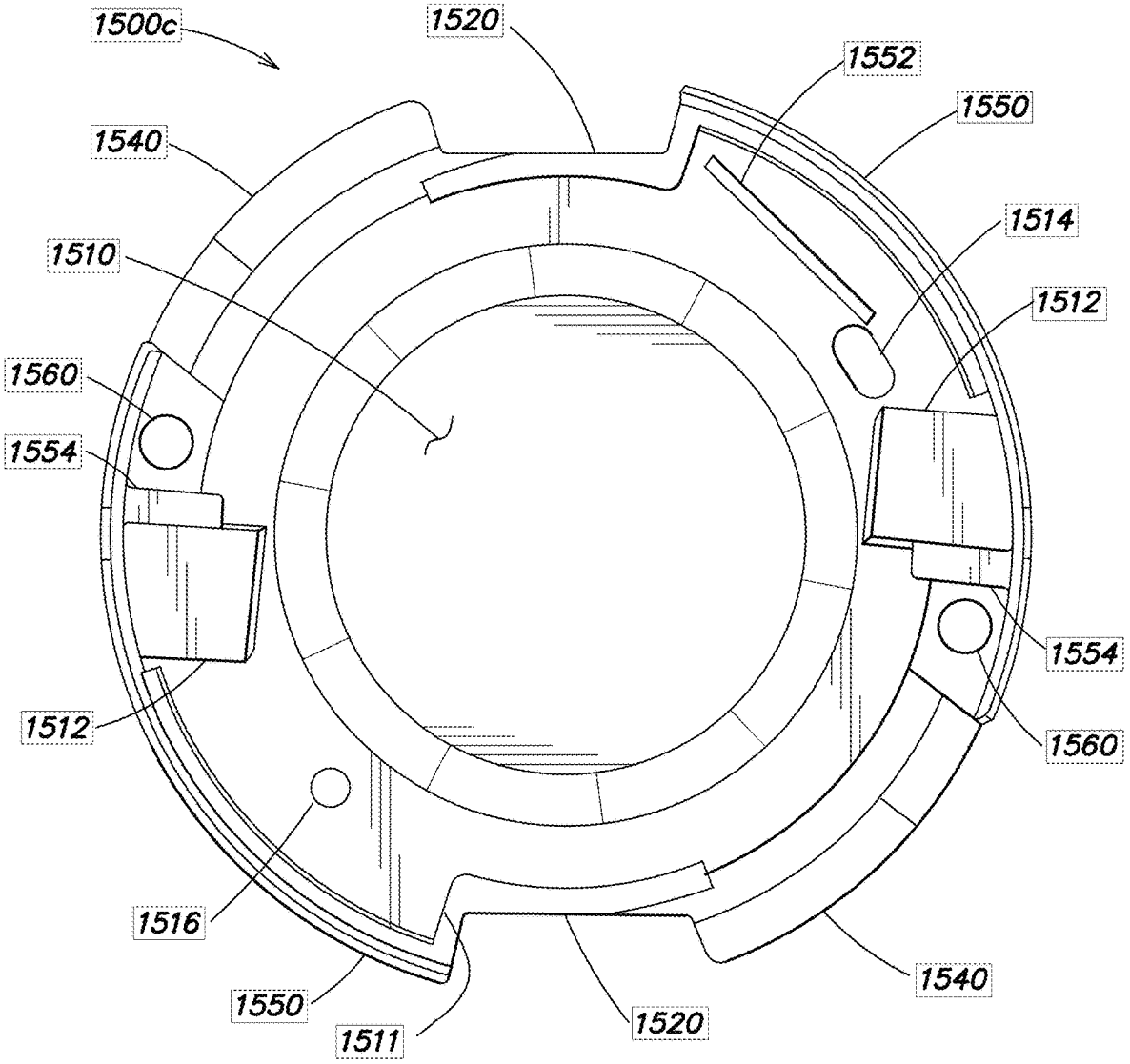
FIG. 17A shows a top view of a partition plate in the lighting fixture of FIG. 16.
Figure 17B:
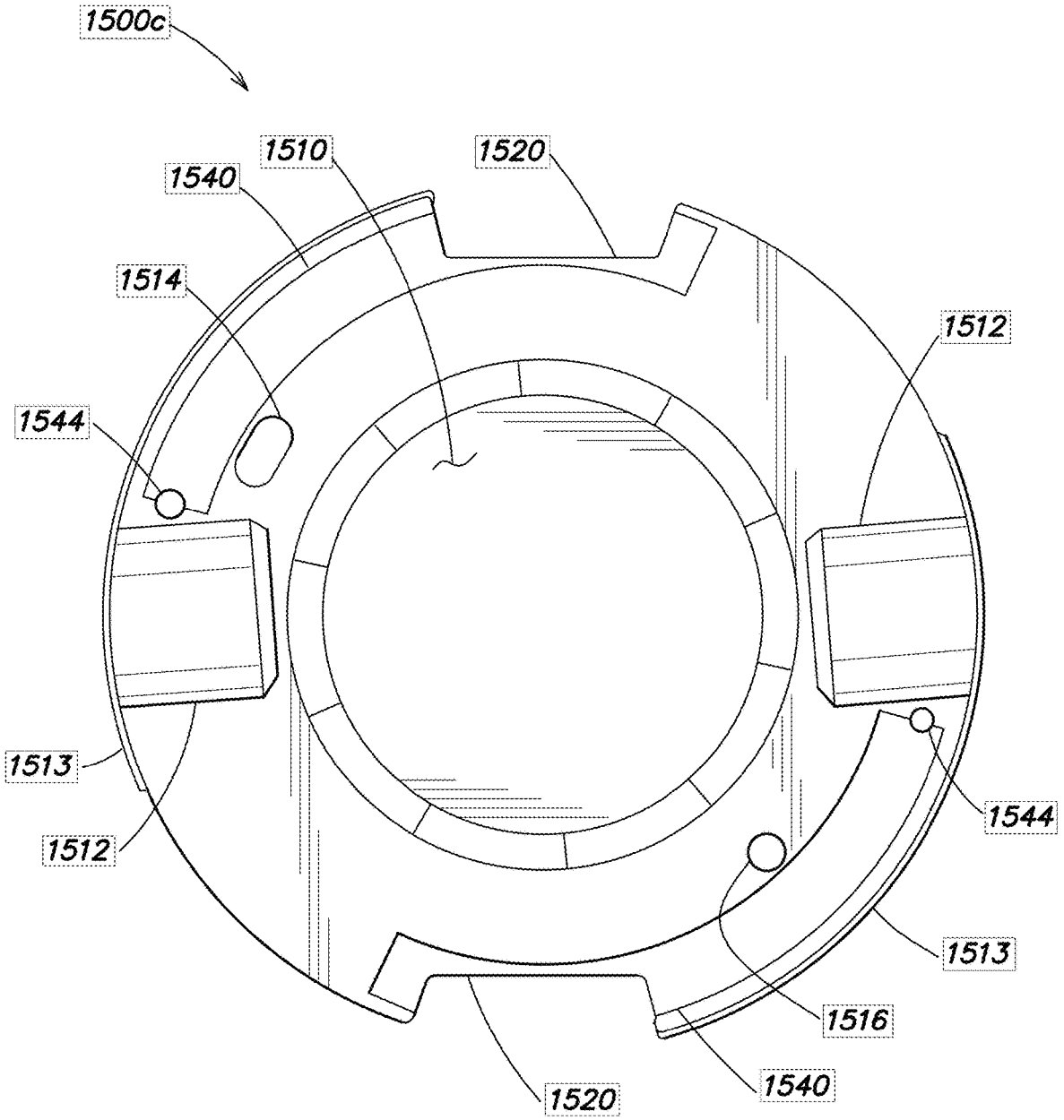
FIG. 17B shows a bottom view of the partition plate in FIG. 17A.
Figure 17C:
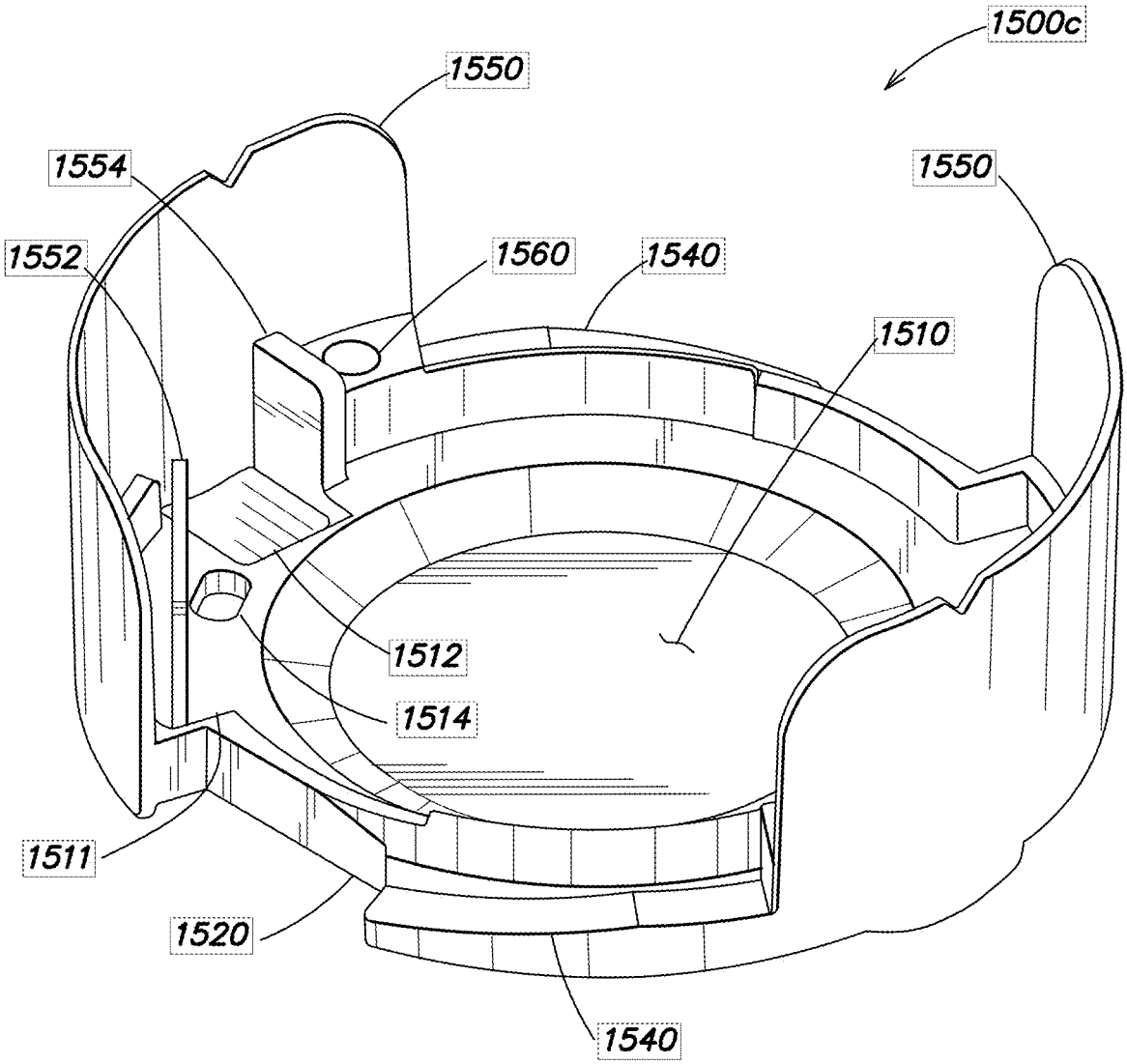
FIG. 17C shows a top, front perspective view of the partition plate in FIG. 17A.
Figure 17D:
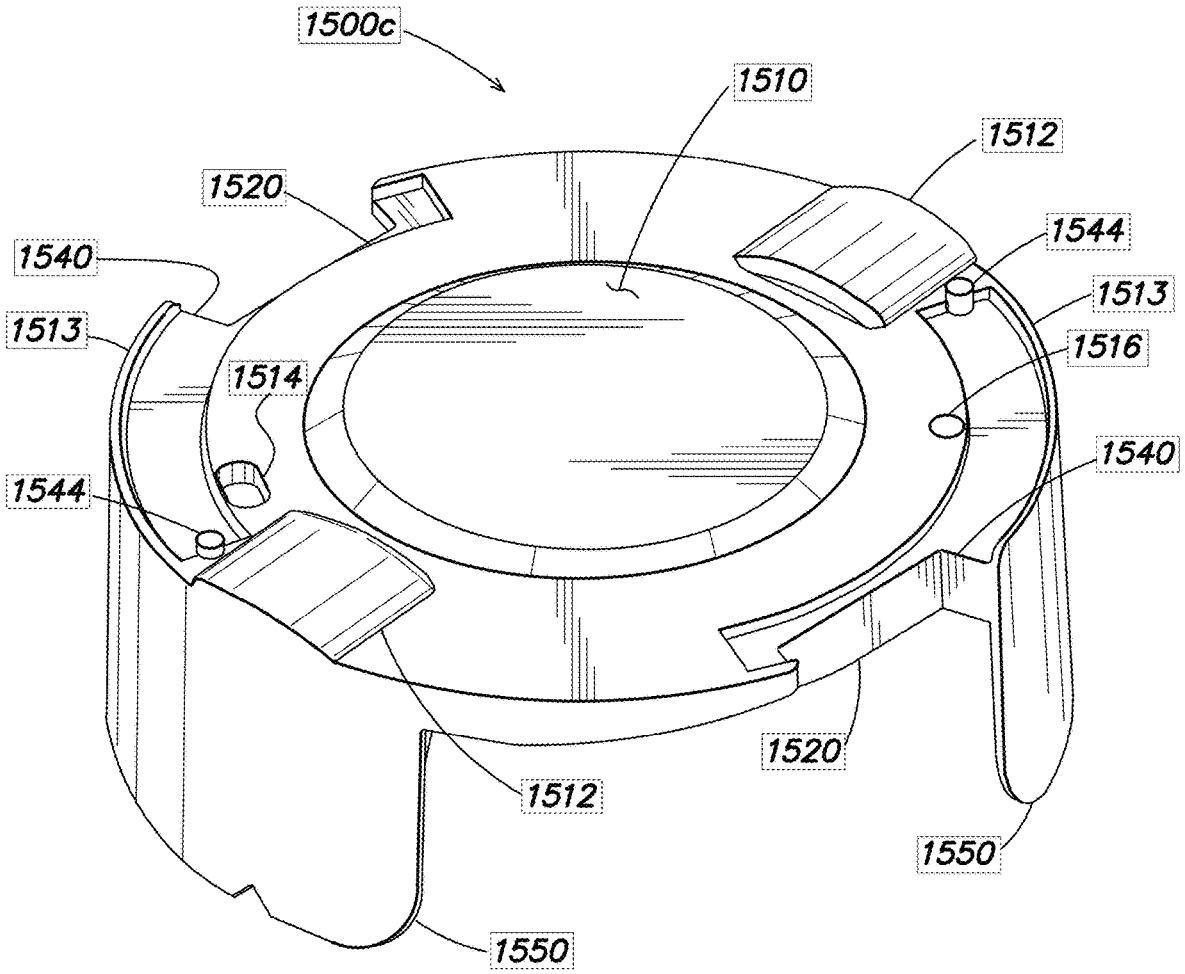
FIG. 17D shows a bottom, front perspective view of the partition plate of FIG. 17A.

FIGS. 17A-17D show several views of the partition plate 1500*c*. The partition plate 1500*c* may include several of the same features described above with respect to the other exemplary recessed lighting fixtures 1000. The partition plate 1500*c* may additionally include a stand-off connector 1560 disposed on the flange 1511 as shown in FIGS. 17A and 17C. The stand-off connector 1560 may be used to support a stand-off 1562 for assembly of a cover plate 1700 on the housing 1100*e*. In some implementations, the stand-off connector 1560 may be an opening in the flange 1511 configured to receive an insert. The insert may be threaded to secure the stand-off 1562 to the partition plate 1500*c*. In some implementations, the insert may be formed from a metal. In some implementations, the opening of the stand-off connector 1560 may be threaded depending on the material used to form the partition plate 1500*c*. As shown, the partition plate 1500*c* may include a pair of stand-off connectors 1562 disposed on opposing sides of the flange 1511.

As before, the partition plate 1500*c* may be formed from various metals, thermoplastic polymers, and thermosetting polymers including, but not limited to aluminum, steel, stainless steel, polyvinyl chloride (PVC), acrylonitrile butadiene styrene (ABS), polycarbonate (PC), and polyurethane (PU), polyethylene, polyethylene terephthalate, polypropylene, polystyrene, a Makrolon® polycarbonate, and a Therma-Tech™ thermally conductive compound. The partition plate 1500*c* may be fabricated using various manufacturing methods including, but not limited to injection molding, 3D printing, blow molding, casting, and machining.

Figure 18A:
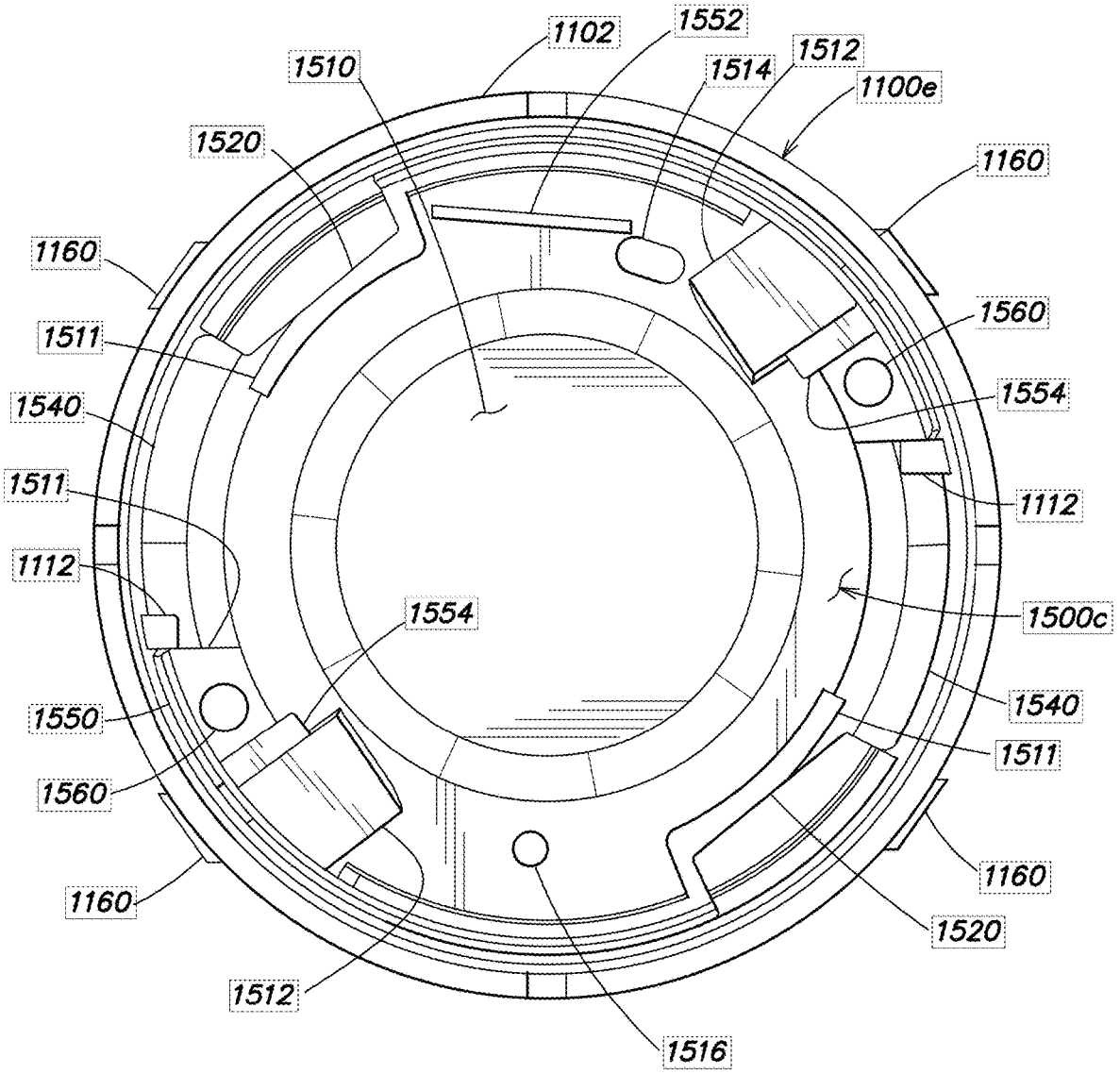
FIG. 18A shows a bottom view of the junction box of FIG. 13A with the partition plate of FIG. 17A inserted into the junction box.
Figure 18B:
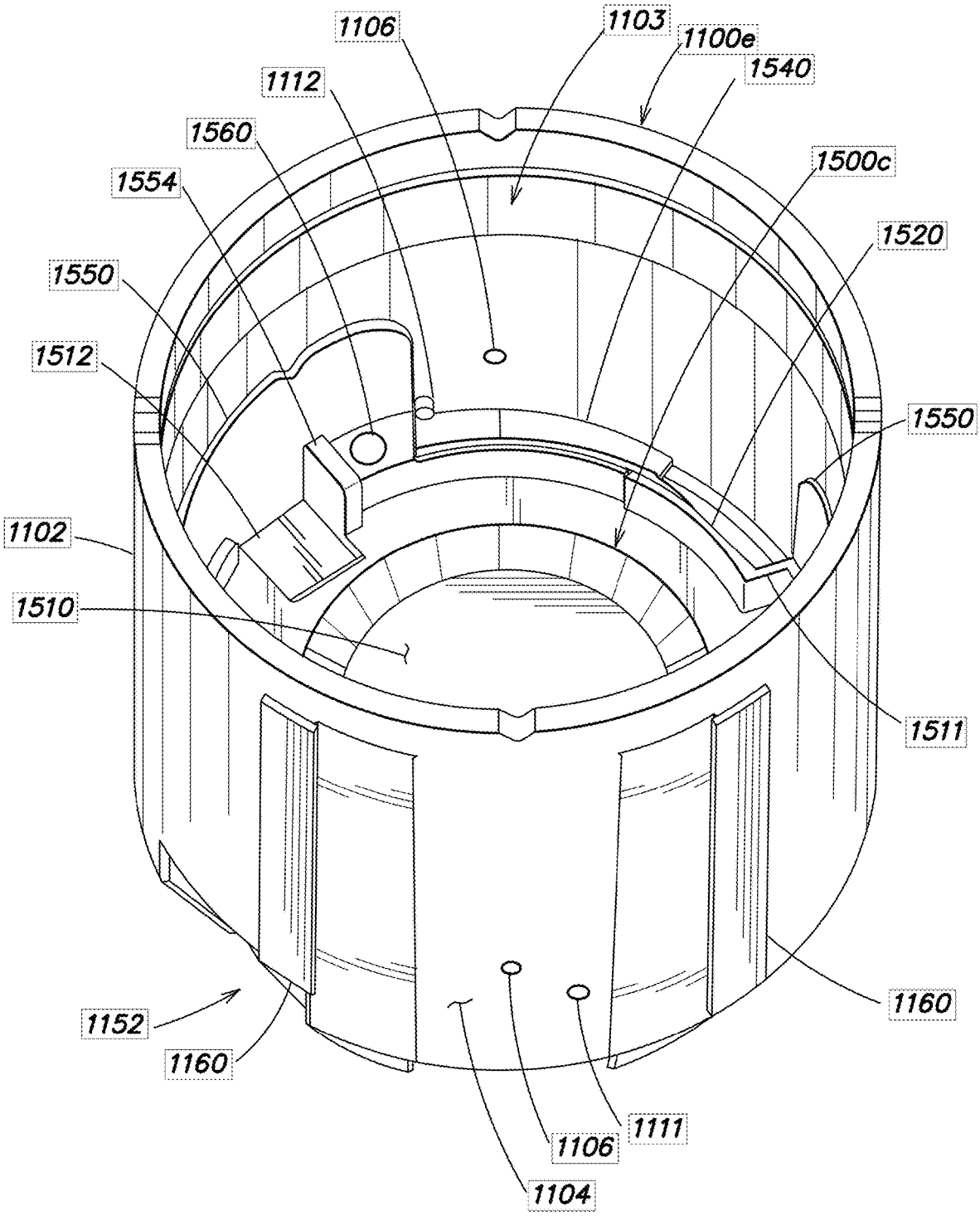
FIG. 18B shows a bottom, front perspective view of the junction box of FIG. 18A where the partition plate is at a fully locked position.

FIGS. 18A and 18B show the partition plate 1500*c* disposed in the cavity 1101 of the housing 1100*e*. As shown, the partition plate 1500*c* may be secured by the peg 1112 on the housing 1100*e*. Additionally, the stand-off connectors 1562 may be oriented to be accessible by a user after the partition plate 1500*c* is installed.

Figure 19A:
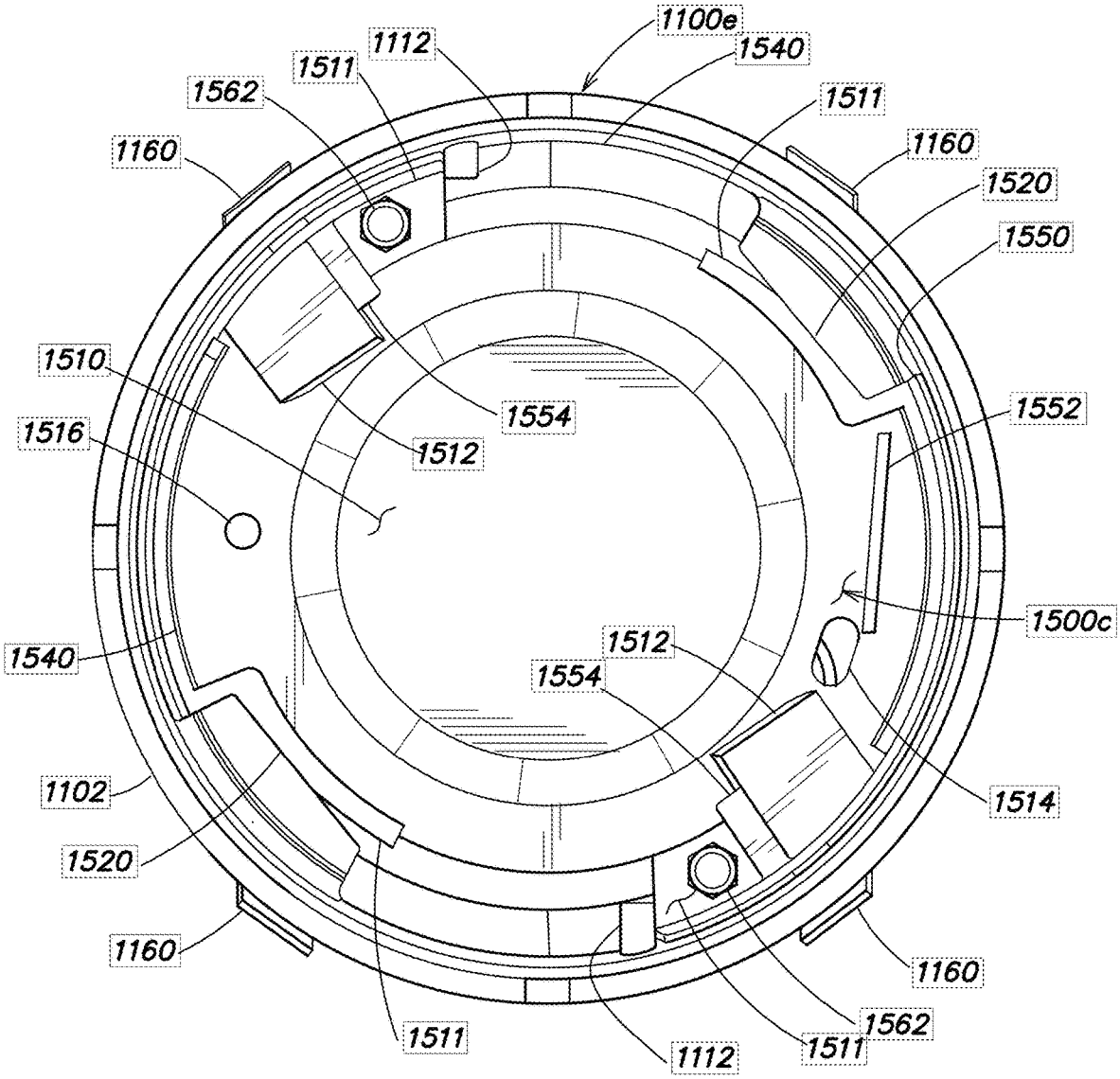
FIG. 19A shows a bottom view of the junction box of FIG. 13A with the partition plate of FIG. 17A inserted into the junction box and a stand-off coupled to the partition plate.
Figure 19B:
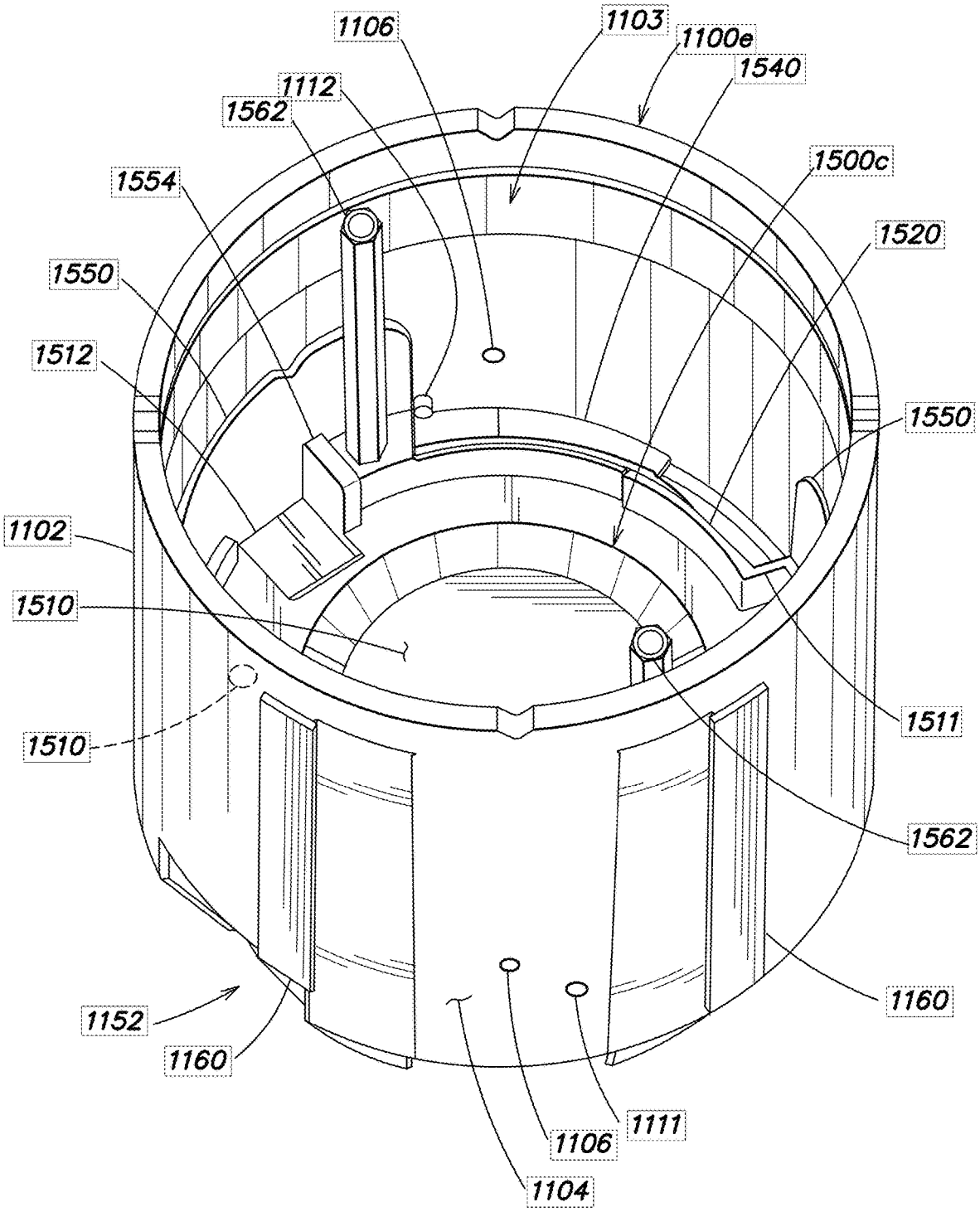
FIG. 19B shows a bottom, front perspective view of the junction box of FIG. 19A where the partition plate is at a fully locked position and the stand-off is coupled to the partition plate.
Figure 19C:
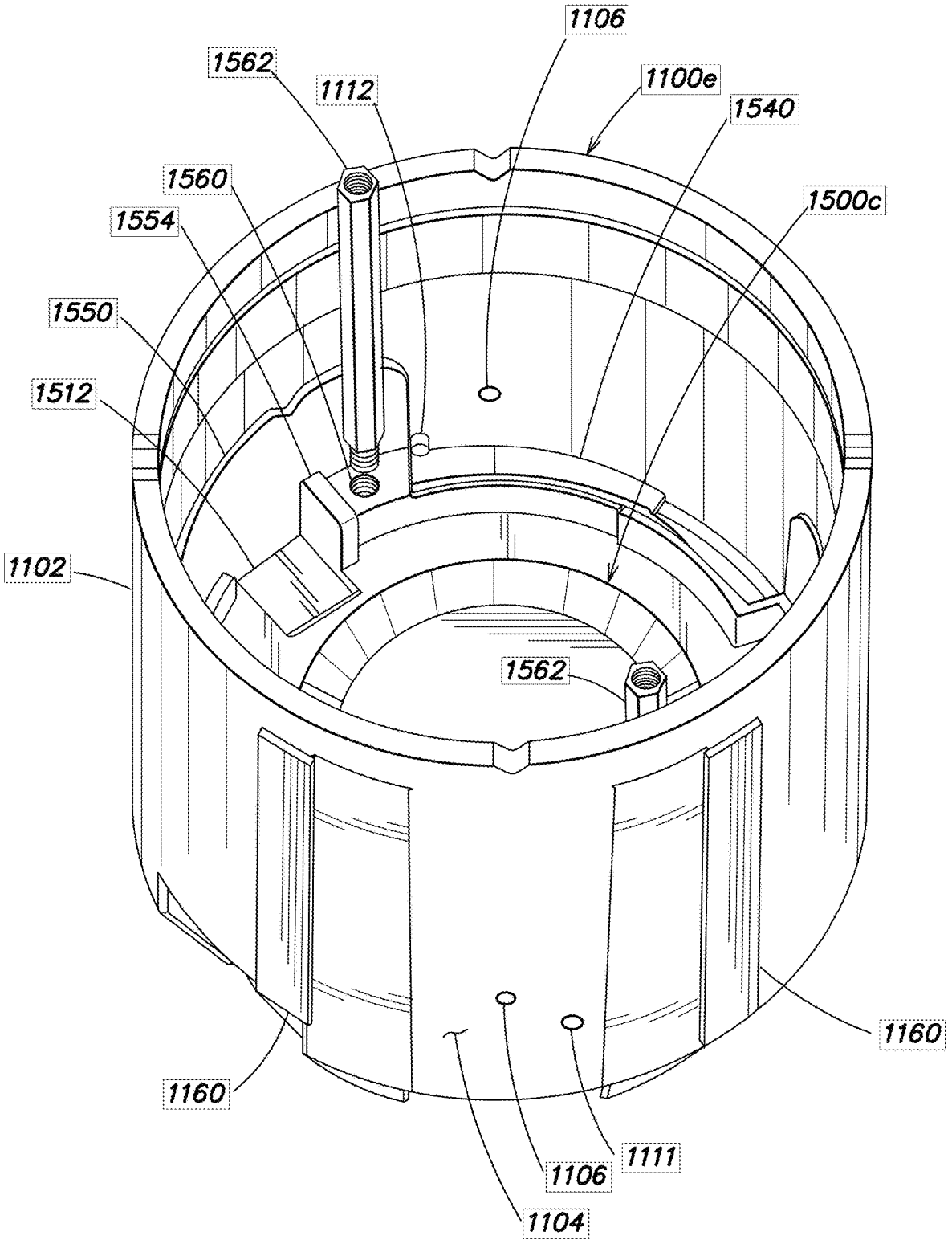
FIG. 19C shows an exploded bottom, front perspective view of the junction box and the stand-off of FIG. 19A.

FIGS. 19A-19D show the partition plate 1500*c* with a stand-off 1562 and a cover plate 1700 disposed on the opening 1103 of the housing 1100*e*. The cover plate 1700 may be used in a similar manner to where an electrical outlet in a building may be covered when unused such that the wall or ceiling does not have an exposed opening. As shown in FIGS. 19A-19C, the stand-off 1562 may be an elongated component with a coupling mechanism (e.g., a threaded male connector) at one end to connect to the stand-off connector 1560 on the partition plate 1500*c*. At the other end, the stand-off 1562 may have a coupling mechanism configured to couple the cover plate 1700 to the opening 1103 of the housing 1100*e*. Various types of coupling mechanisms may be used including, but not limited to a screw fastener, a bolt fastener, a snap fit connector, and an adhesive.

Figure 19D:
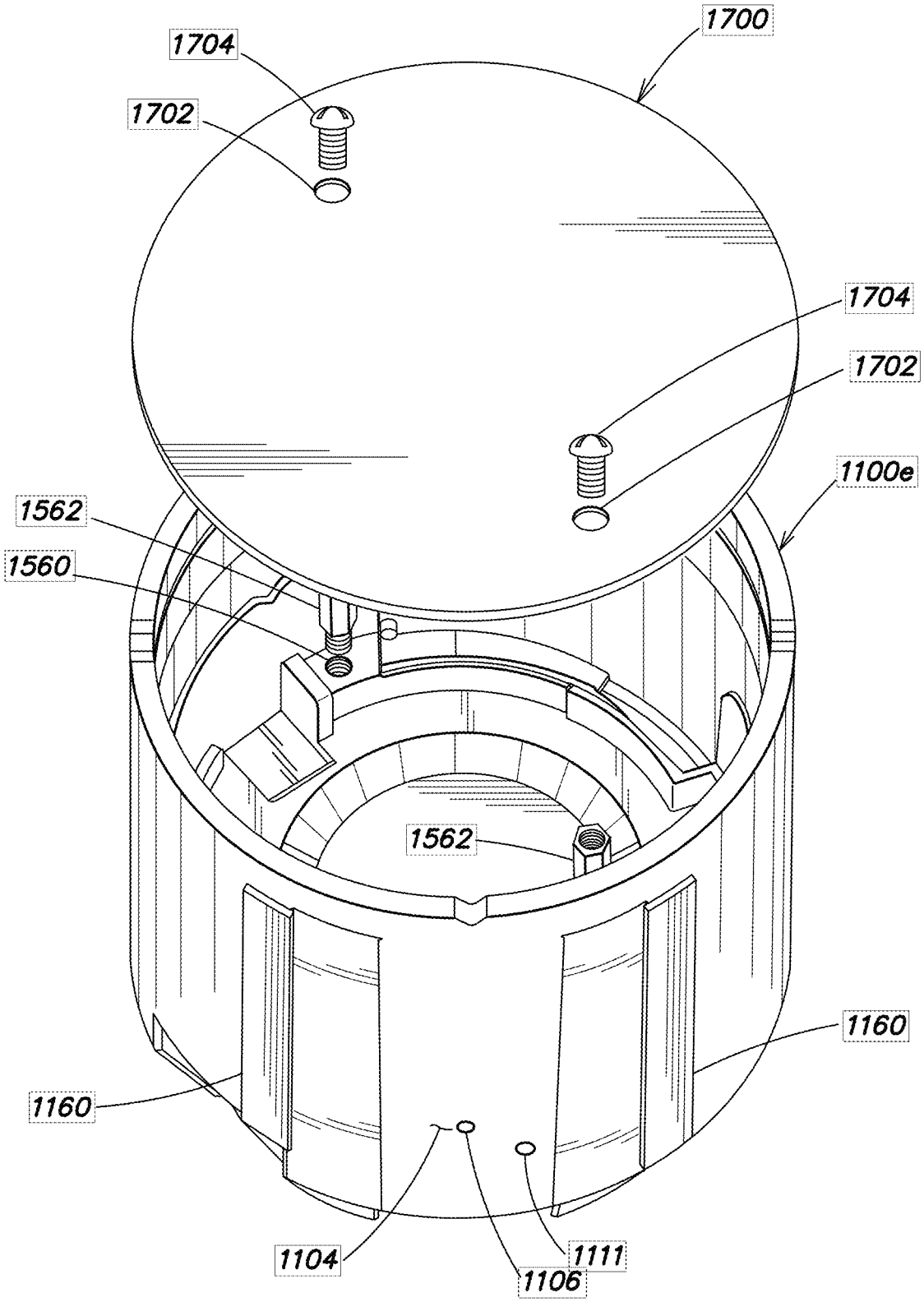
FIG. 19D shows a bottom, front perspective view of the junction box of FIG. 19A and a cover plate.

FIG. 19D shows the cover plate 1700 may be placed onto the opening 1103 of the housing 1100*e*. As shown, the cover plate 1700 may substantially cover the opening 1103. The cover plate 1700 may have various shapes including, but not limited to a circle, an ellipse, a regular polygon, and an irregular polygon. In some implementations, the cover plate 1700 may also include a beveled or a tapered edge where a central portion of the cover plate 1700 protrudes outwards from the opening 1103 of the housing 1100*e* while an edge portion of the cover plate 1700 abuts a portion of the opening 1103 and/or the ceiling or wall. The cover plate 1700 depicted in FIG. 19D may be coupled to the stand-offs 1562 using screw fasteners 1704 inserted through holes 1702 on the cover plate 1700.

The stand-off 1562 and the cover plate 1700 may be formed from various metals, thermoplastic polymers, and thermosetting polymers including, but not limited to aluminum, steel, stainless steel, polyvinyl chloride (PVC), acrylonitrile butadiene styrene (ABS), polycarbonate (PC), and polyurethane (PU), polyethylene, polyethylene terephthalate, polypropylene, polystyrene, a Makrolon® polycarbonate, and a Therma-Tech™ thermally conductive compound. The stand-off 1562 and the cover plate 1700 may be fabricated using various manufacturing methods including, but not limited to injection molding, 3D printing, blow molding, casting, and machining.

Conclusion

All parameters, dimensions, materials, and configurations described herein are meant to be exemplary and the actual parameters, dimensions, materials, and/or configurations will depend upon the specific application or applications for which the inventive teachings is/are used. It is to be understood that the foregoing embodiments are presented primarily by way of example and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein.

In addition, any combination of two or more such features, systems, articles, materials, kits, and/or methods, if such features, systems, articles, materials, kits, and/or methods are not mutually inconsistent, is included within the inventive scope of the present disclosure. Other substitutions, modifications, changes, and omissions may be made in the design, operating conditions and arrangement of respective elements of the exemplary implementations without departing from the scope of the present disclosure. The use of a numerical range does not preclude equivalents that fall outside the range that fulfill the same function, in the same way, to produce the same result.

Also, various inventive concepts may be embodied as one or more methods, of which at least one example has been provided. The acts performed as part of the method may in some instances be ordered in different ways. Accordingly, in some inventive implementations, respective acts of a given method may be performed in an order different than specifically illustrated, which may include performing some acts simultaneously (even if such acts are shown as sequential acts in illustrative embodiments).

All publications, patent applications, patents, and other references mentioned herein are incorporated by reference in their entirety.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of" when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A housing for a lighting system, the housing comprising:

a sidewall defining a cavity and having a first end and a second end disposed opposite to the first end, the first end defining an opening to access the cavity, at least a portion of the sidewall having a circular cross-sectional shape;

a cover having a circular shape to enclose the second end and form a beveled portion;

at least one knockout formed only on the cover; and at least one feedthrough tab formed on the beveled portion, the at least one feedthrough tab being bendable into and out of the cavity, wherein the sidewall, the cover, the at least one knockout, and the at least one feedthrough tab are formed as a single component.

2. The housing of claim 1, wherein the housing is formed of at least one of polyvinyl chloride (PVC), polycarbonate (PC), polyurethane (PU), or acrylonitrile butadiene styrene (ABS).

3. The housing of claim 1, wherein the sidewall does not include a fastener opening disposed proximate to or on the first end to receive a fastener.

4. The housing of claim 1, wherein the sidewall has a first exterior diameter proximate to the first end and a second exterior diameter, proximate to the cover, smaller than the first exterior diameter.

5. The housing of claim 1, wherein the sidewall further comprises:

four notches formed on the first end of the sidewall to divide the first end of the sidewall into four curved segments of equal length.

6. The housing of claim 1, wherein:

the at least one feedthrough tab forms a feedthrough opening for an electrical cable to enter the cavity when the at least one feedthrough tab is bent into the cavity; and the at least one feedthrough tab generates a restraining force to hold the electrical cable in place within the cavity when the at least one feedthrough tab is bent and the electrical cable is present.

7. The housing of claim 6, further comprising:

the electrical cable fed through the feedthrough opening by bending the at least one feedthrough tab into the cavity, the electrical cable being a non-metallic sheathed cable.

8. The housing of claim 1, wherein:

the cover has a first thickness; and the at least one knockout has a second thickness smaller than the first thickness.

9. The housing of claim 8, wherein:

the cover has a first surface abutting the cavity and a second surface opposite the first surface; and the at least one knockout does not protrude from the first and second surfaces of the cover.

10. The housing of claim 1, wherein the cavity is sufficiently large to contain at least 8 electrical cables where each electrical cable has a gauge greater than or equal to 12, a light module, and at least a portion of a trim when the electrical cables, the light module, and the trim are present.

11. The housing of claim 1, wherein the cavity has a volume that ranges between 15 cubic inches and 30 cubic inches.

12. A housing for a lighting system, comprising:

a sidewall defining a cavity and having a first end and a second end disposed opposite the first end, the first end defining an opening to access the cavity;

a cover to enclose the second end and form a beveled portion;

at least one knockout formed only on the cover; and at least one feedthrough tab formed on the beveled portion, the at least one feedthrough tab being bendable into and out of the cavity, wherein:

the sidewall, the cover, the at least one knockout, and the at least one feedthrough tab are formed of a polymer; and the sidewall does not include a hole disposed proximate to or on the first end to receive a fastener.

13. The housing of claim 12, wherein the polymer includes at least one of polyvinyl chloride (PVC), polycarbonate (PC), polyurethane (PU), or acrylonitrile butadiene styrene (ABS).

14. The housing of claim 12, wherein the sidewall has a first exterior diameter proximate to the first end and a second exterior diameter, proximate to the cover, that is smaller than the first exterior diameter.

15. The housing of claim 12, wherein the sidewall has a circular cross-sectional shape.

16. The housing of claim 12, wherein:

the at least one feedthrough tab forms a feedthrough opening for an electrical cable to enter the cavity when the at least one feedthrough tab is bent into the cavity; and the at least one feedthrough tab generates a restraining force to hold the electrical cable in place within the cavity when the at least one feedthrough tab is bent and the electrical cable is present.

17. The housing of claim 12, wherein:

the at least one feedthrough tab comprises:

a first feedthrough tab; and a second feedthrough tab disposed diametrically opposite to the first feedthrough tab; and at least a portion of the at least one knockout is disposed between the first and second feedthrough tabs.

18. A lighting system, comprising:

the housing of claim 12;

a light module, disposed in the cavity of the housing, to emit light out of the opening of the housing;

a trim, partially disposed in the cavity of the housing such that only a flange of the trim is disposed outside the cavity; and an electrical cable, routed into the cavity of the housing through a feedthrough opening formed by bending the at least one feedthrough tab into the cavity, to supply power to the light module.

19. A housing for a lighting system, comprising:

a sidewall defining a cavity and having a first end and a second end disposed opposite to the first end, the first end defining an opening to access the cavity, at least a portion of the sidewall having a circular cross-sectional shape, the sidewall having four notches formed on the first end to divide the first end into four curved segments of equal length;

a cover to enclose the second end and form a beveled portion, the cover having a circular shape and a first thickness;

a first feedthrough tab formed on the beveled portion;

a second feedthrough tab formed on the beveled portion and disposed diametrically opposite to the first feedthrough tab; and at least one knockout formed only on the cover and disposed between the first and second feedthrough tabs, the at least one knockout having a second thickness smaller than the first thickness, wherein:

the sidewall, the cover, the first feedthrough tab, the second feedthrough tab, and the at least one knockout are formed as a single component from at least one of polyvinyl chloride (PVC) or polycarbonate (PC);

the sidewall does not include a fastener opening disposed proximate to or on the first end to receive a fastener; and the sidewall has a first exterior diameter proximate to the first end and a second exterior diameter proximate to the cover that is smaller than the first exterior diameter.

20. A lighting system, comprising:

the housing of claim 19;

a light module, disposed in the cavity of the housing, to emit light out of the opening of the housing;

a trim, partially disposed in the cavity of the housing such that only a flange of the trim is disposed outside the cavity; and a plurality of electrical cables, routed into the cavity of the housing through one or more feedthrough openings formed by at least one of removing the at least one knockout or bending the first feedthrough tab and/or the second feedthrough tab, to at least one of supply power to the light module or transmit power.

* * * * *